United States Patent [19]

Ishikawa et al.

[11] Patent Number: 4,965,176

[45] Date of Patent: Oct. 23, 1990

[54] METHOD FOR PROCESSING LIGHT-SENSITIVE SILVER HALIDE COLOR PHOTOGRAPHIC MATERIAL

[75] Inventors: Masao Ishikawa; Satoru Kuse, both of Tokyo, Japan

[73] Assignee: Konica Corporation, Tokyo, Japan

[21] Appl. No.: 238,755

[22] Filed: Aug. 30, 1988

[30] Foreign Application Priority Data

Sep. 2, 1987 [JP] Japan ..... 62-220061
Sep. 10, 1987 [JP] Japan ..... 62-227709

[51] Int. Cl.[5] ..... G03C 1/485; G03C 5/24; G03C 7/30

[52] U.S. Cl. ..... 430/378; 430/393; 430/434; 430/440; 430/445; 430/464; 430/467; 430/487; 430/489; 430/551; 430/558

[58] Field of Search ..... 430/380, 378, 393, 430, 430/434, , 440, 445, 464, 467, 476, 484, 485, 487, 489, 551, 558

[56] References Cited

U.S. PATENT DOCUMENTS

| | | | |
|---|---|---|---|
| Re. 30,064 | 8/1979 | Shimamura et al. | 430/490 |
| 4,124,391 | 11/1978 | Ogawa et al. | 430/442 |
| 4,264,721 | 4/1981 | Shimano et al. | 430/551 |
| 4,552,834 | 11/1985 | Lau et al. | 430/393 |
| 4,745,047 | 5/1988 | Asami et al. | 430/380 |
| 4,766,057 | 8/1988 | Sakai | 430/380 |
| 4,774,167 | 9/1988 | Koshimizu et al. | 430/380 |
| 4,797,350 | 1/1989 | Ohbayashi et al. | 430/380 |
| 4,800,153 | 1/1989 | Morimoto et al. | 430/380 |
| 4,801,516 | 1/1989 | Ishikawa et al. | 430/380 |
| 4,851,326 | 7/1989 | Ishikawa et al. | 430/380 |
| 4,853,321 | 8/1989 | Momoki et al. | 430/380 |

FOREIGN PATENT DOCUMENTS

| | | | |
|---|---|---|---|
| 173540 | 3/1986 | European Pat. Off. . | |
| 219841 | 4/1987 | European Pat. Off. . | |
| 230997 | 8/1987 | European Pat. Off. . | |
| 123459 | 6/1987 | Japan . | |
| 145730 | 12/1987 | Japan . | |
| 037348 | 2/1988 | Japan | 430/380 |
| 0475533 | 8/1987 | PCT Int'l Appl. | 430/380 |

OTHER PUBLICATIONS

Abstract of 4,851,326, (Not Yet Published) Ishikawa et al. , 7/89, "Method for Processing Silver Halide . . .".
Abstract of 4,853,321, (Not Yet Published), Momoki et al., 8/89, "Method of Forming a Colored Image . . .".
Derwent Abstracts of J01 062641, DD-208686, 78 JP-133954, J63 040,140 and J63 029752.
J53-32035, Fuji Photo, "Color Photographic Processing Method," Abstract Only, 3/78,

*Primary Examiner*—Paul R. Michl
*Assistant Examiner*—Patrick A. Doody
*Attorney, Agent, or Firm*—Jordan B. Bierman

[57] ABSTRACT

There is disclosed a method for processing a light-sensitive silver halide color photographic material, characterized in that the light-sensitive silver halide color photographic material contains a core-shell type-internal latent image type silver halide emulsion a shell of which contains at least silver chloride, and the light-sensitive silver halide color photographic material is processed with a color developing solution containing the compound represented by the following formula (A):

(A)

wherein $R_1$ and $R_2$ each represent a hydrogen atom or an alkyl group having 1 to 5 carbon atoms which may have a substituent or substituents, or $R_1$ and $R_2$ may be combined to form a ring, provided that the case where $R_1$ and $R_2$ are hydrogen atoms at the same time is excluded.

18 Claims, No Drawings

METHOD FOR PROCESSING LIGHT-SENSITIVE SILVER HALIDE COLOR PHOTOGRAPHIC MATERIAL

BACKGROUND OF THE INVENTION

This invention relates to a method for processing a light-sensitive silver halide color photographic material. More particularly, it pertains to a method for processing a light-sensitive silver halide color photographic material which is capable of rapid developing processing and which is improved in processing stability in said rapid developing processing, or a method for processing a light-sensitive silver halide color photographic material in which fluctuation of minimum density (Dmin) at the running processing can be prevented and also lowering of maximum density (Dmax) can be prevented with maintaining preservability (stability during preservation) of the color developing solution.

In recent years, in this field of art, it has been desired to develop a technique which is capable of rapid processing of a light-sensitive silver halide color photographic material and yet also excellent in processing stability to thereby produce stable photographic characteristics.

More specifically, for light-sensitive silver halide color photographic material, running processing has been practiced by an automatic developing machine provided at each laboratory, and as a part of improvement of services to users, it has been demanded that the developing processing of the material be completed returned within the very day on which the material was received. Recently, it has been demanded to return the material even several hours after receipt. Thus, development of a technique capable of rapid processing has been in great demand.

To review the prior art regarding rapid processing of light-sensitive silver halide color photographic material, the techniques may be broadly classified into:

[1]the technique through improvement of light-sensitive silver halide color photographic material;

[2]the technique through physical means during developing processing; and

[3]the technique through improvement of the processing solution composition to be used in developing processing.

Concerning the above [1], there may be included (1) improvement of silver halide composition (e.g., fine grain formation as disclosed in Japanese Provisional Patent Publication No. 77223,/1976, the lowered silver bromide technique of silver halide as disclosed in Japanese Provisional Patent Publication No. 784142/1983, or Japanese Patent Publication No. 18939/1981); (2) use of an additive (e.g., the technique of adding a 1-aryl-3-pyrazolidone having a specific structure to light-sensitive silver halide color photographic material as disclosed in Japanese Provisional Patent Publication No. 64339/1981 or the technique of adding a 1-aryl-pyrazolidone to light-sensitive silver halide color photographic material as disclosed in Japanese Provisional Patent Publications No. 144547/1982, No. 50534/1983, No. 50535/1983 and No. 50536/1983); (3) the technique of a high speed reactive coupler (e.g., the technique of using a high speed reactive coupler as disclosed in Japanese Patent Publication No. 10783/1976, Japanese Provisional Patent Publications No. 123342/1975 and No. 102636/1976); and (4) the thin film formation technique of photographic constituent layers (e.g., the thin film formation technique of photographic constituent layers as disclosed in Japanese Patent Publication No. 204992/1985).

Concerning the above [2], there is the stirring technique of processing solution (e.g., the stirring technique of processing solution as disclosed in Japanese Patent Publication No. 23334/1986).

Concerning the above [3], there have been known (1) the technique of employing a developing accelerator; (2) the technique of thickening the color developing solution; and (3) the technique of lowering the concentration of halide ions.

The present invention, from among these rapid processing techniques of [1], [2]and [3], concerns the above [3]. Processing of light-sensitive material comprises basically the two steps of color developing and desilverization. Said desilverization comprises the steps of bleaching and fixing or the step of bleach-fixing. Otherwise, as additional steps, rinsing processing, stabilizing processing, water washing or stabilizing processing substituted with water washing may be added. More specifically, in color developing, the silver halide exposed is reduced to silver and at the same time the aromatic primary amine developing agent reacts with a coupler to form a dye. During this process, halide ions formed by reduction of silver halide are dissolved in the developing solution to be accumulated therein. Also separately, the components such as inhibitor, etc. contained in the light-sensitive material are also dissolved in the color developing solution to be accumulated therein. In the desilverization step, the silver formed by development is bleached with an oxidizing agent, and then all the silver salts are removed with the fixing agent as soluble silver salts from within the light-sensitive material. Also known is a the one bath bleach-fixing processing method in which the bleaching step and the fixing step are processed all at once.

Of the techniques for improving the processing solution composition, the present inventors have investigated (2) the technique of thickening the color developing solution to be used for developing processing of the above [3]. This technique is a method for increasing activity by increasing the color developing agent in the color developing solution during the color developing step, but due to the extremely expensive cost of color developing agent, the processing solution becomes relatively higher in cost and at the same time the above developing agent is difficultly soluble in water to be unstably and easily precipitated. Thus, it has been found to be practically unapplicable.

Accordingly, the present inventors have investigated (3) the technique of lowering the halide ion concentration. Of the techniques through improvement of processing solution composition to be used for development processing of the above [3]. This technique is a technique which increases the development activity by increasing the amount of color developing solution supplemented to thereby to lower the halide ion concentration accumulated in the developing solution.

The present inventors have attempted to apply such a technique of lowering the halide ion concentration to various silver halide emulsions.

As described above, it has been known that the halide ion concentration in color developing solution has an influence on rapid processing, and a similar effect was also anticipated in the processing of internal latent type light-sensitive silver halide color photographic material.

According to the study of the present inventors, a color developing solution having a halide ion concentration, particularly a bromide ion concentration, in excess of $4.0\times10^{-3}$ mole/liter may have an influence on both the surface latent image type emulsion and the internal latent image type emulsion. However, it has been found that the developing acceleration effect on the internal latent image type emulsion is very great when the developing solution has a halide ion concentration, particularly a bromide ion concentration of $4.0\times10^{-3}$ mole/liter or less.

Particularly, it has been found that the effect of rapid processing for an internal latent image type emulsion containing a mercapto type inhibitor is marked in processing with a color developing solution having a bromide ion concentration of $4.0\times10^{-3}$ mole/liter or less. Further, it has been found that the effect is great in a color developing solution containing substantially no benzyl alcohol.

In color developing, silver halide which had been exposed is converted into silver by reduction and at the same time an oxidized aromatic primary amine developing agent forms a dye by reacting with a coupler.

In the color developing solution to be used in such color developing, sulfites, or a water-soluble salt of sulfite and hydroxylamine is added as a preservative (antioxidant) in order to increase preservability thereof. Among them, in the color developing solution using a sulfite singly as in the former case, generation of fog becomes remarkably high as time lapse. Thus, as in the latter case, by combinedly using a water-soluble salt of a sulfite and hydroxylamine, the preservability of the developing solution is remarkably increased and the generation of fog in the lapsed developing solution is decreased.

However, handling hydroxylamine is extremely inconvenient since the general distributor of poisonous substances and powerful medicines requires its registration. A person must be appointed who is responsible for handling the hydroxylamine in order to handle and sell the salts based on the poisonous substances and powerful medicines management law.

Accordingly, when self-treatment at the shop or color copying loaded with a color development system is carried out in the future, it has strongly been desired to develop a preservative substituting for the hydroxylamine.

As the preservative substituting for the hydroxylamine, 2-anilinoethanol and dihydroxyalkene have been proposed in U.S. Pat. Nos. 3,823,017 and No. 3,615,503, respectively. However, these compounds are themselves unstable and have no preservative effect in a color developing solution.

On the other hand, in a developing solution (for black and white photography) containing hydroquinone or N-alkyl-paminophenol as the developing agent, sucrose has been known as a preservative, but sucrose seldom has any effect as a preservative in a color developing solution containing an aromatic primary amine as the developing agent.

Also, ascorbic acid and its derivatives have been known as preservative for both the developing solution for black- and-white photography developing solution and the color developing solution, but these materials have a defect of inhibiting color formation and causing a remarkable decrease in color density. Therefore, ascorbic acid and its derivatives are inferior to the hydroxylamine in the color developing solution.

Further, α-hydroxy-aromatic alcohols described in Japanese Provisional Patent Publication No. 7779/1977, hydroxamic acid compounds as described in Japanese Provisional Patent Publication No. 27638/1977, o-aminocarbonyl compounds described in Japanese Provisional Patent Publication No. 143020/1977, monosaccarides described in Japanese Provisional Patent Publication No. 102727/1977, and amino acid derivatives described in Japanese Provisional Patent Publication No. 140324/1977 have been disclosed.

However, when a large amount of monosaccarides or amino acid derivatives are employed, they show fairly good preservability, but they are easily decomposed by heat and have undesirable characteristics with respect to pollution.

D-glucosamine hydrochloride salt is the representative compound of the α-aminocarbonyl compounds, but the compound is inferior in preservability to hydroxylamines.

Also, while the hydroxamic acid compound has the same preservability as that of the hydroxylamine, it has the defect of high cost.

Thus, the present inventors have carried out development of the preservative having preservability (antioxidizing characteristics of the developing agent) substituting for the hydroxylamine. As a result, they have found that hydroxylamine derivatives are the most preferred preservatives but these compounds involve the following problems. That is, fluctuation of the minimum density (Dmin) at the running processing is large, and fluctuation of the maximum (Dmax) is also large, which has not been observed in the conventional hydroxylamine. However, according to further researches, it can be found that the above two problems can be solved by using an internal latent image type light-sensitive material having a specific silver halide.

Particularly, the effect of restraining fluctuation of the minimum density (Dmin) at the running processing is remarkable and it can be found that decrease of the maximum density (Dmax) can be prevented without decreasing preservability.

SUMMARY OF THE INVENTION

Accordingly, an object of the present invention is to provide a method for development processing of a light-sensitive silver halide color photographic material which is capable of rapid development processing, high in stable photographic performance, particularly in the maximum density and which inhibits fog production.

Also, another object of the present invention is to provide a method for processing a light-sensitive silver halide color photographic material which is inhibited in fluctuation of the minimum density (Dmin) at the running processing as well as inhibited in decrease of the maximum density (Dmax) maintaining preservability of a color developing solution.

The present invention which accomplishes the above object is a method for processing a light-sensitive silver halide color photographic material, characterized in that said light-sensitive silver halide color photographic material contains an internal latent image type silver halide emulsion which has not been previously fogged and said light-sensitive silver halide color photographic material is processed with a color developing solution with a bromide ion concentration of $4.0\times10^{-3}$ mole/-liter or less.

Also, the present invention which accomplishes the above object is a method for processing a light-sensitive silver halide color photographic material, characterized in that said light-sensitive silver halide color photographic material contains a core-shell type-internal latent image type silver halide emulsion a shell of which contains at least silver chloride, and said light-sensitive silver halide color photographic material is processed with a color developing solution containing the compound represented by the following formula (A):

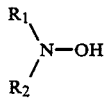

(A)

wherein $R_1$ and $R_2$ each represent a hydrogen atom or an alkyl group having 1 to 5 carbon atoms which may have a substituent or substituents, or $R_1$ and $R_2$ may be combined to form a ring (for example, a heterocylyl ring such as pyperidine or morpholine may be formed), provided that the case where $R_1$ and $R_2$ are hydrogen atoms at the same time is excluded.

DESCRIPTION OF THE PREFERRED EMBODIMENTS

In the following, the present invention will be described in more detail.

The internal latent image type (internal latent type) silver halide emulsion to be used in the present invention is an emulsion which forms a latent image primarily in the internal portions of silver halide grains and has most of the light-sensitive nuclei in the internal portions of the grains. This emulsion may include any desired silver halide, for example, silver bromide, silver chloride, silver iodochloride, silver chlorobromide, silver iodobromide, silver chloroiodobromide, and the like. Among them, with respect to the grain and speed of development, silver chloride, silver chlorobromide, silver chloroiodobromide and silver iodochloride are preferred, and particularly silver chlorobromide is most preferred. The internal latent image type silver halide emulsion which has not been previously fogged on the grain surface means that, when a test strip coated with the emulsion to be used in the present invention, on a transparent support to 35 mg Ag/cm$^2$ is developed without exposure with the surface developing solution A shown below at 20° C. for 10 minutes, the density obtained does not exceed 0.6, preferably 0.4.

| Surface developing agent A | |
|---|---|
| Metol | 2.5 g |
| ι-Ascorbic acid | 10 g |
| $NaBO_2.4H_2O$ | 35 g |
| KBr | 1 g |
| made up to one liter with addition of water. | |

Also, the silver halide emulsion according to the present invention gives sufficient density, when the test strip prepared as described above is developed after exposure with the internal developing solution B of the recipe shown below.

| Internal developing solution B | |
|---|---|
| Metol | 2 g |
| Sodium sulfite (anhydrous) | 90 g |
| Hydroquinone | 8 g |
| Sodium carbonate (monohydrate) | 52.5 g |
| KBr | 5 g |
| made up to one liter with addition of water. | |

To describe in more detail, when a part of the above test strip is exposed to light intensity scale over a predetermined time up to about one second and developed with the internal developing solution B at 20° C. for 10 minutes, it exhibits the maximum density which is at least 5-fold, preferably 10-fold of that obtained when another part of said test strip subjected to exposure under the same conditions is developed with the surface developing solution A at 20° C. for 10 minutes.

The internal latent image type silver halide grains to be used in the present invention may be preferably not chemically sensitized on the grain surface, or slightly sensitized, if any.

Specifically, there may be included the conversion type silver halide emulsion as disclosed in U.S. Pat. No. 2,592,250; the core/shell type silver halide emulsion doped with internal chemical sensitization nuclei or polyvalent metal ions as disclosed in U.S. Pat. Nos. 3,761,266 and 3,761,276; the lamination type silver halide emulsion as disclosed in Japanese Provisional Patent Publications Nos. 8245/1975, 38525/1975 and 2408/1978; and other emulsions as disclosed in Japanese Provisional Patent Publications Nos. 156614/1977 and 127549/1980.

The silver halide emulsions particularly preferably used in the present invention is a core-shell emulsion consisting of a core and at least one layer of shell covering said core, and the surface composition of said shell should preferably contain silver chloride from the standpoint point of rapid processing, particularly 10 mole % or more of silver chloride in the shell, preferably 30 mole % or more, in accomplishing the present invention.

Also, the shell layer of the above silver halide grains in the present invention can cover completely the surface of silver halide grain or selectively a part of the surface of grain. In the present invention, the shell surface layer containing silver chloride should preferably comprise 10 % or more of the grain surface.

The shell in the above silver halide grain may be either a single layer which is single in the silver halide composition or a multi-layer of two or more layers.

When formed into a multi-layer shell, this consists of at least the outermost layer and the layer adjacent thereto, but it may also assume a structure in which layers having silver halide compositions different from each other are laminated.

The shell layers of said multi-layer may also assume a structure in which the silver halide composition changes continuously in the radial direction of the silver halide grain.

When the above multi-layer shell is to be formed, provided that silver chloride is contained in the outermost layer of the multi-layer shell or at least the surface thereof, or in the surface layer portion of the shell of the layer adjacent to the outermost layer, the grain as a whole or in the internal layer portion may have any desired silver halide composition. For example, there may be included silver iodobromide, silver bromide, silver chlorobromide, silver chloroiodide, silver chloroiodobromide.

The shell preferably covers 50% or more of the surface area of the core, but more preferred is a shell completely covering the surface.

The core comprises preferably primarily silver bromide, and may further contain silver chloride and/or silver iodobromide. Most preferably it is silver chlorobromide, and the content of silver bromide is preferably 50 mole % or more in bringing about the effect of the present invention.

Hereinafter, the silver halide emulsion of the present invention (or the light-sensitive silver halide photographic material of the present invention) refers to an internal latent type direct positive silver halide emulsion (or a light-sensitive material having a photographic constitution layer comprising said internal latent type direct positive silver halide emulsion), unless otherwise particularly noted.

The silver halide grains to be used in the silver halide emulsion of the present invention may be obtained according to any one of the acidic method, the neutral method or the ammonia method. Said grains may be grown at one time or grown after preparation of seed grains. The method for preparation of seed grains and the growth method may be either the same or different.

The silver halide emulsion of the present invention may be prepared by mixing at the same time halide ions and silver ions, or mixing the other into a solution wherein either one of them exists. Also, it may be also formed by adding successively and simultaneously halide ions and silver ions while controlling pH and pAg in the mixing vessel in view of the critical growth speed of silver halide crystals. According to this method, silver halide grains having regular crystal forms and approximately uniform sizes can be obtained. After the growth, the halogen composition in the grains may be also changed by use of the conversion method.

The silver halide emulsion of the present invention can be controlled in the grain size of silver halide grains, the shape of grains, the grain size distribution and the growth speed of grains during its preparation, by use of a solvent for silver halide, if necessary.

The silver halide grains to be used in the silver halide emulsion of the present invention can add metal ions by use of at least one selected from cadmium salts, zinc salts, lead salts, thallium salts, iridium salts (complexes containing the same), rhodium salts (complexes containing the same) and iron salts (complexes containing the same) to contain these metal elements internally of the grains and/or on the surface of grains. Also, by placing the grains in an appropriate reducing atmosphere, reduced sensitization nuclei can be imparted internally in the grains and/or onto the surface of grains.

The silver halide emulsion of the present invention may have unnecessary soluble salts removed after completion of growth of silver halide grains, or may also contain them as such. Said salts can be removed on the basis of the method described in Research Disclosure No. 17643.

The silver halide grains to be used in the silver halide emulsion of the present invention may have regular crystal forms such as cubic, octahedral, tetradecahedral crystals or irregular crystal forms such as spherical or plate crystals. In these grains, any desired ratio of {100}plane and {111}plane can be used. Also, those having complex forms of these crystal forms are available, and grains of various crystal forms may be mixed.

The silver halide grains of the present invention may have an average grain size (grain size: as defined below) preferably of 5 μm or less, particularly 3 μm or less.

The silver halide emulsion of the present invention may have any grain size distribution. An emulsion with broad grain size distribution (called polydispersed emulsion) may be used, or an emulsion with narrow grain size distribution (called monodispersed emulsion. The monodispersed emulsion as herein mentioned refers to one having a value of the standard deviation of the grain size distribution divided by the average grain size of 0.20 or less, preferably 0.15 or less. Here, the grain size indicates its diameter in the case of spherical silver halide or the diameter of the circular image with the same area calculated from the projected image in the case of grains having shapes other than spherical shape.) may be used singly or several kinds may be also mixed. Also, a polydispersed emulsion and a monodispersed emulsion can be used in a mixture.

The silver halide emulsion of the present invention can be chemically sensitized in the conventional manner. That is, the sulfur sensitization method, the selenium sensitization method, the reduction sensitization method, the noble metal sensitization method by use of gold or other noble metal compounds, etc. can be used either alone or in combination.

The silver halide emulsion of the present invention can be optically sensitized to a desired wavelength region by use of a dye known as the sensitizing dye in the field of photography. The sensitizing dye may be used singly, but two or more kinds may be also used in combination. Together with the sensitizing dye, a potentiating sensitizer for potentiating the sensitizing action of the sensitizing dye, which is a dye having itself no spectral sensitizing action or a compound absorbing substantially no visible light may also be contained in the emulsion.

In the silver halide emulsion of the present invention, for the purpose of preventing fog during preparation steps of the light-sensitive material storage or photographic processing, or stably maintaining photographic performances, compounds known as antifoggants or stabilizers, as known in the art of photography, can be added during chemical aging, on completion of chemical aging and/or after completion of chemical aging.

As the binder (or protective colloid) in the silver halide emulsion of the present invention, gelatin may be advantageously, but gelation derivatives, graft polymers of gelatin with other polymers, other proteins, sugar derivatives, cellulose derivatives, hydrophilic colloids of synthetic hydrophilic polymeric substances such as polymers or copolymers, etc. can be also used.

The photographic emulsion layer or other hydrophilic colloidal layers in the light-sensitive material, according to the silver halide emulsion of the present invention (hereinafter called the light-sensitive material of the present invention) can be hardened by use of one or more kinds of film hardeners for enhancing film strength by crosslinking the binder (or protective colloid) molecules. The film hardener can be added in an amount which can harden the light-sensitive material to the extent such that no film hardener is required to be added in the processing solution, but it is also possible to add film hardener to the processing solution.

In the silver halide emulsion layer and/or other hydrophilic colloid layers of the light-sensitive material of the present invention, plasticizers can be added for the purpose of enhancing flexibility.

In the photographic emulsion and other hydrophilic colloid layers of the present invention, a dispersion of a water-insoluble or difficultly soluble synthetic polymer (latex) can be added for the purpose of improving dimensional stability, etc.

In the emulsion layer of the light-sensitive material of the present invention, in the color developing processing, a dye forming coupler forms a dye by effecting the coupling reaction with an oxidized aromatic primary amine developing agent (e.g., p-phenylenediamine derivative or aminophenol derivative). Said dye forming coupler is ordinarily selected so as to form a dye capable of absorbing light-sensitive spectral light of the emulsion layer for the respective emulsion layers, namely a yellow dye forming coupler for the blue-sensitive emulsion layer, a magenta dye forming coupler for the green-sensitive emulsion layer and a cyan dye forming coupler for the red-sensitive emulsion layer. However, the light-sensitive silver halide color photographic material may be also prepared in a manner of use different from the above combination depending on the purpose.

These color forming couplers may be either tetra-equivalent for which four molecules of silver ions are required to be reduced for formation of one molecule of dye or di-equivalent for which only two molecules of silver ions may be reduced. In the dye forming coupler, there can be incorporated a compound capable of releasing a photographically useful fragment such as development accelerator, bleaching accelerator, developing agent, solvent for silver halide, color controller, film hardener, foggant, antifoggant, chemical sensitizer, spectral sensitizer and desensitizer through coupling with the oxidized developing agent. Together with these dye forming couplers, colored couplers having the effect of color correction or DIR couplers releasing development inhibitors with developing to improve sharpness of the image or graininess of the image may be also used in combination. In this case, the DIR coupler is preferably such that the dye formed from said coupler is of the same type as the dye formed from the dye forming coupler used in the same emulsion layer. But, one forming a different dye may be also used when there is no conspicuous turbidity of color. In place of the DIR compound or in combination with said coupler, a DIR compound which undergoes a coupling reaction with the oxidized developing agent to form a colorless compound simultaneously with release of a development inhibitor may be also used.

It is also possible to use a colorless coupler which undergoes a coupling reaction with an oxidized aromatic primary amine type developing agent but forms no dye in combination with a dye forming coupler.

The light-sensitive material of the present invention has great effect on rapid processing when containing a mercapto type inhibitor, and examples of such mercapto type inhibitor may include those as disclosed in Japanese Patent Publications Nos. 299964/1987, 29752/1988 and 40140/1988.

That is, the mercapto compound represented by the following formula (B) or (C) may be used as the mercapto type inhibitor.

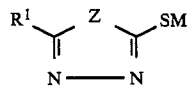

(B)

wherein Z represents —$NR^2$, an oxygen atom, a sulfur atom or a selenium atom; $R^1$ represents a hydrogen atom, an alkyl group, an aryl group, group, —$NHCOR^3$ group, or —$NHSO_2R^3$ group, where $R^3$ and $R^4$ each represent an alkyl group, an alkenyl group, a cycloalkyl group, an aryl group or an aralkyl group; $R^2$ represents a hydrogen atom, an alkyl group, an alkenyl group, a cycloalkyl group, an aryl group, an aralkyl group, an amino group, —$NHCOR^3$ group, —$NHSO_4R^3$ group, —$COR^5$ group or —$SO_2R^5$ group, where $R^5$ represents an alkyl group, an alkenyl group, a cycloalkyl group, an aryl group, an aralkyl group or —$NR^3R^4$ group; and M represents a hydrogen atom, an alkali metal or an ammonium group.

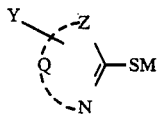

(C)

wherein Z represents —NR′, an oxygen atom, a sulfur atom or a selenium atom, where R′ represents a hydrogen atom, an alkyl group or an aryl group; Q represents a hydrocarbon group necessary for forming a 5-membered heterocyclic ring with Z and the nitrogen atom, and said heterocyclic ring may be fused with a benzene ring or a naphthalene ring; Y represents a hydrogen atom or a substituent; and M has the same meaning as defined above.

The compound represented by the formula (B) to be used in the present invention is a 1,2,4-triazole, oxadiazole, thiadiazole or selenodiazole derivative having a mercapto group (including a salt thereof) and other substituent(s).

In the formula (B), when $R^1$ represents —$NR^3R^4$ group, $R^3$ and $R^4$ are preferably an alkyl group or an aryl group. The alkyl group may preferably include an alkyl group having 1 to 8 carbon atoms, more preferably an alkyl group having 1 to 6 carbon atoms, and specifically include a methyl group, an ethyl group, a butyl group, a t-butyl group, a hexyl group, etc. These alkyl groups may have a substituent(s), and the substituent(s) includes a hydroxyl group, a cyano group, an amino group, an alkoxy group, an aryl group, a heterocyclic ring group, etc. The aryl group may include a phenyl group and a naphthyl group, and they may be substituted with a halogen atom, an alkyl group, an alkoxy group, etc. When $R^1$ represents —$NHCOR^3$ group or —$NHSO_2R^3$ group, $R^3$ represents, in addition to the above alkyl group and aryl group, an alkenyl group (e.g., an allyl group, a butenyl group, etc.), a cycloalkyl group (e.g., a cyclopentyl group, a cyclohexyl group, etc.), or an aralkyl group (e.g., a benzyl group, a phenethyl group, etc.).

$R^2$ represents the substituent at the 4-position nitrogen atom when the compound represented by the formula (B) is a 1,2,4-triazole type compound, and an alkyl group of $R^2$ may preferably includes an alkyl group having 1 to 8 carbon atoms, and more specifically includes, for example, a methyl group, an ethyl group, a propyl group, an octyl group, etc. These alkyl groups may have a substituent(s), and the substituent(s) includes a halogen atom (e.g., a fluorine atom, a chlorine atom, a bromine atom, etc.), an alkoxy group (e.g., a methoxy group, a butoxy group, a decyloxy group, etc.), an aryloxy group (e g., a phenoxy group, a naphthoxy group, etc.), an alkylthio group (e.g., a methylthio group, an ethylthio group, an octylthio group, etc.), an arylthio group (e.g., a phenylthio group, a naphthylthio group, etc.), a cyano group, etc.

The aryl group represented by $R^2$ may include a phenyl group, a naphthyl group, etc., and said aryl group may be substituted with, in addition to the substituents described in the above alkyl group in detail, an alkyl group (e.g., a methyl group, an ethyl group, an octyl group, etc.), a halogen-substituted alkyl group (e.g., a fluoromethyl group, a 2-chloroethyl group, etc.), and the like.

The alkenyl group, cycloalkyl group or aralkyl group represented by $R^2$ may include those mentioned in $R^3$ and $R^4$.

The amino group represented by $R^2$ may include an amino group or a substituted amino group (e.g., a methylamino group, a diethylamino group, an anilino group, a p-toluidino group, etc.).

The —$NHCOR^3$ group or —$NHSO_2R^3$ group represented by $R^2$ may include the same groups as the —$NHCOR^3$ group or —$NHSO_2R^3$ group mentioned in the $R^1$.

When $R^2$ represent —$COR^5$ group or —$SO_2R^5$ group, $R^5$ represents an alkyl group, an alkenyl group, a cycloalkyl group, an aryl group, an aralkyl group, or —$NR^3R^4$ group, and regarding the alkyl group, alkenyl group, cycloalkyl group, aryl group and aralkyl group, the same groups as those mentioned in $R^2$ in detail may be included, respectively. Also, $R^3$ and $R^4$ have the same meanings as $R^3$ and $R^4$ mentioned in $R^1$.

The alkali metal represented by M includes sodium, potassium, etc.

When the compound represented by (B) is a 3-mercapto-1,2,4triazole type compound, it can take the following tautomeric structure shown below, and both these tautomeric isomers are included in the present invention.

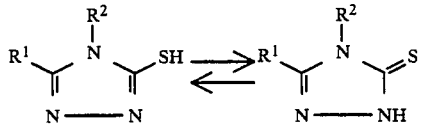

Among the compound of the formula (B), particularly preferred is a 1,2,4-triazole compound where z is -$NR^2$.

The compound represented by the above formula (C) is an imidazole (benzoimidazole, naphthoimidazole), imidazoline, oxazole (benzoxazole, naphthoxazole), thiazole (benzothiazole, naphthothiazole), thiazoline or selenazole (benzoselenazole, naphthoselenazole), etc., which have a mercapto group (including a salt thereof) at the 2-position.

When Z is NR′, the alkyl group represented by R′ may preferably include an alkyl group having 1 to 8 carbon atoms, and specifically include a methyl group, an ethyl group, an isopropyl group, a butyl group, a t-butyl group, a hexyl group, etc. These alkyl groups may be substituted with a hydroxyl group, an amino group, a cyano group, an alkoxy group, an aryl group, a heterocylic ring group, etc. The aryl group represented by R′ may include a phenyl group, a naphthyl group, etc., and these aryl groups may be substituted with a halogen atom, an alkyl group, an alkoxy group, etc.

The substituent(s) represented by Y may not be limited so long as they are substitutable with a benzene ring or a naphthalene ring of a heterocyclic rind or a fused heterocyclic cylic ring, but preferably the substituent(s) may preferably include a halogen atom, a hydroxyl group, a mercapto group (including a salt thereof), a nitro group, an amino group, an alkyl group, an alkoxy group, an aryl group, a carboxyl group and its salt, a sulfo group and its salt, an acyl group, an acylamino group, a carbamoyl group, a sulfamoyl group, an alkoxycarbonyl group, etc.

M has the same meaning as defined above.

Among the compound of the formula (C), a benzoimidazole and benzothiazole type compounds are preferred.

When the 2-mercaptoazole type compound, it can take the following tautomeritic structure, but both these tautomeric isomers are indluded in the present invention.

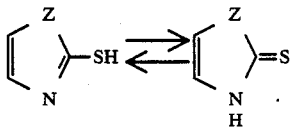

In the following, exemplary compounds represented by the formula (B) or (C) may be mentioned but the present invention will be desecibed, but the present invention is not limited to the scope of the present invention.

B-1

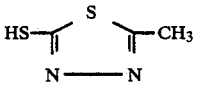

B-2

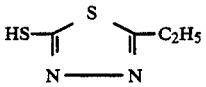

B-3

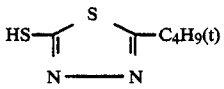

B-4

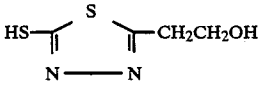

B-5

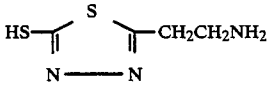

B-6

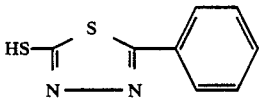

B-7

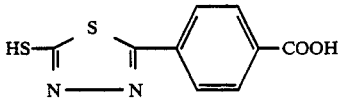

B-8

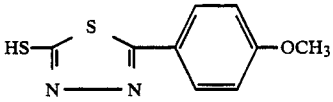

-continued

B-9

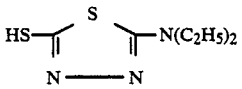

B-10

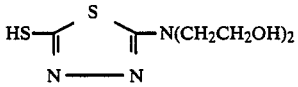

B-11

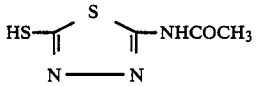

B-12

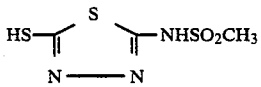

B-13

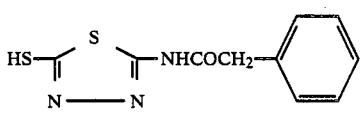

B-14

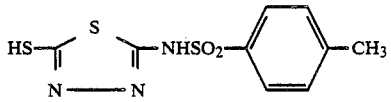

B-15

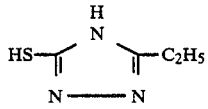

B-16

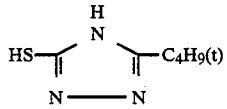

B-17

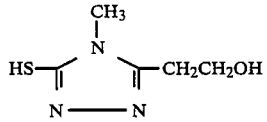

B-18

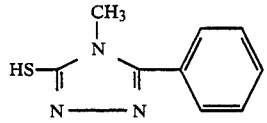

B-19

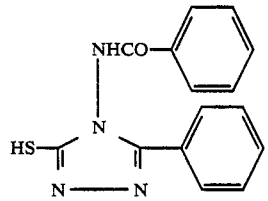

B-20

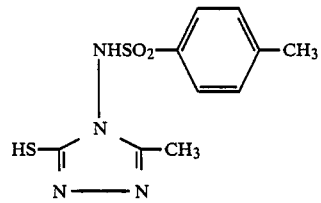

-continued
B-21
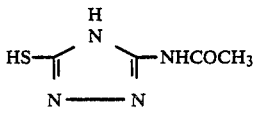
B-22
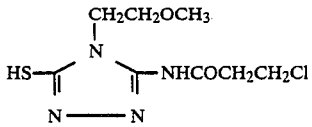
B-23
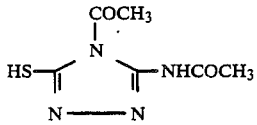
B-24
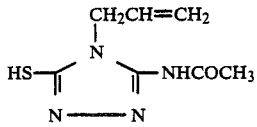
B-25
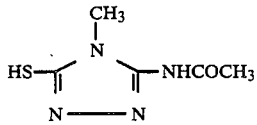
B-26
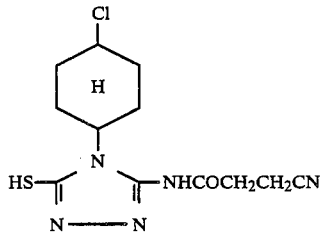
B-27
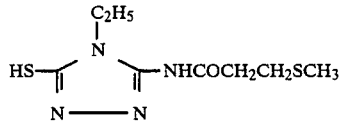
B-28
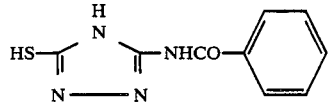
B-29
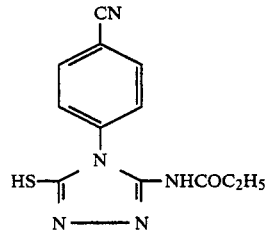
B-30
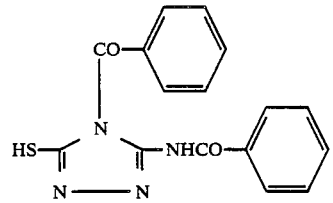
-continued
B-31
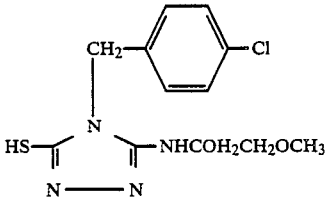
B-32
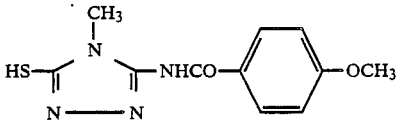
B-33
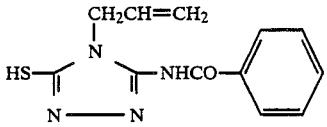
B-34
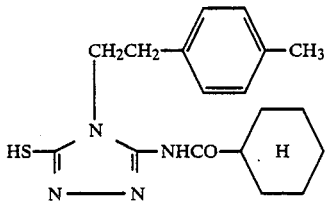
B-35
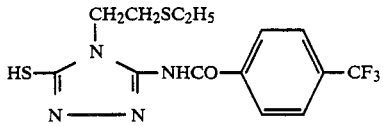
B-36
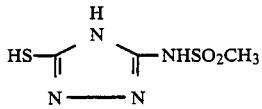
B-37
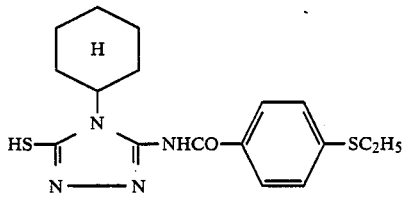
B-38
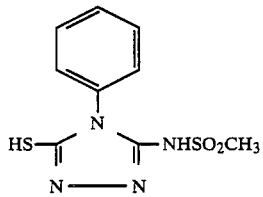
B-39
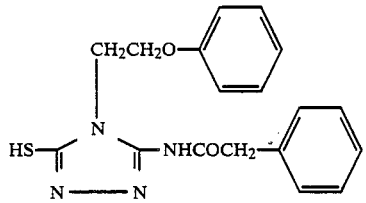

-continued
B-40
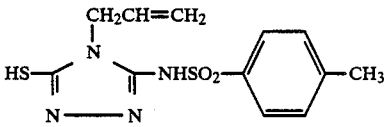
B-41
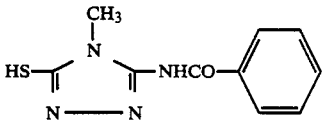
B-42
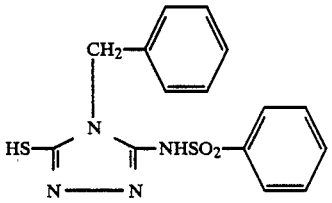
B-43
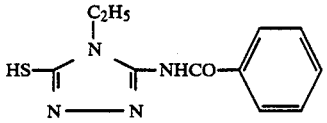
B-44
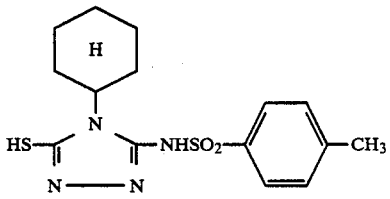
B-45
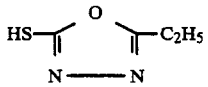
B-46
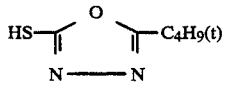
B-47
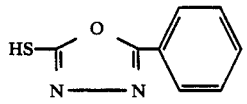
B-48
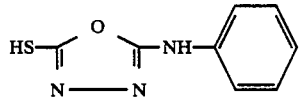
B-49
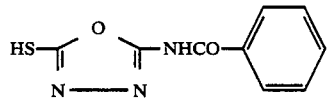
B-50
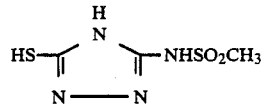
B-51
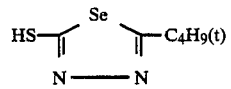
-continued
B-52
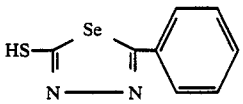
B-53
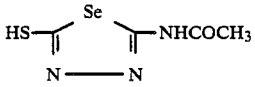
B-54
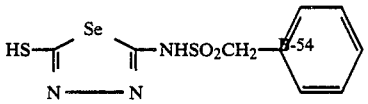
B-55
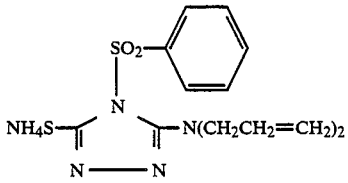
B-56
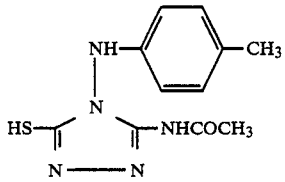
C-1
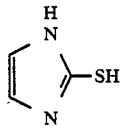
C-2
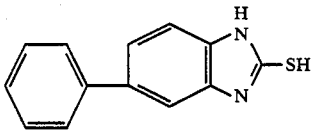
C-3
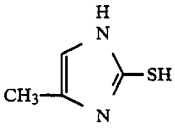
C-4
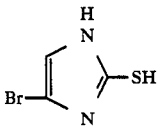
C-5
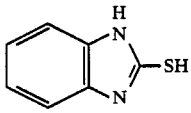
C-6
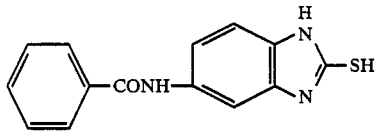

-continued
C-7
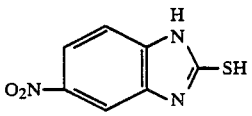
C-8
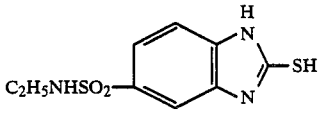
C-9
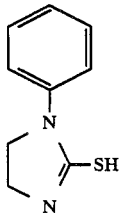
C-10
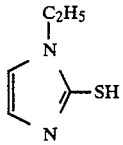
C-11
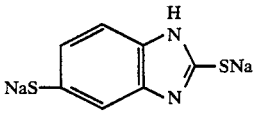
C-12
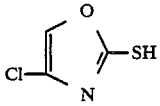
C-13
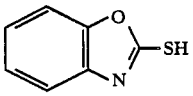
C-14
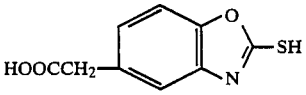
C-15
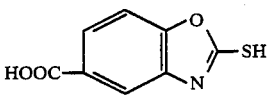
C-16
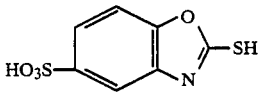
C-17
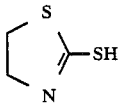
C-18
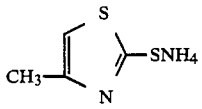
-continued
C-19
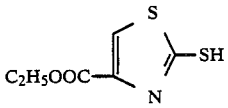
C-20
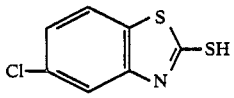
C-21
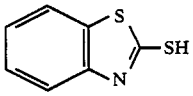
C-22
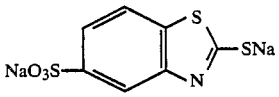
C-23
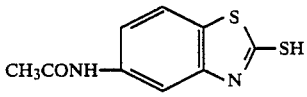
C-24
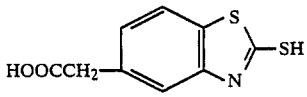
C-25
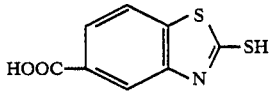
C-26
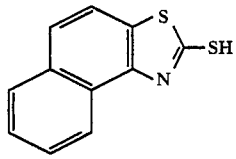
C-27
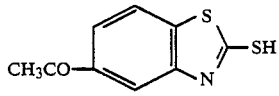
C-28
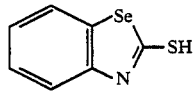
C-29
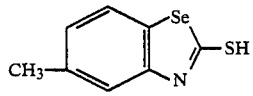
C-30
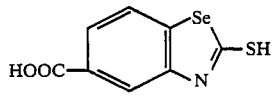
C-31
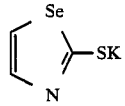

The above compounds represented by the formula (B) can be easily synthesized by the already know methods. For example, the compounds of the formula (B) can be synthesized in accordance with the method disclosed in Japanese Provisional Patent Publication No. 59463/1980, GB Patent No. 940,169, etc.; or the method disclosed in Journal of the American Chemical Society, Vol. 44, pp. 1502 to 1510, Journal of the Chemical Society, 1952, pp. 4811 to 4817, etc. Also, the compounds represented by the formula (C) are the known compounds and can be easily obtained as commercially available products, and can be synthesized in accordance with the method disclosed in Beilesteins Handbuch der Organischen Chemie, Vol. 24, p. 119, Ditto, Vol. 27 (2), p. 181 and p. 233 (1972); U.S. Pat. No. 2,730,528 Journal of the American Chemical Society, Vol. 49, p. 748, etc.

The above compounds of the formulae (B) and (C) in accordance with the present invention may be added in a constituting element of a light-sensitive material by dissolving in water or an organic solvent having an affinity with water such as methanol or acetone, or dissolving in a weak alkali or a weak acid, or may be contained in a developing processing bath.

An amount of the compound of the formula (B) or (C) to be added may be optionally varied depending upon kinds of the compound to be used or a layer to be added. When the compound is added to a silver halide emulsion layer, it is generally in the range of $10^{-8}$ to $10^{-2}$ mole per mole of silver halide, more preferably $10^{-6}$ to $10^{-3}$ mole per mole of silver halide.

The compound of the formula (B) or (C) in accordance with the present invention may be added to any one layer constituting layers providing in the conventional light-sensitive material, including a silver halide emulsion layer, such as a protective layer, an intermediate layer, a filter layer, a halation preventive layer and a subbing layer, but particularly preferred layer is a silver halide emulsion layer.

When the above compound is added to a silver halide emulsion layer, the compound may be added at any time between after completion of ripening of the emulsion and before coating thereof. Also, when the compound is added to the other layer, it may be added at any time between preparation of a coating solution and before coating.

Also, when the compound of the present invention is added to a developing processing bath, it may preferably be used in an amount of 1 to 1000 mg per one liter of a developing solution, particularly 10 to 100 mg per one liter of a developing solution is preferred.

When the above compound is added in the developing processing bath, it is added thereto by dissolving in water, alcohol or acetone.

Further, in the internal latent image type light-sensitive material to be used in the present invention, other compounds than the above, for example, 4-hydroxy-6-methyl-1,3,3a,7-tetrazaindene, 1-phenyl-2-mercaptotetrazole, benzotriazole, purine derivatives such as adenine, etc. may be combinedly used as an antifoggant or a stabilizer for the silver halide emulsion.

The support to be used in the present invention may be flexible reflective supports such as papers laminated with α-olefin polymers (e.g., polyethylene, polypropylene, ethylene/butene copolymer), synthetic papers, etc.; films comprising semi-synthetic or synthetic polymers such as cellulose acetate, cellulose nitrate, polystyrene, polyvinyl chloride, polyethylene terephthalate, polycarbonate, polyamide, etc.; flexible supports having provided reflective layers on these films; glass; metal; earthware; etc. The light-sensitive material of the present invention can be exposed by use of electromagnetic wave in the spectral region to which the emulsion layer constituting the light-sensitive material has sensitivity. As the light source, all of the know light sources are available such as natural light (sunlight), tungsten lamp, fluorescent lamp, mercury lamp, xenon arc lamp, carbon arc lamp, xenon flash lamp, cathode-ray flying spot, various laser beams, emission diode beam, light emitted from phosphor excited with electron beam, X-ray, α-ray, γ-ray, etc.

The processing steps to be used in the present invention are color developing processing step including the color developing step.

Particularly, it is preferably to perform the color developing processing step, the bleaching processing step, the fixing processing step, and the step of water washing or stabilizing processing substituting for water washing, but in place of the processing step by use of the bleaching solution and the processing step by use of the fixing solution, it is also possible to perform the bleach-fixing processing step by use of one bath bleach-fixing solution.

In combination with these processing steps, pre-hardening processing step, its neutralization step, the stopping fixing processing step, post-hardening step, etc. may be also performed. In these processings, in place of the color developing step, a color developing agent or its precursor may be contained in the light-sensitive material to perform the developing processing by way of the activator processing step with the use of an activator solution.

In the present invention, the bromide ion concentration contained in the color developing solution in the present invention is $4.0\times10^{-3}$ mole/liter or less, particularly preferably $3.0\times10^{-3}$ mole/liter or less and $1.0\times10^{-6}$ mole/liter or more, for the effect of development acceleration and stability in processing.

The color developing agent to be used in the present invention is a surface developing agent containing substantially no solvent for silver halide, and the color developing agent contained in the color developing solution is an aromatic primary amine type color developing agent, including aminophenol type and p-phenylenediamine type derivatives. These color developing agents can be used as the salt of an organic acid or inorganic acid. For example, hydrochlorides, sulfates, p-toluenesulfonates, sulfites, oxalates, benzenesulfonates, etc. can be used.

These compounds are used generally at concentrations of about 0.1 g to about 200 g, more preferably at concentrations of about 1 g to about 50 g per one liter of the color developing solution.

The processing temperature for the color developing solution may be preferably 10° C. to 65° C., more preferably 25° C. to 45° C.

Examples of the above aminophenol type developing solution may include, for example, o-aminophenol, p-aminophenol, 5-amino-2-oxy-toluene, 2-amino-3-oxy-toluene, 2-oxy-3-amino-1,4-dimethyl-benzene, etc.

Particularly useful aromatic primary amine type color developing agents are N,N'-dialkyl-p-phenylenediamine type compounds, and the alkyl group and the phenyl group may be either substituted or unsubstituted. Among them, examples of particularly useful compounds may include N,N'-dimethyl-p-phenylenediamine hydrochloride, N-methyl-p-phenylenediamine hydrochloride, N,N'-diethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluene sulfonate, etc.

Also, the above color developing agent may be used either singly or as a combination of two or more kinds. Further, the above color developing agent may be also built in the color photographic material. For example, there may be employed the method in which the color developing agent is built in as the metal salt as in U.S. Pat. No. 3,719,492; the method in which the color developing agent is built in as the Schiff salt as disclosed in U.S. Pat. No. 3,342,559 or Research Disclosure No. 15159 (1976); the method in which it is built in as the dye precursor as disclosed in Japanese Provisional Patent Publication Nos. 65429/1983 and 24137/1983; etc.; or the method in which it is built in as the precursor for the color developing agent. In this case, it is also possible to process the light-sensitive silver halide color photographic material with an alkali solution (activator solution), and then immediately processing with the bleach-fixing processing.

The color developing solution of the present invention is preferably contain substantially no benzyl alcohol from the standpoint of environmental pollution and solubility, and also contain a compound of the formula (A) as mentioned above in bringing about the effect of the present invention.

In the following, the compound of the formula (A) will be supplementally explained.

In the formula (A), $R_1$ and $R_2$ may be either identical or different, and when $R_1$ and/or $R_2$ represent(s) an alkyl group(s), said alkyl group includes those having substitutents. Examples of said substituent may include a sulfonic acid group, a hydroxy group, an alkoxy group (a methoxy group, an ethoxy group, a propyloxy group, etc.), a carboxy group, an amino group and the like.

In the following, preferred exemplary compounds shown by the formula (A) are enumerated.

$CH_3—NH—OH$ (1)
$C_2H_5—NH—OH$ (2)
iso-$C_3H_7—NH—OH$ (3)

-continued $C_3H_7—NH—OH$ (4)
$HO—CH_2—NH—OH$ (5)
$CH_3—O—C_2H_4—NH—OH$ (6)
$HO—C_2H_4—NH—OH$ (7)
$HOOC—C_2H_4—NH—OH$ (8)
$HO_3S—C_2H_4—NH—OH$ (9)
$H_2N—C_3H_6—NH—OH$ (10)
$C_2H_5—O—C_2H_4—NH—OH$ (11)
$HO—C_2H_4—O—C_2H_4—NH—OH$ (12)

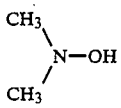
(13)

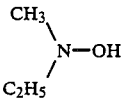
(14)

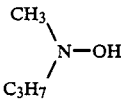
(15)

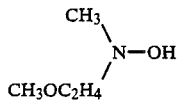
(16)

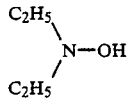
(17)

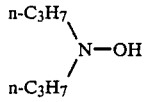
(18)

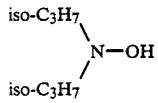
(19)

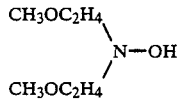
(20)

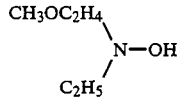
(21)

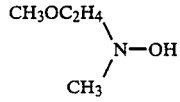
(22)

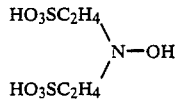
(23)

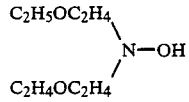
(24)

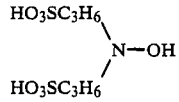
(25)

-continued (26)

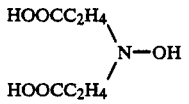

(27)

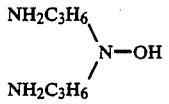

(28)

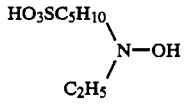

(29)

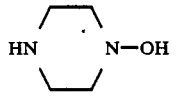

(30)

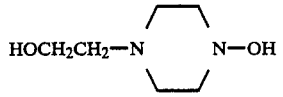

(31)

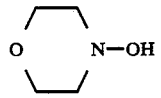

(32)

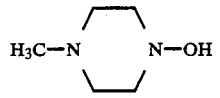

These compounds are used generally in the form of salts such as hydrochlorides, sulfates, p-toluenesulfonates, oxalates, phosphates, acetates, etc.

These can be easily synthesized according to the methods as disclosed in U.S. Pat. Nos. 3,287,125, 3,293,034 and 3,287,124, etc.

The concentration of the compound represented by the above formula (A) in the color developing solution may be generally preferred to be, for example, 0.1 g/liter to 50 g/liter, more preferably 0.3 g/liter to 30 g/liter, and most preferably 0.5 g/liter to 20 g/liter.

The above compound may be used either singly or in combination with two or more kinds.

In the present invention, it is particularly preferred to employ a sulfite or sulforous ion releasing compound together with the compound represented by the formula (A).

Specific examples of sulfite or sulforous ion releasing compound may include potassium sulfite, sodium sulfite, ammonium sulfite, sodium metabisulfite, potassium metabisulfite, bisulfite adduct of acetaldehyde, bisulfite adduct of propionaldehyde, bisulfite adduct of glutaraldehyde, etc.

The concentration of the above compound may be within the range of $1.0\times10^{-4}$ to $1.0\times10^{-1}$ mole per liter of the color developing solution, but when a sulfite or a sulforous ion releasing compound exists in a large amount, lowering in color forming density is liable to occur, and therefore it is preferably $5.0\times10^{-4}$ to $5.0\times10^{-2}$ mole. Also, it is preferred to contain substantially no benzyl alcohol in the present invention, specifically 1.0 ml/liter or less, particularly 0.5 ml/liter or less.

The color developing solution to be used in the present invention can contain an alkali agent conventionally used in the developing solution such as sodium hydroxide, potassium hydroxide, ammonium hydroxide, sodium carbonate, potassium carbonate, sodium sulfate, sodium metaphosphate or borax, and further various additives such as alkali metal halides (e.g., potassium chloride, etc.) can be contained. Also, as the development controller, for example, citrazinic acid, etc. may be contained. Further, various deforming agents or surfactants and also organic solvents such as methanol, dimethylformamide or dimethyl sulfoxide, etc. can be suitably contained.

The pH of the color developing solution to be used in the present invention may be generally 7 or higher, preferably about 9 to 13.

Also, in the color developing solution to be used in the present invention, there may be contained, if desired, antioxidants such as tetronic acid, tetronimide, 2-anilinoethanol, dihydroxyacetone, aromatic secondary alcohol, hydroxamic acid, pentose or hexose, pyrogalol-1,3-dimethyl ether, etc.

In the color developing solution to be used in the present invention, as the sequestering agent, various chelating agents can be used in combination. For example, as said chelating agent, there may be included aminopolycarboxylic acids such as ethylenediaminetetraacetic acid, diethylenetriaminopentaacetic acid, etc.; organic phosphonic acids such as 1-hydroxyethylidene-1,1-diphosphonic acid, etc.; aminopolyphosphonic acids such as ethylenediaminetetraphosphonic acid, etc.; oxycarboxylic acids such as citric acid or gluconic acid; phosphonocarboxylic acids such as 2-phosphonobutane-1,2,3-tricarboxylic acid, etc.; polyphosphoric acids such as tripolyphosphoric acid or hexamethanoic acid, etc.; polyhydroxy compounds; and the like.

In the present invention, in order to make the bromide ion concentration $4.0\times10^{-3}$ mole/liter or less, the amount supplemented into said color developing solution, the composition of the components of the light-sensitive material to be processed, the composition components of said color developing solution and supplemental solution may be controlled.

In the present invention, direct positive images can be obtained easily by surface development after imagewise exposure (photographing) of the light-sensitive material of the present invention according to the conventional method. More specifically, the principal steps for preparing direct positive images comprises performing surface development of the light-sensitive silver halide photographic material having an internal latent image type silver halide emulsion layer not previously fogged of the present invention after applying the processing to form fogged nuclei by chemical action or optical action, namely after fogging processing and/or while applying fogging processing. Here, fogging processing can be effected by exposing whole surface or by use of a compound capable of forming a fogged nucleus, namley foggant.

In the present invention, the whole surface exposure is effected by dipping or wetting the light-sensitive material subjected to image exposure in a developing solution or other aqueous solutions before uniform exposure over the whole surface. As the light source employed here, any light within the light-sensitive wavelength of the photographic light-sensitive material is suitable. A high luminance light such as flash light can be irradiated for a short time. The time for whole surface exposure may be varied widely so that the best positive image may be obtained depending on the photographic light-sensitive material, the development processing condition, the kind of the light source employed, etc.

In the present invention, when a light-sensitive silver halide color photographic material which is an internal latent image type having two or more light-sensitive wavelength regions different from each other on a support is subjected to image exposure, a direct positive image is formed by exposing the whole surface prior to developing or during the developing processing step, it is preferably to expose the whole surface so that the ratio of the photographic intensity of said whole surface to the respective silver halide emulsion layers as mentioned above may be 6 or greater.

The whole surface exposure to be used in the present invention, namely illumination of light fogging should be preferably one which does not cause illumination irregularity which depends on the light-sensitive material, but may be generally 0.01 to 2000 lux, preferably 0.05 to 30 lux, more preferably 0.1 to 5 lux. The light fogging illumination can be controlled by varying the luminous intensity of the light source, reducing the light with various filters or utilizing the distance between the light-sensitive material and the light source, the angle between the light-sensitive material and the light source, etc. Also, for shortening the light fogging exposure time, it is also possible to employ a method in which fogging is first effected with weak light at the initial exposure stage of light fogging and then effected with stronger light. Also, the method of applying the whole surface exposure while increasing the illumination as described in Japanese Patent Publication No. 6936/1983 can be practiced advantageously.

As the exposure device to be utilized for the whole surface exposure, there can be employed advantageously the devices as disclosed in Japanese Provisional Utility Model Publication Nos. 130935/1981, 145049/1981, 87051/984, 87052/1984 and 61542/1986, and Japanese Provisional Patent Publication No. 114237/1986.

The foggant to be used in the present invention can be selected from a wide variety of compounds, and the foggant may be present during developing processing. For example, it may be contained in other constituent layers than the support of the photographic light-sensitive material (among them, particularly preferrably silver halide emulsion layer) or in the developing solution or processing solution prior to developing processing. Its amount used can be varied widely depending on the purpose, and a preferred amount used when added in silver halide emulsion may be 1 to 1500 mg, preferably 10 to 1000 mg per mole of silver halide. On the other hand, a preferred amount when added in a processing solution such as developing solution may be 0.01 to 5 g/liter, particularly 0.05 to 1 g/liter.

The foggant to be used in the present invention may include hydrazine as disclosed in U.S. Pat. Nos. 2,563,785 and 2,588,982; heterocyclic quaternary nitrogen salt compounds disclosed in U.S. Pat. Nos. 3,615,615, 3,718,479, 3,719,494, 3,734,738 and 3,759,901; further compounds having adsorptive groups onto silver halide surface such as acylhydrazinophenylthioureaa as disclosed in U.S. Pat. No. 4,030,925. Also, these foggants can be used in combination. For example, Research Disclosure No. 15162 describes the use of a non-adsorption type foggant in combination with an adsorption type foggant, and this combination technique is also effective in the present invention.

As the foggant to be used in the present invention, either the adsorption type or the non-adsorption type can be used, and also they can be used in combination.

Specific examples of useful foggants may include hydrazine compounds such as hydrazine hydrochloride, phenylhydrazine hydrochloride, 4-methylphenylhydrazine hydrochloride, 1-formyl-2-(4-methylphenyl)hydrazine, 1-acetyl-2-phenylhydrazine, 1-acetyl-2-(4-acetamidophenyl)hydrazine, 1-methylsulfonyl-2-phenylhydrazine, 1-benzoyl-2-phenylhydrazine, 1-methylsulfonyl-2-(3-phenylsulfonamidophenyl)hydrazine, formaldehydephenylhydrazine; N-substituted quaternary cycloammonium salts such as 3-(2-formylethyl)-2methylbenzothiazolium bromide, 3-(2-formylethyl)-2-propylbenzothiazolium bromide, 3-(2-acetylethyl)-2-benzylbenzoselenazolium bromide, 3-(2-acetylethyl)-2-benzyl-5-phenylbenzoxazolium bromide, 2-methyl-3-[3-(phenylhydrazino)propyl]benzothiazolium bromide, 2-methyl-3-[3-(p-tolylhydrazino)propyl]benzothiazolium bromide, 2-methyl-3-[3-(p-sulfophenylhydrazino)propyl]benzothiazolium bromide, 2-methyl-3-[3-(p-sulfophenylhydrazino)pentyl]benzothiazolium iodide, 1,2-dihydro-3-methyl-4-phenylpyrido[2,1-b]benzoxazolium bromide, 1,2-dihydro-3-methyl-4-phenylpyrido-[2,1-b]-5-phenylbenzoxazolium bromide, 4,4'-ethylenebis-(1,2-dihydro-3-methylpyrido[2,1-b]benzothiazolium bromide) and 1,2-dihydro-3-methyl-4-phenylpyrido[2,1-b]benzoselenazolium bromide; 5-[1-ethylnaphtho(1,2-b)thiazolin-2-ilideneethylidene]-1-(2-phenylcarbazoyl)methyl-3-(4-sulfamoylphenyl)-2-thiohydantoin, 5-(3-ethyl-2-benzothiazolinidene)-3-[4-(2-formylhydrazino)phenyl]rhodanine, 1-[4-(2-formylhydrazino)phenyl]-3-phenylthiourea, 1,3-bis-[4-(2-formylhydrazino)phenyl]thiourea; and the like.

The bleaching processing step in the present invention refers to the step in which the silver image developed after the color developing processing step is bleaching with an oxidizing agent (bleaching agent).

As the bleaching agent, metal complexes of organic acids may be preferably used, for example, organic acids such as polycarboxylic acids, aminopolycarboxylic acids or oxalic acid, citric acid and the like, having metal ions such as iron, cobalt, copper, etc. coordinated. Of the above organic acids, the most preferred organic acids may be polycarboxylic acids or aminopolycarboxylic acids. These polycarboxylic acids may be also alkali metal salts, ammonium salts or water-soluble amine salts. Specific examples of these may include ethylenediaminetetraacetic acid, diethylenetriaminepentaacetic acid, pentasodium diethylenetriaminepentaacetate and the like. These bleaching agents are used in amounts of 5 to 450 g/liter, more preferably 20 to 250 g/liter.

In the bleaching solution, other than the above bleaching agents, halides such as ammonium bromide is preferably added. As the above halides, other than ammonium bromide, hydrochloric acid, hydrobromic acid, lithium bromide, sodium bromide, potassium bromide, sodium iodide, potassium iodide, ammonium iodide, etc. can be also used.

The fixing processing step refers to the step of fixing by desilverization with a fixing solution containing a silver halide fixing agent. The silver halide fixing agent to be used in said fixing solution may include compounds capable of forming water-soluble complexes through the reaction with silver halide used in conventional fixing processing, including thiosulfates such as potassium thiosulfate, sodium thiosulfate and ammonium thiocyanate, thiocyanates such as ammonium thiocyanate, thiourea, thioether, etc. as representative ones. These fixing agents may be used in amounts within the range which can be dissolved of 5 g/liter or more, generally from 70 g/liter to 250 g/liter.

In the present invention, the bleaching processing step and the fixing processing step should be preferably performed in one processing step with a bleach-fixing solution, and the metal complex of organic acid as the bleaching agent to be used in said bleach-fixing solution may be an organic acid such as aminopolycarboxylic acid, oxalic acid, citric acid, etc., having metal ions such as iron, cobalt, copper, etc. coordinated. As the organic acid to be used for fixing such as metal complexes of organic acids, the same as those for bleaching solution can be employed.

As the silver halide fixing agent to be contained in the bleach-fixing solution, there may be employed a compound which forms a water-soluble complex through the reaction with silver halide as in conventional fixing processing.

Also, in the bleach-fixing solution according to the present invention there is another effect of improving precipitation caused by the silver in the bleach-fixing solution. These intended better effects of the present invention are best realized when at least one compound represented by the formulae (I) to (IX) is present, these compounds can be more preferably employed in the present invention.

(I)

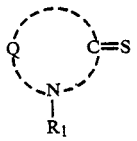

wherein Q represents a group of atoms necessary for formation of a nitrogen-containing hetero ring (including fused unsaturated rings of 5 to 6 members), $R_1$ represents a hydrogen atom, an alkyl group having 1 to 6 carbon atoms, a cycloalkyl group, an aryl group, a heterocyclic group (including fused unsaturated rings of 5 to 6 members) or an amino group.

(II)

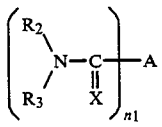

wherein $R_2$ and $R_3$ each represent a hydrogen atom, an alkyl group having 1 to 6 carbon atoms, a hydroxy group, a carboxy group, an amino group, an acyl group having 1 to 3 carbon atoms, an aryl group or an alkenyl group; A represents

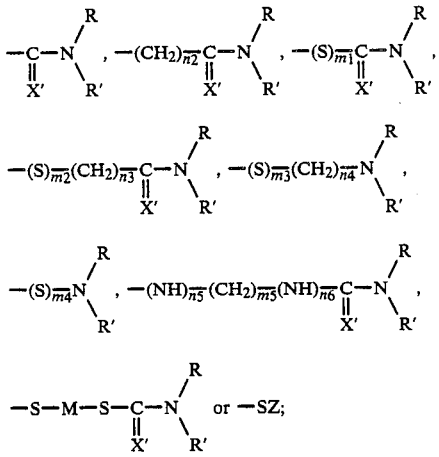

or a hetero ring residue of $n_1$ valence (including also fused unsaturated rings of 5 to 6 members), X represents =S, =O or =NR''; here, R and R' are the same as $R_2$ and $R_3$, respectively; X' is the same as X; Z represents a hydrogen atom, an alkali metal atom, an ammonium group, an amino group, a nitrogen-containing heterocyclic residue, an alkyl group or

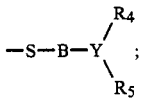

M represents a divalent metal atom; R'' represents a hydrogen atom, an alkyl group having 1 to 6 carbon atom, a cycloalkyl group, an aryl group, a heterocyclic residue (including also fused unsaturated rings of 5 to 6 members) or an amino group; $n_1$ to $n_6$ and $m_1$ to $m_5$ each represent an integer of 1 to 6; B represents an alkylene group having 1 to 6 carbon atoms; Y represents —N< or —CH<; and $R_4$ and $R_5$ are the same as $R_2$ and $R_3$, respectively; provided that $R_4$ and $R_5$ may each represent —B—SZ, and also $R_2$ and $R_3$, R and R', and $R_4$ and $R_5$ may be bonded together to form a ring.

The compounds represented by said formula are also inclusive of ethanolated derivatives and salts thereof.

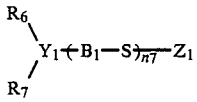

(III)

wherein $R_6$ and $R_7$ each represent a hydrogen atom, an alkyl group having 1 to 6 carbon atoms, a hydroxy group, a carboxy group, an amino group, an acyl group having 1 to 3 carbon atoms, an aryl group, an alkenyl group or $—B_1—S—Z_1$; provided that $R_6$ and $R_7$ may be bonded together to form a ring; $Y_1$ represents >N— or >CH—; $B_1$ represents an alkylene group having 1 to 6 carbon atoms; $Z_1$ represents a hydrogen atom, an alkali metal atom, an ammonium group, an amino group, a nitrogen-containing heterocyclic residue or

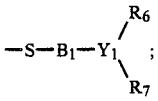

ps and $n_7$ represents an integer of 1 to 6.

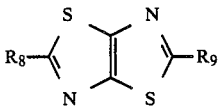

(IV)

wherein $R_8$ and $R_9$ each represent

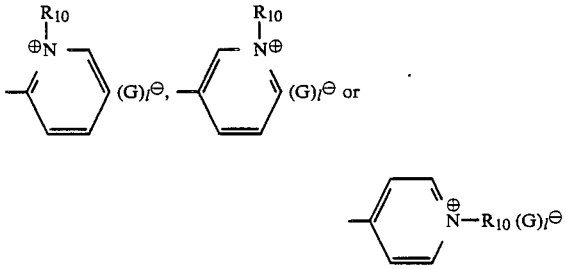

$R_{10}$ represents an alkyl group or $—(CH_2)_{n8}SO_3\oplus$ provided that when $R_{10}$ is $—(CH_2)_{n8}SO_3\oplus$, l represents 0, and when an alkyl group, it represents 1); $G\oplus$ represents an anion; $n_8$ represents an integer of 1 to 6.

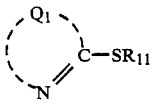

(V)

wherein $Q_1$ represents a group of atoms necessary for formation of a nitrogen-containing hetero ring (including also fused unsaturated rings or saturated rings of 5 to 6 members); $R_{11}$ represents a hydrogen atom,

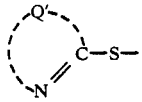

or an alkyl group; provided that Q' is the same as $Q_1$.

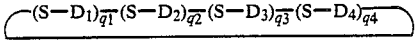

(VI)

wherein $D_1$, $D_2$, $D_3$ and $D_4$ each represent a mere bonding arm, an alkylene group having 1 to 8 carbon atoms or a vinylene group; $q_1$, $q_2$, $q_3$ and $q_4$ each represent 0, 1 or 2; the ring formed together with sulfur atom may be further fused with a saturated or unsaturated ring of 5 to 6 members.

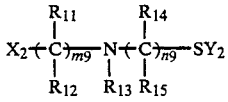

(VII)

wherein $X_2$ represents —COOM', —OH, $—SO_3M'$, $—CONH_2$, $—SO_2NH_2$, $—NH_2$, —SH, —CN, $—CO_2R_{16}$, $—SO_2R_{16}$, $—OR_{16}$, $—NH_{16}R_{17}$, $—SR_{16}$, $—SO_3R_{16}$, $—NHCOR_{16}$, $—NHSO_2R_{16}$, $—OCOR_{16}$ or $—SO_2R_{16}$; $Y_2$ represents

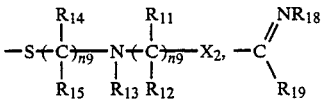

or a hydrogen atom; $m_9$ and $n_9$ each represent an integer of 1 to 10; $R_{11}$, $R_{12}$, $R_{14}$, $R_{15}$, $R_{17}$ and $R_{18}$ each represent a hydrogen atom, a lower alkyl group, an acyl group or

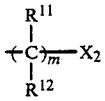

where $R^{11}$ and $R^{12}$ each have the same meanings as the above $R_{11}$ and $R_{12}$, respectively; $R_{16}$ represents a lower alkyl group; $R_{19}$ represents $—NR_{20}R_{21}$, $—OR_{22}$ or $—SR_{22}$; $R_{20}$ and $R_{21}$ each represent a hydrogen atom or a lower alkyl group; $R_{22}$ represents a group of atoms necessary for formation of a ring by bonding to $R_{18}$; $R_{20}$ or $R_{21}$ may also form a ring by bonding to $R_{18}$; M' represents a hydrogen atom or a cation.

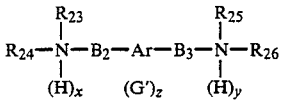

(VIII)

wherein Ar represents a divalent aryl group or divalent organic group comprising a combination of an aryl group with oxygen atom and/or an alkylene group; $B_2$ and $B_3$ each represent a lower alkylene group; $R_{23}$, $R_{24}$, $R_{25}$ and $R_{26}$ each represent a hydroxy-substituted lower alkylene group; x and y each represent 0 or 1; G' represents an anion; and z represents 0, 1 or 2.

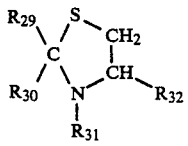

(IX)

wherein $R_{29}$ and $R_{30}$ each represent a hydrogen atom, an alkyl group, an aryl group or a heterocyclic group; $R_{31}$ represents a hydrogen atom or an alkyl group; and $R_{32}$ represents a hydrogen atom or a carboxy group.

The compounds represented by the formulae (I) to (IX) preferably used in the present invention are compounds generally used as the bleaching accelerators, and hereinafter called bleaching accelerators of the present invention.

Representative specific examples of the bleaching accelerators of the present invention represented by the above formula (I) to (IX) may include those shown below, which are not limitative of the present invention.

Exemplary compounds (I-1)

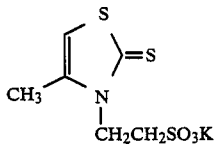

(I-2)

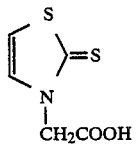

(I-3)

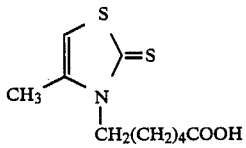

(I-4)

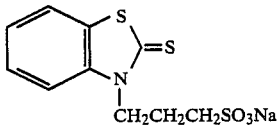

(I-5)

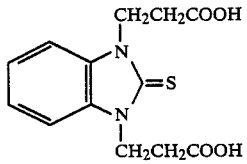

(I-6)

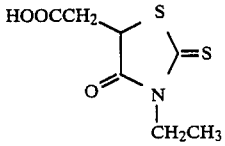

(I-7)

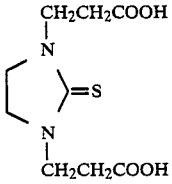

(I-8)

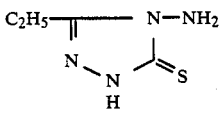

-continued
Exemplary compounds
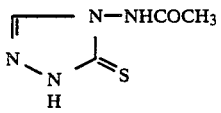
(I-9)
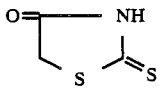
(I-10)
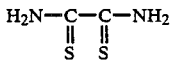
(II-1)
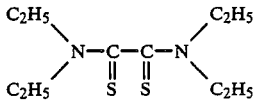
(II-2)
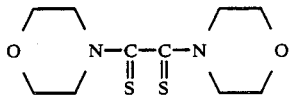
(II-3)
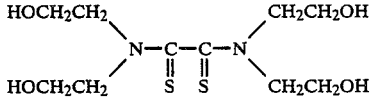
(II-4)
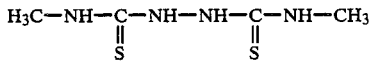
(II-5)
$H_2N—CSNHNHCS—NH_2$ (II-6)
$H_2N—CSNH(CH_2)_2NHCS—NH_2$ (II-7)
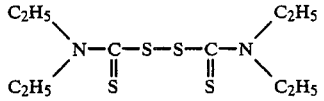
(II-8)
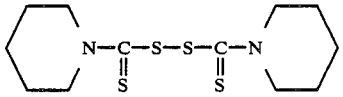
(II-9)
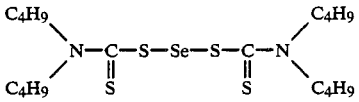
(II-10)
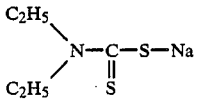
(II-11)
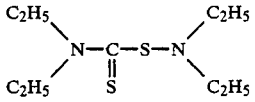
(II-12)
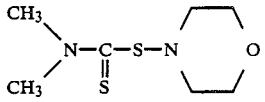
(II-13)
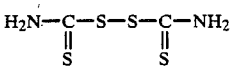
(II-14)

-continued
Exemplary compounds
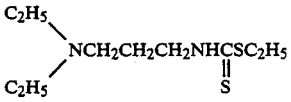
(II-15)
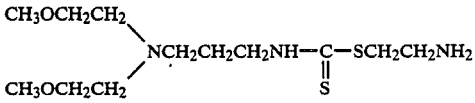
(II-16)
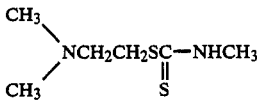
(II-17)
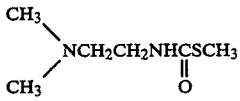
(II-18)
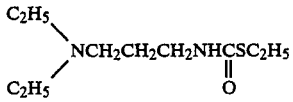
(II-19)
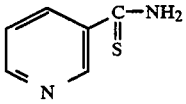
(II-20)
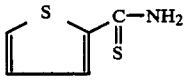
(II-21)
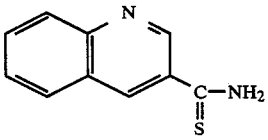
(II-22)
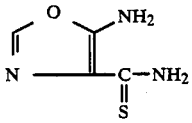
(II-23)
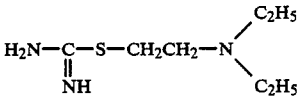
(II-24)
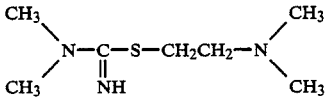
(II-25)
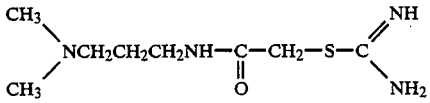
(II-26)
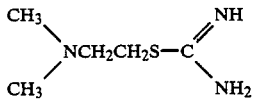
(II-27)
(III-1)

-continued
Exemplary compounds
(III-2)
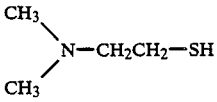
(III-3)
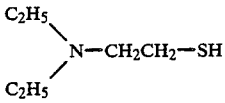
(III-4)
$HOOC-CH_2CH_2-SH$
(III-5)
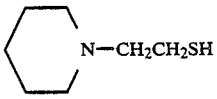
(III-6)
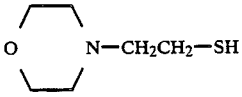
(III-7)
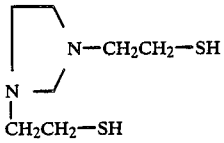
(III-8)
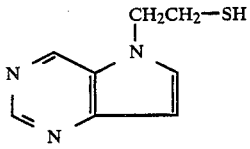
(III-9)
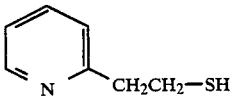
(III-10)
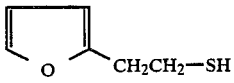
(III-11)
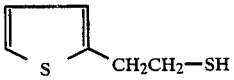
(III-12)
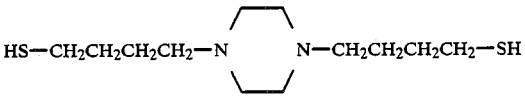
(III-13)
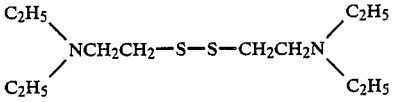
(III-14)
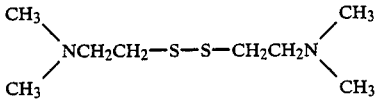
(III-15)
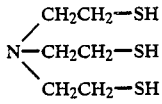

-continued
Exemplary compounds
(IV-1)
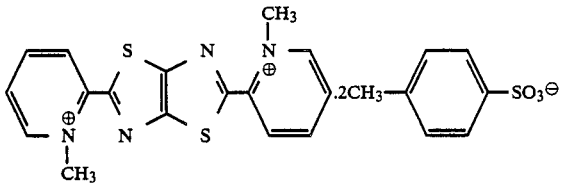
(IV-2)
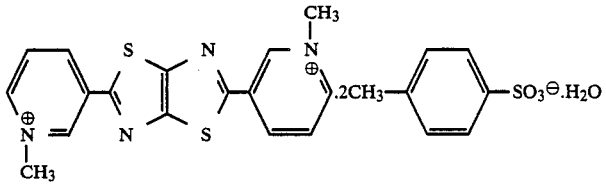
(IV-3)
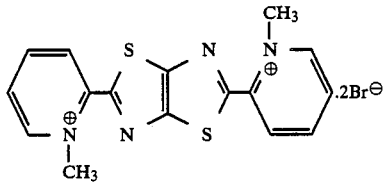
(V-1)
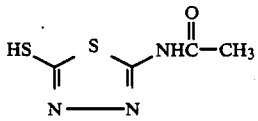
(V-2)
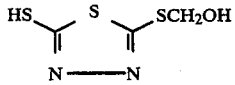
(V-3)
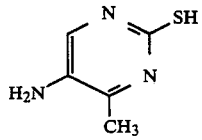
(V-4)
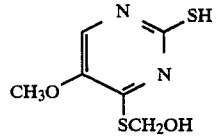
(V-5)
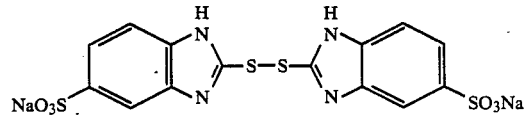
(V-6)
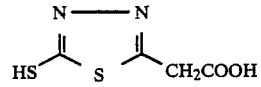
(V-7)
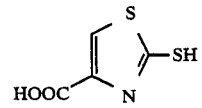
(V-8)
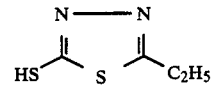

-continued
Exemplary compounds
(V-9)
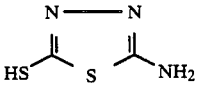
(V-10)
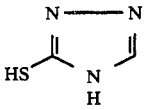
(V-11)
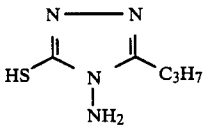
(V-12)
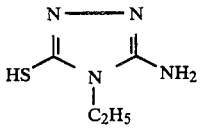
(V-13)
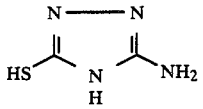
(V-14)
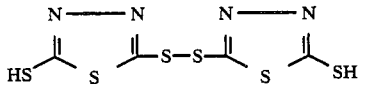
(V-15)
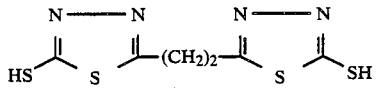
(V-16)
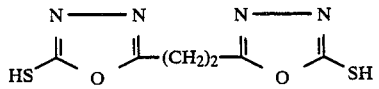
(V-17)
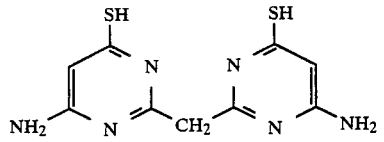
(V-18)
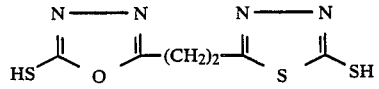
(V-19)
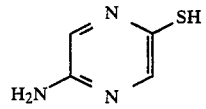
(V-20)
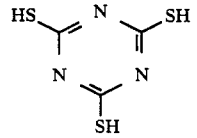
(V-21)
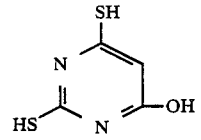

-continued
Exemplary compounds
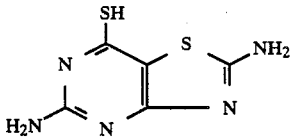
(V-22)
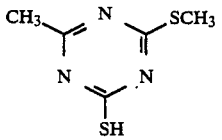
(V-23)
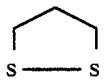
(VI-1)
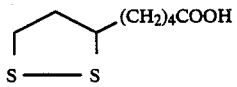
(VI-2)
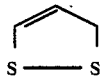
(VI-1)
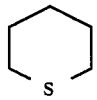
(VI-4)
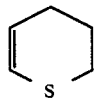
(VI-5)
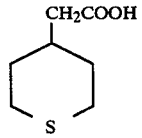
(VI-6)
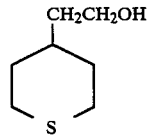
(VI-7)
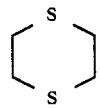
(VI-8)
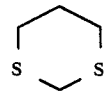
(VI-9)
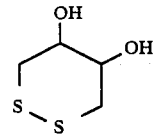
(VI-10)

-continued
Exemplary compounds
(VI-11)
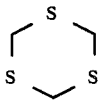
(VI-12)
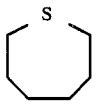
(VI-13)
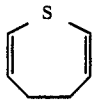
(VI-14)
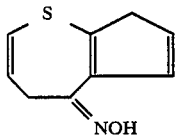
(VI-15)
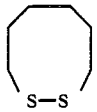
(VI-16)
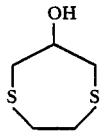
(VI-17)
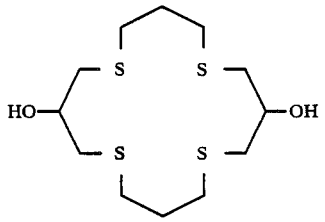
(VII-1)
$$\left(SCH_2CH_2N\left(CH_2CH_2SO_2CH_3\right)_2\right)_2$$
(VII-2)
$$\left(SCH_2CH_2N\left(CH_2CH_2CO_2CH_3\right)_2\right)_2$$
(VII-3)
$$\left(SCH_2CH_2N\left(CH_2CH_2CN\right)_2\right)_2$$
(VII-4)
$$\left(SCH_2CH_2N\left(CH_2CH_2CONH_2\right)_2\right)_2\ 2HCl$$
(VII-5)
$$\left(SCH_2CH_2N\left(CH_2CH_2SO_3Na\right)_2\right)_2$$

-continued
Exemplary compounds
(VII-6)
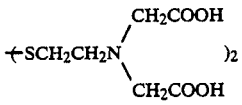
(VII-7)
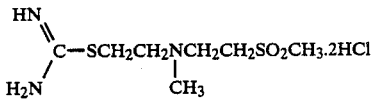
(VII-8)
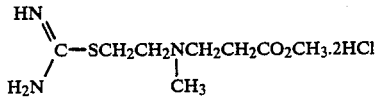
(VII-9)
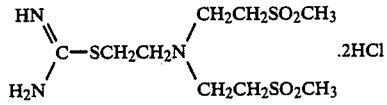
(VII-10)
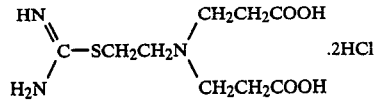
(VII-11)
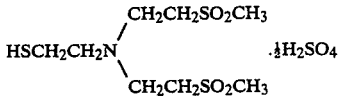
(VII-12)
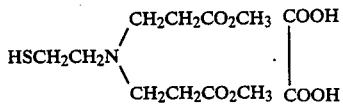
(VII-13)
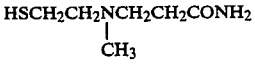
(VII-14)
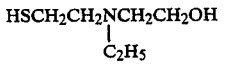
(VII-15)
(VIII-1)
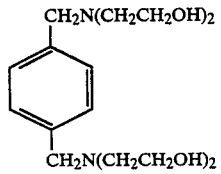
(VIII-2)
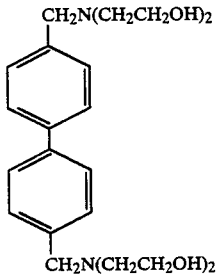

-continued
Exemplary compounds
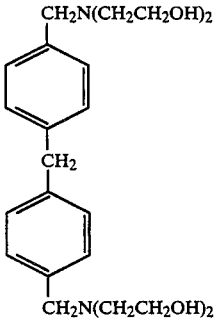
(VIII-3)
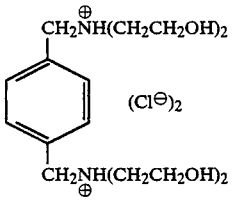
(VIII-4)
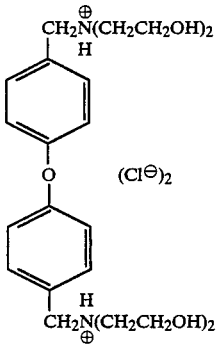
(VIII-5)
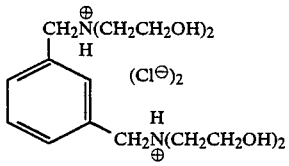
(VIII-6)
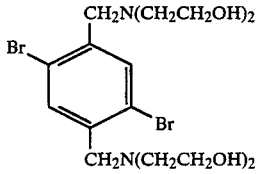
(VIII-7)
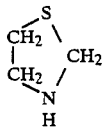
(IX-1)
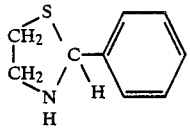
(IX-2)

-continued

Exemplary compounds

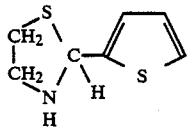

(IX-3)

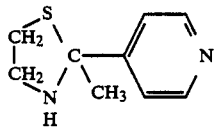

(IX-4)

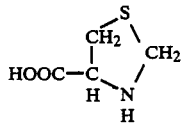

(IX-5)

Other than the bleaching accelerators of the present invention as exemplified above, the exemplary compounds described on page 51 to page 155 in Japanese Provisional Patent Publication No. 123459/1987, Nos. I-2, I-4 to 7, I-9 to 13, I-16 to 21, I-23, I-24, I-26, I-27, I-30 to 36, I-38, II-2 to 5, II-7 to 10, II-12 to 20, II-22 to 25, II-27, II-29 to 33, II-35, II-36, II-38 to 41, II-43, II-45 to 55, II-57 to 60, II-62 to 64, II-67 to 71, II-73 to 79, II-81 to 84, II-86 to 99, II-101, II-102, II-104 to 110, II-112 to 119, II-121 to 124, II-126, II-128 to 144, II-146, II-148 to 155, II-157, III-4, III-6 to 8, III-10, III-11, III-13, III-15 to 18, III-20, III-22, III-23, III-25, III-27, III-29 to 32, III-35, III-36, IV-3, IV-4, V-3 to 6, V-8 to 14, V-16 to 38, V-40 to 42, V-44 to 46, V-48 to 66, V-68 to 70, V-72 to 74, V-76 to 79, V-81, V-82, V-84 to V-100, V-102 to 108, V-110, V-112, V-113, V-116 to 119, V-121 to 123, V-125 to 130, V-132 to 144, V-146 to 162, V-164 to 174, V-176 to 184, VI-4, VI-7, VI-10, VI-12, VI-13, VI-16, VI-19, VI-21, VI-22, VI-25, VI-27 to 34, VI-36, VII-3, VII-6, VII-13, VII-19, VII-20, etc. can be also similarly used.

These bleaching accelerators may be used either singly or as the combination of two or more kinds, and the amount added may be generally about 0.01 to 100 g per one liter of the bleach-fixing solution to give favorable results. However, generally the bleaching acceleration effect is small when the amount added is too small, and precipitation may occur if the amount added is too large than is necessary to stain the light-sensitive material to be processed, and therefore a preferred amount is 0.05 to 50 g per one liter of the bleach-fixing solution, more preferably 0.05 to 15 g per one liter of the bleach-fixing solution.

When a bleaching accelerator is to be added, it may be also added as such and dissolved, but generally dissolved previously in water, alkali organic acid, etc. before addition, and if necessary, it may be also dissolved in an organic solvent such as methanol, ethanol, acetone, etc. before addition.

In the present invention, it is preferred that the light-sensitive silver halide color photographic material contains at least one magenta coupler represented by the following formula (M - I):

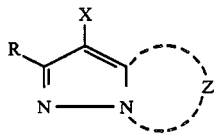

(M-I)

wherein Z represents a metal atom group necessary for forming a nitrogen-containing heterocyclic ring, and a ring formed by said Z may have a substituent or substituents; X represents a hydrogen atom or a group eliminatable through the reaction with an oxidized product of a color developing agent; and R represents a hydrogen atom or a substituent.

The magenta coupler to be used in the green-sensitive silver halide emulsion layer of the light-sensitive material according to the present invention will be explained.

In the magenta coupler represented by the above formula (M - I) according to the present invention, Z represents a group of non-metallic atoms necessary for forming a nitrogen-containing heterocyclic ring, and the ring formed by said Z may have a substituent or substituents.

X represents a hydrogen atom or a substituent eliminatable through the reaction with the oxidized product of a color developing agent.

Also, R represents a hydrogen atom or a substituent or substituents.

As the substituent represented by R, there is not particularly limited, but representatively, it may include each groups of alkyl, aryl, anilino, acylamino, sulfonamido, alkylthio, arylthio, alkenyl, cycloalkyl, etc., and in addition to them, there may be mentioned halogen atoms and each groups of cycloalkenyl, alkynyl, heterocyclic ring, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclylthio, as well as a spiro compound residual group and a bridged hydrocarbon compound residual group.

The alkyl group represented by R may include preferably those having 1 to 32 carbon atoms, and it may be straight or branched.

The aryl group represented by R may preferably be a phenyl group.

The acylamino group represented by R may be mentioned an alkylcarbonylamino group, an arylcarbonylamino group, etc.

The sulfonamido group represented by R may be mentioned an alkylsulfonylamino group, an arylsulfonylamino group, etc.

An alkyl component and aryl component of the alkylthio group and the arylthio group represented by R may be mentioned the above alkyl group and aryl group represented by R.

As the alkenyl group represented by R, those having 2 to 32 carbon atoms, and the cycloalkyl group is those having 3 to 12 carbon atoms, particularly preferably 5 to 7 carbon atoms, and the alkenyl group may be straight or branched.

As the cycloalkenyl group represented by R, those having 3 to 12 carbon atoms, particularly 5 to 7 carbon atoms are preferred.

The sulfonyl group represented by R may include an alkylsulfonyl group, an arylsulfonyl group, etc.; the sulfinyl group may include an alkylsulfinyl group, an arylsulfinyl group; the phosphonyl group may include an alkylphosphonyl group, an alkoxyphosphonyl group, an aryloxyphosphonyl group, an arylphosphonyl group, etc.; the acyl group may include an alkylcarbonyl group, an arylcarbonyl group, etc.; the carbamoyl group may include an alkylcarbamoyl group, an arylcarbamoyl group, etc.; the sulfamoyl group may include an alkylsulfamoyl group, an arylsulfamoyl group, etc.; the acyloxy group may include an alkylcarbonyloxy group, an aryloxycarbonyloxy group, etc.; the carbamoyloxy group may include an alkylcarbamoyloxy group, an arylcarbamoyloxy group, etc.; the ureido group may include an alkylureido group, an arylureido group, etc.; the sulfamoylamino group may include an alkylsulfamoylamino group, an arylsulfamoylamino group, etc.; the heterocyclic group may preferably be 5 to 7-membered, and more specifically a 2-furyl group, a 2-thienyl group, a 2-pyrimidinyl group, a 2-benzothiazolyl group, etc.; the heterocyclyloxy group may preferably be those having 5 to 7-membered heterocyclic ring, for example, a 3,4,5,6-tetrahydropyranyl-2-oxy group, a 1-phenyltetrazol-5-oxy group, etc.; the heterocyclylthio group may preferably be those having 5 to 7-membered heterocyclylthio group, for example, a 2-pyridylthio group, a 2-benzothiazolylthio group, a 2,4-diphenoxy-1,3,5-triazol-6-thio group, etc.; the siloxy group may include a trimethylsiloxy group, a triethylsiloxy group, a dimethylbutylsiloxy group, etc.; the imido group may include a succinimido group, a 3-heptadecylsuccinimido group, a phthalimido group, a glutarimido group, etc.; a spiro compound residual group may include a spiro[3.3]-heptan-1-yl group, etc; the bridged hydrocarbon residual group may include a bicyclo[2.2.1]heptan-1-yl group, a tricyclo[3.3.1.1$^{3,7}$]decan-1-yl group, a 7,7-dimethylbicyclo[2.2.1]heptan-1-yl group, etc.

The atom eliminatable through the reaction with the oxidized product of a color developing agent represented by X may include halogen atoms (e.g. a chlorine atom, a bromine atom, a fluorine atom, etc.) and also each groups of alkoxy, aryloxy, heterocyclyloxy, acyloxy, sulfonyloxy, alkoxycarbonyloxy, aryloxycarbonyl, alkyloxzalyloxy, alkoxyoxzalyloxy, alkylthio, arylthio, heterocyclylthio, alkyloxycarbonylthio, acylamino, sulfonamido, nitrogen-containing heterocyclic ring combined with N-atom, alkyloxycarbonylthiamino, aryloxycarbonylamino, carboxyl,

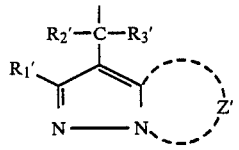

wherein $R^1$, has the same meaning as the above R, Z' has the same meaning as the above Z, $R^{2'}$ and $R^{3'}$ each represent a hydrogen atom, an aryl group, an alkyl group or a heterocyclic group, and the like, but preferably halogen atoms, and particularly a chlorine atom.

Also, the nitrogen-containing heterocyclic ring formed by Z or Z' may include a pyrazole ring, an imidazole ring, a triazole ring, a tetrazole ring, etc. and the substituent or substitutents which may be bonded to said rings may include those as mentioned for the above R.

The magenta coupler represented by the formula (M-I) may be mentioned more specifically, for example, by the formulae (M - II) to (M - VII) below:

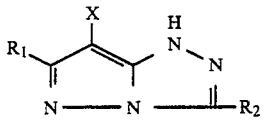

(M-II)

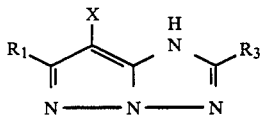

(M-III)

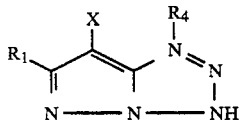

(M-IV)

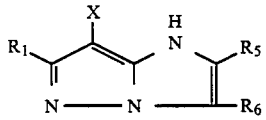

(M-V)

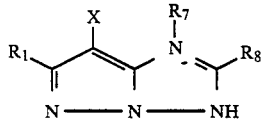

(M-VI)

-continued

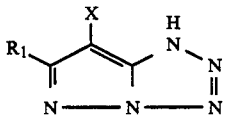

(M-VII)

In the above formulae (M-II) to (M-VII), $R_1$ to $R_8$ and X have the same meanings as the above R and X.

Also, of the compounds represented by the formula (M-I), preferred are the compound represented by the following formula (M-VIII):

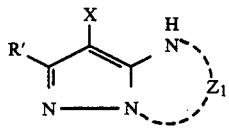

(M-VIII)

wherein $R_1$, X and $Z_1$ have the same meanings as R, X and Z in the formula (M-I).

Of the magenta couplers represented by the formulae (M-II) to (M-VII), the magenta coupler represented by the formula (M-II) is particularly preferred.

As the substituent(s) on the ring formed by Z in the formula (M-I) and on the ring formed by $Z_1$ in the formula (M-VIII), and $R_2$ to $R_8$ in the above formulae (M-II) to (M-VI), that represented by the formula (M-IX) is preferred.

$$-R^1-SO_2-R^2 \qquad \text{(M-IX)}$$

In the formula, $R^1$ represents an alkylene group, and $R^2$ represents an alkyl group, a cycloalkyl group or an aryl group.

The alkylene group represented by $R^1$ may preferably have carbon number at straight chain portion of 2 or more, more preferably 3 to 6 and may be straight or branched.

The alkyl group represented by $R^2$ may preferably be 5- to 6-membered ones.

Also, when it is used for forming a positive image, the most preferred substituent R and $R_1$ on the above heterocyclic ring are that represented by the following formula (M-X):

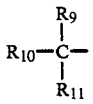

(M-X)

In the above formula, $R_9$, $R_{10}$ and $R_{11}$ have the same meanings as in the above R.

Also, two of the above $R_9$, $R_{10}$ and $R_{11}$, for example, $R_9$ and $R_{10}$, may be combined with each other to form a saturated or unsaturated ring (e.g., cycloalkane, cycloalkene, heterocyclic ring), and $R_{11}$ is further combined to said ring to form a bridged hydrocarbon residual group.

Among the formula (M-X), preferred are (i) the case where at least two of $R_9$ to $R_{11}$ are alkyl groups, and (ii) the case where at least one of $R_9$ to $R_{11}$, for example, $R_{11}$ is a hydrogen atom and the other two of $R_9$ and $R_{10}$ are combined with each other to form cycloalkyl with root carbon atoms.

Further, among (i), preferred is the case where two of $R_9$ to $R_{11}$ are alkyl groups, and the other one is a hydrogen atom or an alkyl group.

Also, when it is used for forming a negative image, the most preferred substituent R and $R_1$ on the above heterocyclic ring are that represented by the following formula (M-XI):

$$R_{12}-CH_2- \qquad \text{(M-XI)}$$

In the formula, $R_{12}$ has the same meaning as in the above R.

$R_{12}$ may preferably be a hydrogen atom or an alkyl group.

In the following, representative specific examples of the compounds according to the present invention will be mentioned.

[Exemplary compounds]

1

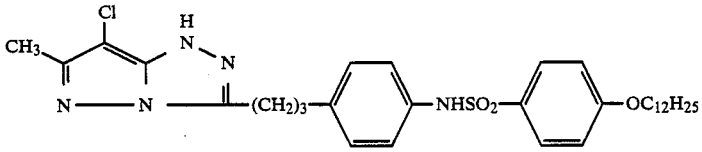

2

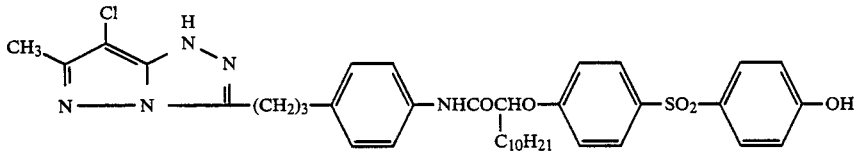

3

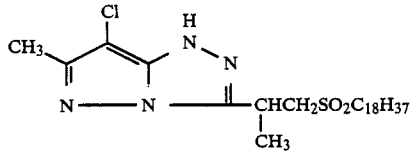

-continued
[Exemplary compounds]
4
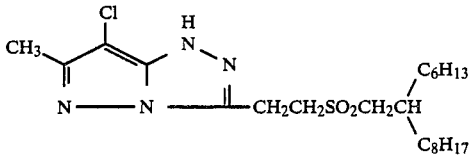
5
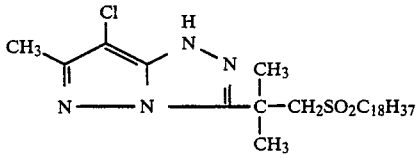
6
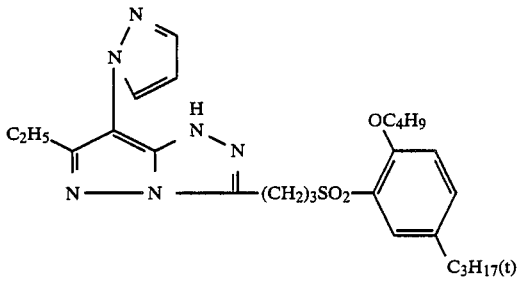
7
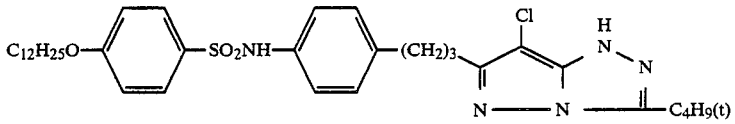
8
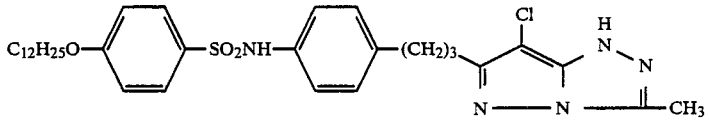
9
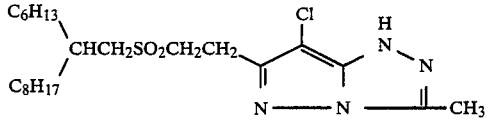
10
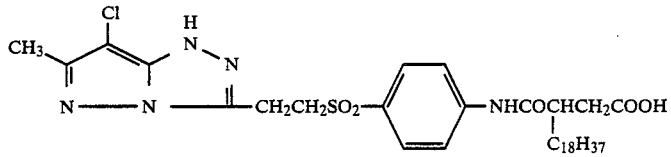
11
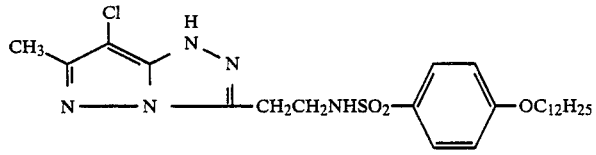
12
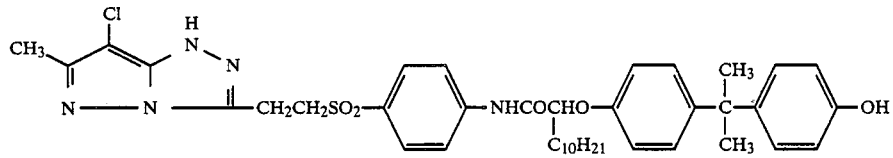

-continued
[Exemplary compounds]
13
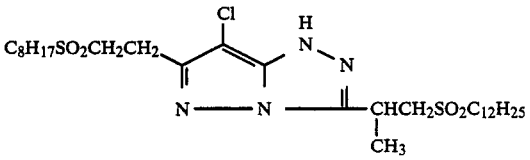
14
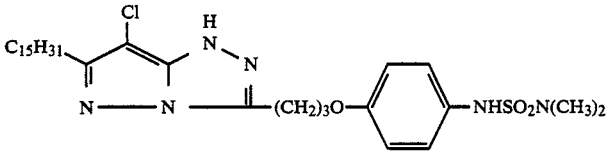
15
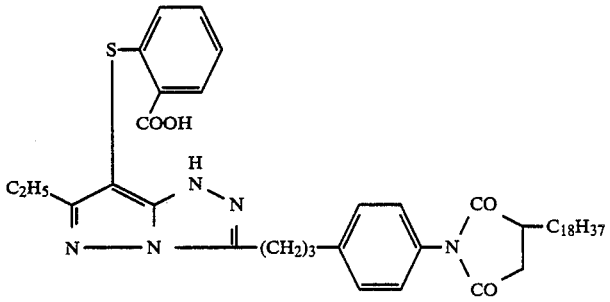
16
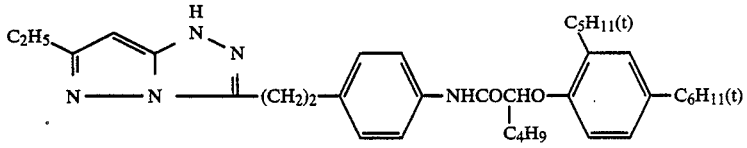
17
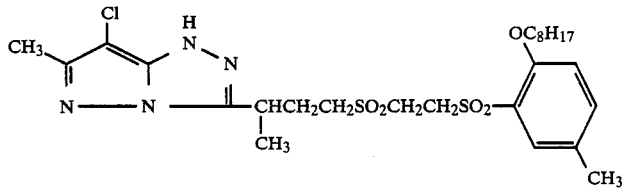
18
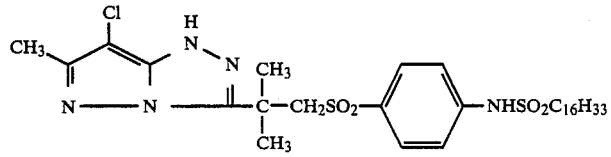
19
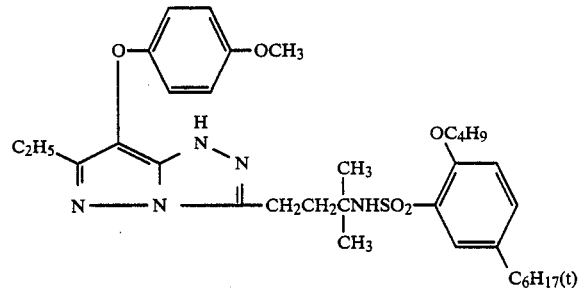

-continued
[Exemplary compounds]
20
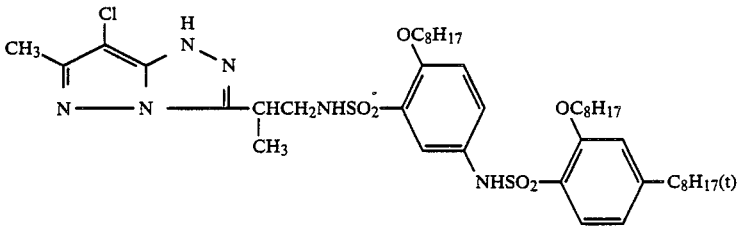
21
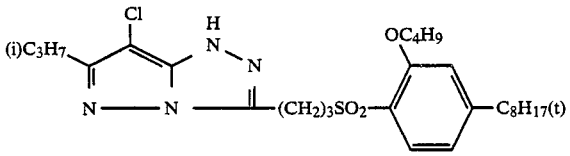
22
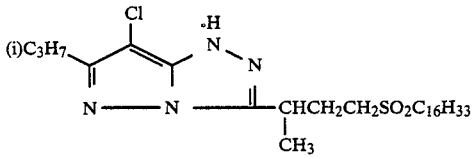
23
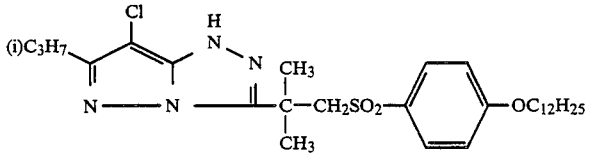
24
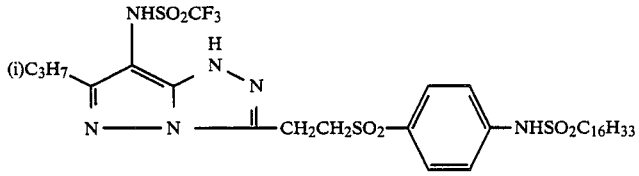
25
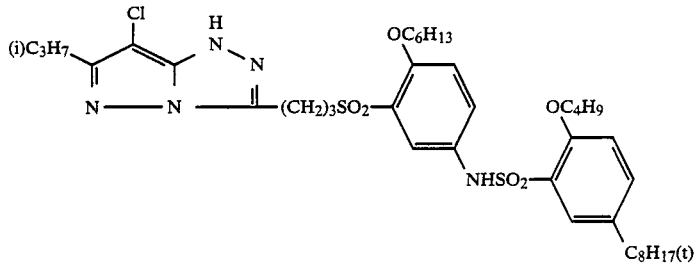
26
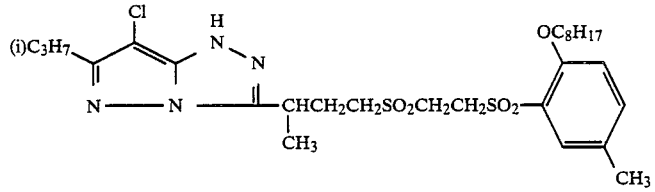

-continued
[Exemplary compounds]
27
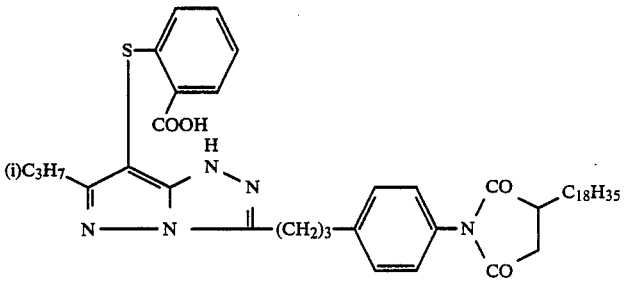
28
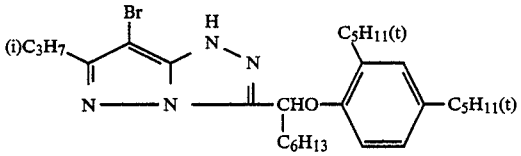
29
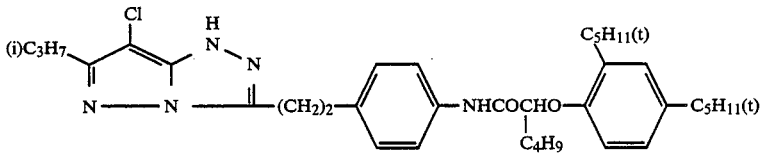
30
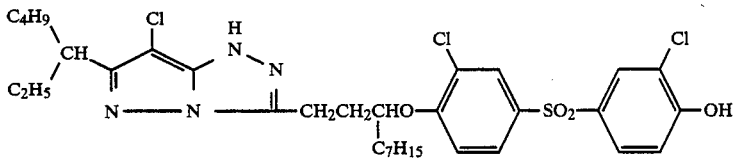
31
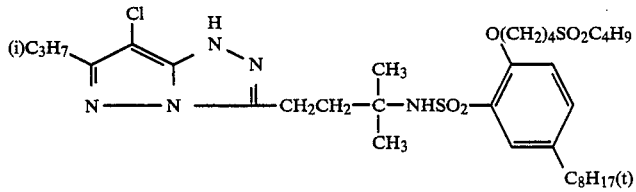
32
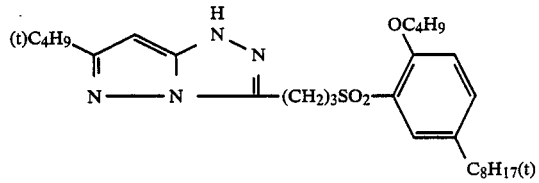
33
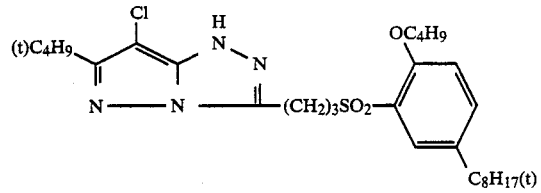
34
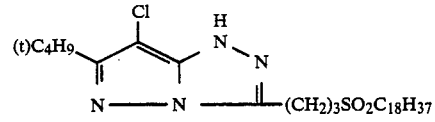

-continued
[Exemplary compounds]
35
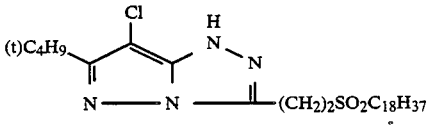
36
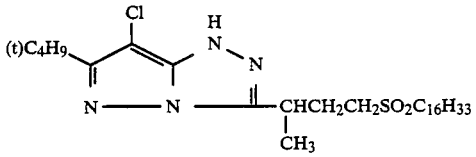
37
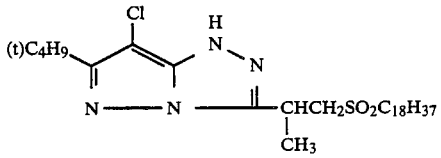
38
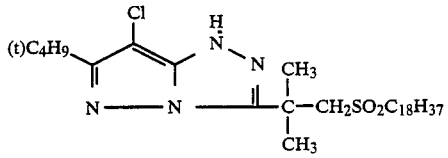
39
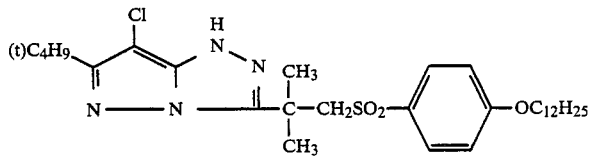
40
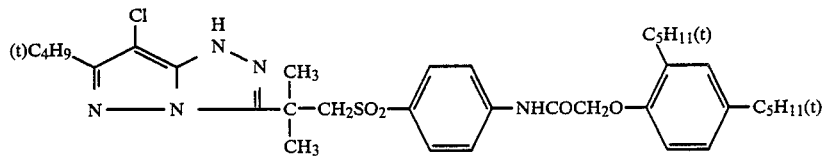
41
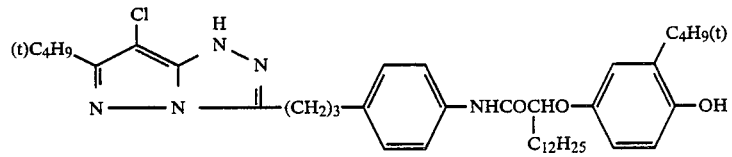
42
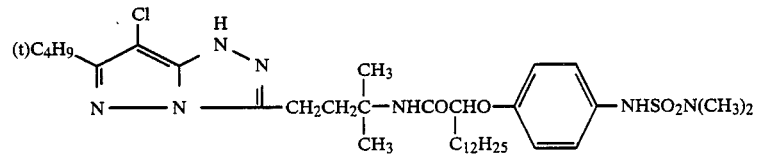
43
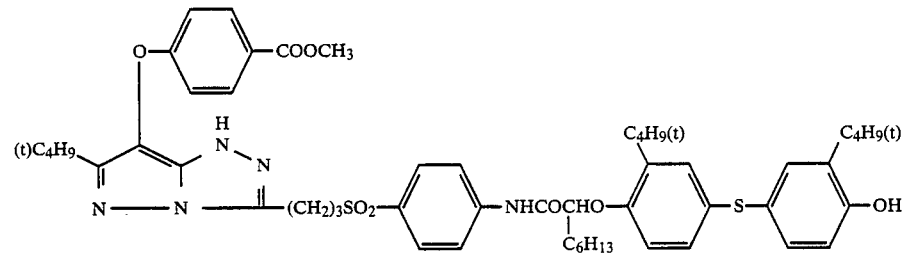

-continued
[Exemplary compounds]
44
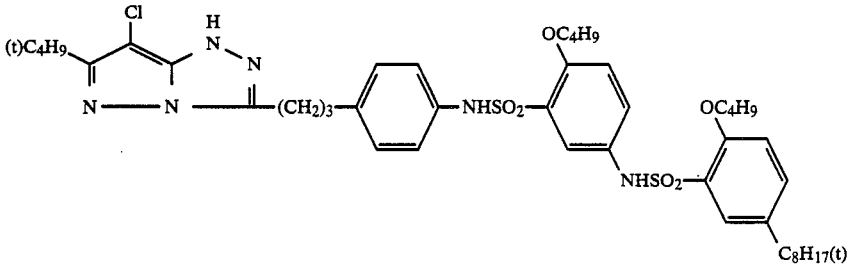
45
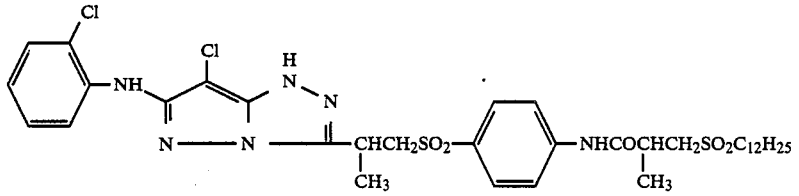
46
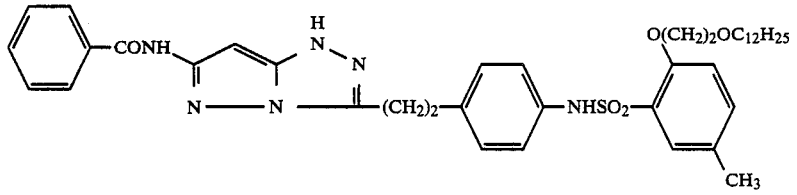
47
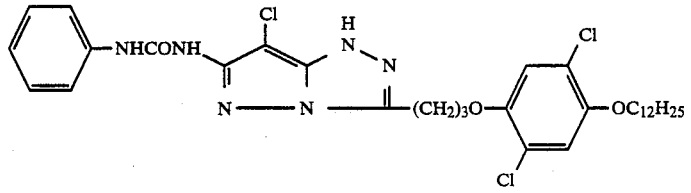
48
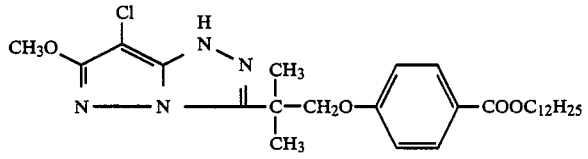
49
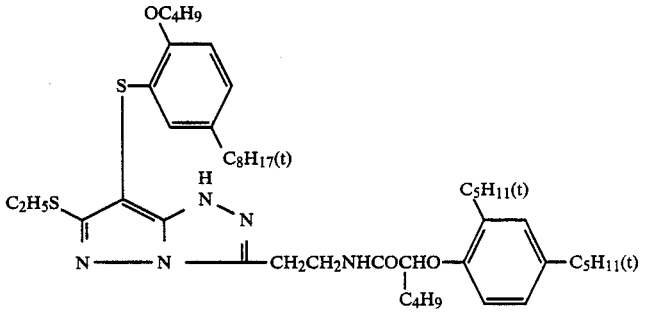
50
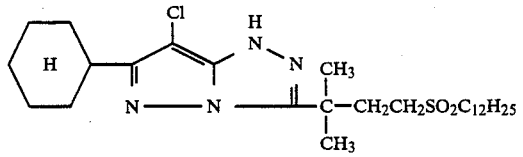

-continued
[Exemplary compounds]
51
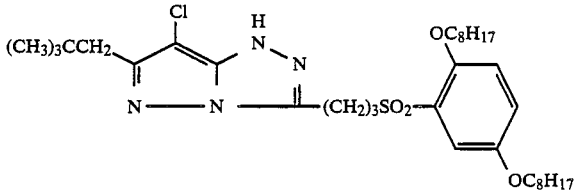
52
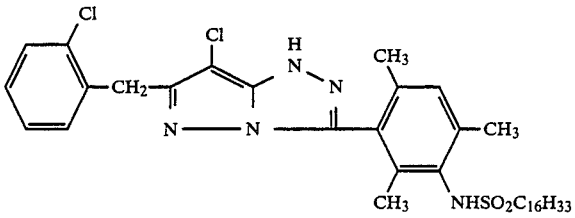
53
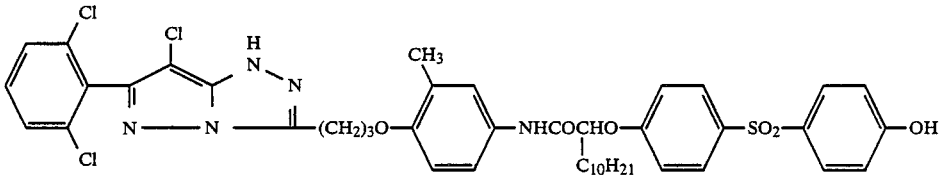
54
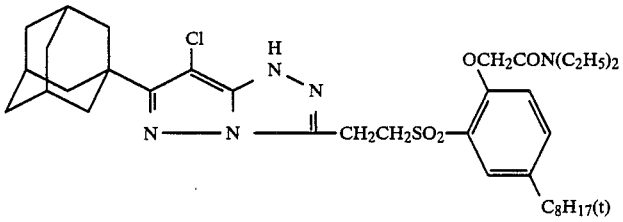
55
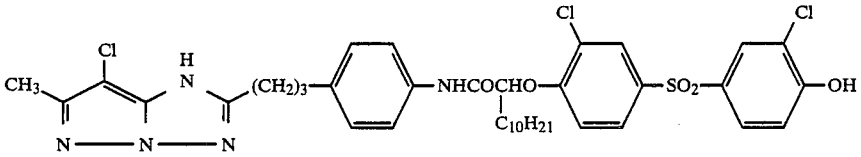
56
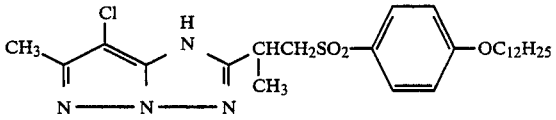
57
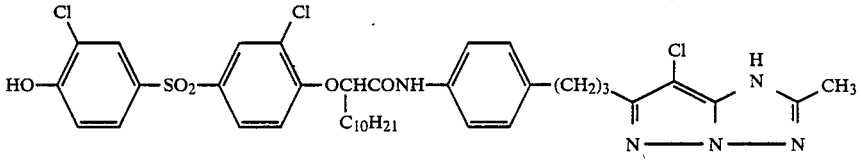
58
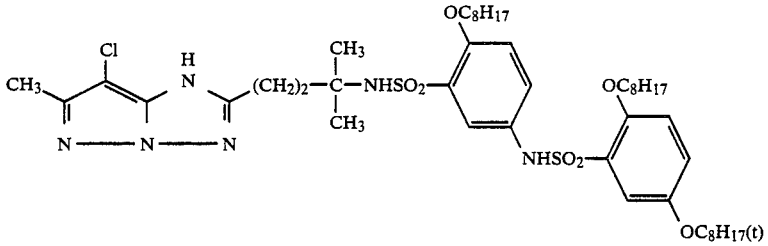

-continued
[Exemplary compounds]
59
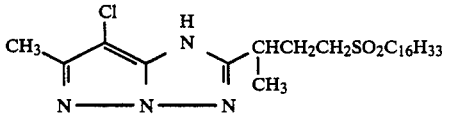
60
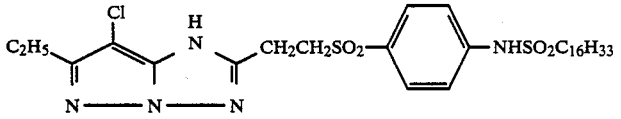
61
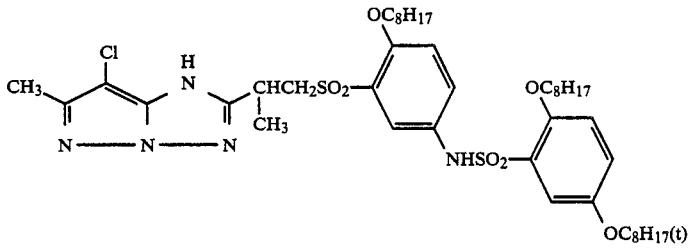
62
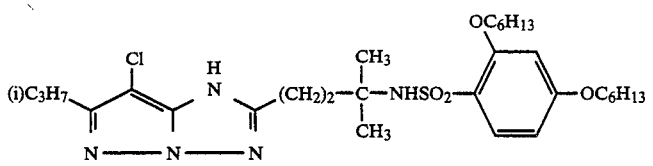
63
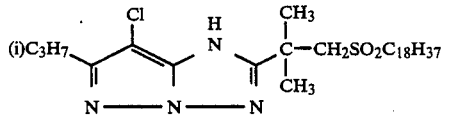
64
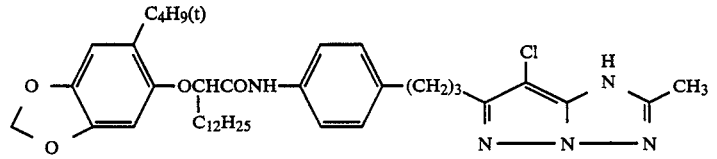
65
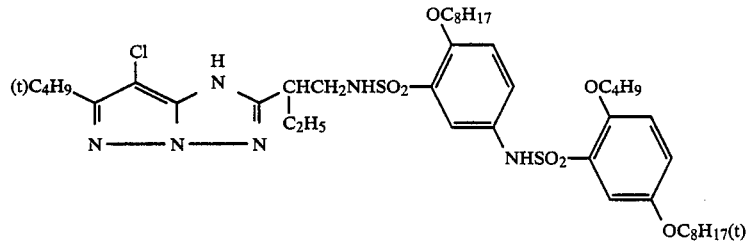
66
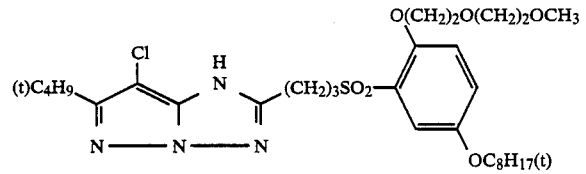
67
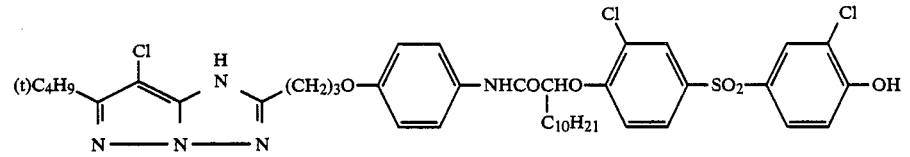

-continued
[Exemplary compounds]
68
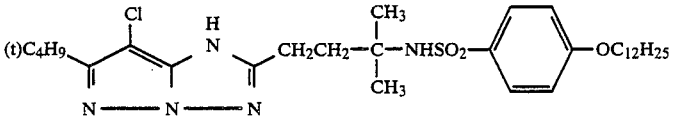
69
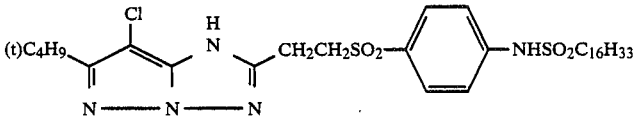
70
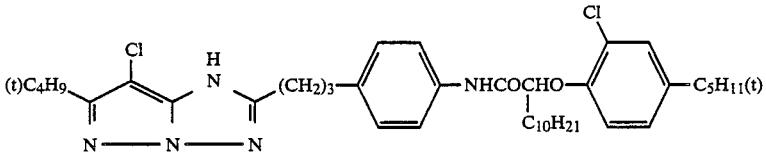
71
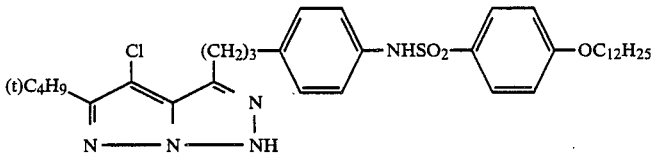
72
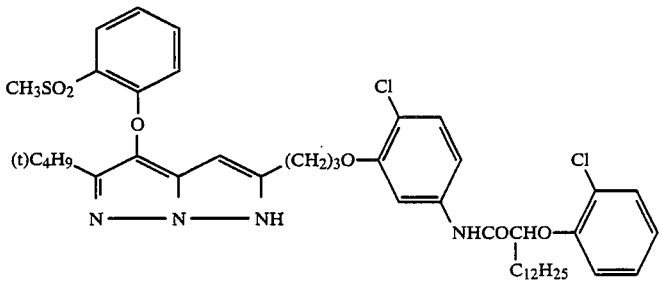
73
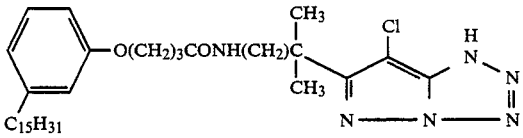
74
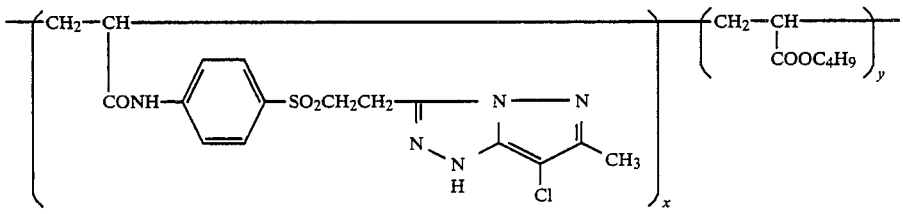
x:y = 50:50
75
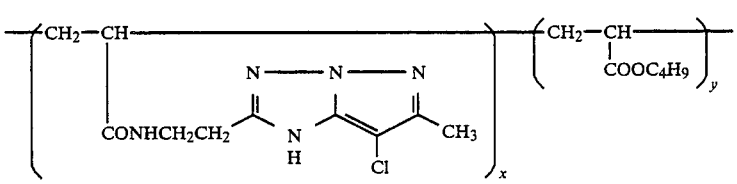
x:y = 50:50

-continued

[Exemplary compounds]

76

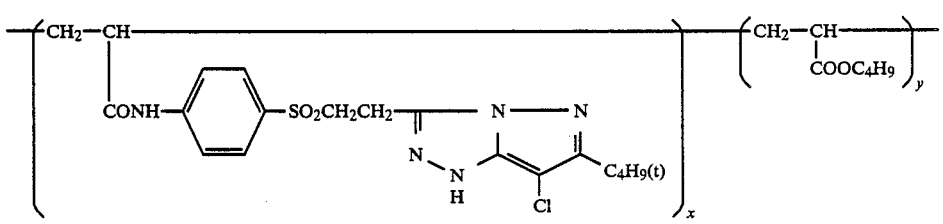

x:y = 50:50

77

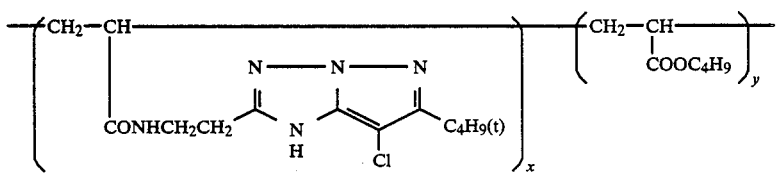

x:y = 50:50

In addition to the above representative exemplary compounds according to the present invention, specific exemplary compounds according to the present invention may be mentioned, among the compounds described on pages 66 to 122 of Japanese Provisional Patent Publication No. 166339/1987, the compounds represented by Nos. 1 to 4, 6, 8 to 17, 19 to 24, 26 to 43, 45 to 59, 61 to 104, 106 to 121, 123 to 162 and 164 to 223.

Also, the above couplers can be synthesized by referring to Journal of the Chemical Society, Perkin I (1977), pp. 2047 to 2052, U.S. Pat. No. 3,725,067 and Japanese Provisional Patent Publications Nos. 99437/1984, 42045/1983, 162548/1984, 171956/1984, 33552/1985, 43659/1985, 172982/1985 and 190779/1985.

The coupler of the present invention can be used in an amount generally within the range of from $1\times10^{-3}$ mole to 1 mole, preferably from $1\times10^{-2}$ mole to $8\times10^{-1}$ mole per one mole of the silver halide.

Also, the coupler of the present invention can be used in combination with other kinds of magenta couplers.

After processing with a fixing solution or a bleach-fixing solution, conventional water washing processing may also be performed, but it is particularly preferred in the present invention to apply stabilizing processing including substantially no water washing step.

In the present invention, the stabilizing processing including substantially no water washing step refers to stabilizing processing substituting for water washing with a single tank or a multi-tank countercurrent system, etc. immediately after processing with a processing solution having fixing ability, but other procesing steps than general water washing such as rinsing, auxiliary water washing and known water washing acceleration bath, etc. may be also included.

In the stabilizing processing step in the present invention, the method for contacting the stabilizing solution with the light-sensitive silver halide material may be preferably to dip the light-sensitive silver halide photographic material in a bath similarly as in processing solutions in general, but the solution may be also coated onto an emulsion surface of the light-sensitive silver halide photographic material and both surfaces of conveying leader, conveying belt with sponge, synthetic fiber cloth, etc. or blowed by means of a spray, etc. In the following, description is primarily made about the case when a stabilizing bath according to the dipping method is used.

In the above stabilizing solution, a chelating agent having a chelating stability constant for iron ion of 6 or higher is preferably contained.

As the chelating agent having a chelating stability constant for iron ions of 6 or higher, organic carboxylic acid chelating agents, organic phosphoric acid chelating agents, inorganic phosphoric acid chelating agents, polyhydroxy compounds, etc. may be included. The above iron ions mean ferric ($Fe^{3+}$) ions.

Specific compound examples of the chelating agent having a chelating stability constant with ferric ions of 6 or higher may include diethylenetriaminepentaacetic acid, nitrilotriacetic acid, 1-hydroxyethylidene-1,1-diphosphonic acid and the like.

The amount of the above chelating agent used may be within the range of 0.01 to 50 g, preferbaly 0.05 to 20 g, per liter of the stabilizing solution.

Further preferred compounds to be added in the stabilizing solution may include antifungal agents, water-soluble metal salts, ammonium compounds, etc. Examples of the above antifungal agents may include hydroxybenzoic acid type compounds; phenolic type compounds; isothiazole type compounds; pyridine type compounds; guanidine type compounds; carbamate type compounds; morpholine type compounds; quaternary phosphonium type compounds; ammonium type compounds, urea type compounds; isoxazole type compounds; propanolamine type compounds; sulfamide type compounds; amino acid type compounds and benztriazole type compounds; etc.

Further, the metal salt may be a metal salt of Ba, Ca, Ce, Co, In, La, Mn, Ni, Pb, Sn, Zn, Ti, Mg, Al and Sr, and can be supplied as halide, hydroxide, inorganic salt such as sulfate, carbonate, phosphoate, acetate, etc. The amount used may be within the range of $1\times10^{-4}$ to $1\times10^{-1}$ mole, preferably $4\times10^{-4}$ to $2\times10^{-1}$ mole, more preferably $8\times10^{-4}$ to $1\times10^{-2}$ mole, per liter of the stabilizing solution.

In the stabilizing solution, other than the above compounds, there may be added as desired various additives for improving and expanding the processing effects, including optical brightners, organic sulfur compounds, onium salts, film hardeners, quaternary salts, droplet irregularity preventives such as diethylene oxide derivatives, siloxane derivatives, pH controller such as boric acid, citric acid, phosphoric acid, acetic acid, or sodium hydroxide, sodium acetate, etc., organic solvents such as methanol, ethanol, dimethyl sulfoxide, etc., dispersing agents such as ethylene glycol, polyethylene glycol, etc., otherwise tone controllers, etc.

As the method for adding the above compounds and other additives, they can be added as concentrated solutions into the stabilizing tank, or the above compounds and other additives can be added into the stabilizing solution to be fed into the stabilizing tank, which is provided as the feed solution into the stabilizing tank. Or, they can be added into the previous bath preceding the stabilizing processing step to be contained in the light-sensitive silver halide photographic material to be processed, thereby being permitted to exist in the stabilizing tank. Thus, there are various kinds of methods, and they can be added according to any addition method.

The method for feeding the stabilizing solution in the stabilizing processing step, in the case of the multi-tank countercurrent system may be preferably such that it is fed into the later bath and permitted to overflow from the previous bath.

The pH value of the processing solution in the stabilizing bath may be preferably within the range of pH 4 to 8.

The pH can be controlled by use of the pH controller as described above.

The processing temperature during the stabilizing processing may be, for example, in the range of 20 ° C. to 50 ° C., preferably 25° C. to 40° C. The processing time is preferably as short as possible from the standpoint of rapid processing, generally 20 seconds to 5 minutes, most preferably 30 seconds to 2 minutes. In the multi-tank countercurrent system, the processing time is shorter in the earlier stage and longer in the later stage.

In the present invention, there may be no water washing processing, but rinsing with a small amount of water within a short time, surface washing with sponge, etc. and provision of a processing tank for stabilization of image or control of the surface properties of the light-sensitive silver halide photographic material can be optionally practiced. As the material for stabilizing image or controlling the surface properties as mentioned above, activators such as formalin and its derivatives, polyethylene oxide type compounds, quaternary salts, etc. may be employed.

In the present invention, in addition to the above processing steps, any additive processing step may be provided as desired. Also, silver may be recovered from the above stabilizing solution, as a matter of course, and also from the processing solutions containing soluble silver complexes such as fixing solution or bleach-fixing solution.

By performing the stabilizing processing as described above, the water washing step becomes substantially unnecessary and therefore the pipeline equipment unnecessary, whereby there is the advantage that the device itself can be installed easily at any desired place.

Other than these processing , processing may be also possible by use of a developing method which includes the amount of dye formed such as the method in which the developing agent formed by color developing is subjected to halogenation bleaching and then applied again with color developing, various amplifying processings as disclosed in Japanese Provisional Patent Publication No. 154839/1983.

The respective processing steps are generally perfomed by dipping the light-sensitive material in the processing solutions, but other methods such as the spraying system to feed the processing solution in atomized state, the Wepp system to effect processing through contact with a carrier impregnated with a processing solution or the method of performing viscous developing processing may be also employed.

According to the present invention, there can be provided a method for processing a light-sensitive silver halide color photographic material which is capable of rapid developing processing, high in stable photographic performances, particularly maximum density, even in said rapid developing processing and inhibited in fog.

Also, according to the present invention there can be provided a method for processing a light-sensitive silver halide color photographic material which prevents both fluctuation of minimum density (Dmin) at the running processing and lowering of maximum density (Dmax) while maintaining the preservability of the color developing solution by using the color developing solution containing the preservative which is harmless to human body and easy in handling.

EXAMPLES

The present invention will be described below by referring to Examples, but the embodiments of the present invention are not limited thereby at all.

EXAMPLE 1 (COMPARATIVE)

An internal latent image type emulsion (Em-1) was prepared as described below.

While an aqueous solution containing gelatin was controlled at 50° C., an aqueous silver nitrate solution and an aqueous solutions containing potassium bromide and sodium chloride (KBr : NaCl=60:40 in molar ratio) were added at the same time thereto to give a cubic emulsion with an average particle size of 0.38 μm. To the core emulsion thus obtained were added sodium thiosulfate and potassium chloroaurate, and chemical aging was effected at 55° C. for 120 minutes. This emulsion is called Emulsion A.

With Emulsion A as the core, and further an aqueous silver nitrate solution and an aqueous solution containing potassium bromide and sodium chloride (KBr : NaCl=20:80 in molar ratio) were added at the same time to give tetradecahedral particles with an average particle size of 0.51 μm. This emulsion is called Emulsion F.

To the Emulsion F was added sodium thiosulfate to effect chemical sensitization, and after completion of chemical sensitization, 10 mg of 1-phenyl-5-mercaptotetrazole was added per one mole of silver halide.

Negative-type emulsion (Em-2) was prepared as follows.

For the core particles, the same emulsion as used in the internal latent image type emulsion was used, but no chemical aging with sodium thiosulfate and potassium chloroaurate is effected.

Also, by use of the above core particles, tetradecahedral particles with an average particle size of 0.51 μm were prepared.

Chemical sensitization was effected by addition of sodium thiosulfate, and after completion of chemical sensitization, 10 mg of 1-phenyl-5-mercaptotetrazole was added per 1 mole of silver halide.

By use of the above internal latent image type emulsion (Em-1), the negative-type emulsion (Em-2), a light-sensitive material having the composition shown below was prepared.

(Preparation of Internal Latent Image Type Light-Sensitive Silver halide Material)

On a paper support having polyethylene laminated thereon, the following respective layers were provided by coating successively to prepare an internal latent image type light-sensitive material sample.

First Layer: Cyan-Forming Red-Sensitive Silver Halide Emulsion Layer

A cyan coupler, 2,4-dichloro-3-methyl-6-[α-(2,4-di-tertamylphenoy)butylamido]phenol [C-1](90 g), 2 g of 2,5-di-tert-octylhydroquinone, 50 g of tricresylphosphate, 200 g of paraffin and 50 g of ethyl acetate were mixed and dissolved, added with a gelatin solution containing sodium dodecylbenzenesulfonate, followed by addition of an internal latent image type silver halide emulsion (Em-1) sensitized with $3.5\times10^{-5}$ mole of a sensitizing dye (III) per mole of silver halide, and the mixture was applied to a silver amount of 400 mg/m$^2$, and AI dye [I]of 20 mg/m$^2$ and a coupler amount of 360 mg/m$^2$.

Second Layer: Intermediate Layer

One hundred (100) ml of a 2.5% gelatin solution containing 5 g of gray colloidal silver and 10 g of 2,5-di-tertoctylhydroquinone dispersed in dibutyl phthalate was applied to a colloidal silver amount of 400 mg/m$^2$.

Third Layer: Magenta-Forming Green-Sensitive Silver Halide Emulsion Layer

A magenta coupler, 1-(2,4,6-trichlorophenyl)-3-(2-chloro-octadecyl-succinimidoanilino)-5-pyrazolone (M - 1) (100 g), 5 g of 2,5-di-tert-octylhydroquinone, 50 g of Sumilizer MDP (trade name, produced by Sumitomo Kagaku Kogyo K.K.), 200 g of paraffin, 100 g of dibutyl phthalate and 50 g of ethyl acetate were mixed and dissolved, added with a gelatin solution containing sodium dodecylbenzenesulfonate, followed by addition of an internal latent image type silver halide emulsion (Em - 1) sensitized with $3.0\times10^{-4}$ mole of a sensitizing dye (II) per mole of silver halide, and the mixture was applied to a silver amount of 400 mg/m$^2$, an AI dye [II] of 20 mg/m$^2$ and a coupler amount of 400 mg/m$^2$.

Fourth Layer: Yellow Filter Layer

A 2.5 % gelatin solution containing 5 g of yellow colloidal silver and 5 g of 2,5-di-tert-octylhydroquinone dispersed in dibutyl phthalate was applied to 200 mg/m$^2$ of colloidal silver.

Fifth Layer: Yellow-Forming Blue-Sensitive Silver Halide Emulsion Layer

A yellow coupler, α-[4-(1-benzyl-2-phenyl-3,5-dioxo-1,2,4-triazolidinyl) ]-α-pivalyl-2-chloro-5-[γ-(2,4-di-tert-amylphenoxy)butylamido]acetanilide (Y - 1) (120 g), 3.5 g of 2,5-di-tert-octylhydroquinone, 200 g of paraffin, 100 g of Tinuvin (trade name, produced by Ciba-Geigy AG) and 70 ml of ethyl acetate were mixed and dissolved, added with a gelatin solution containing sodium dodecylbenzenesulfonate, followed by addition of an internal latent image type silver halide emulsion (Em - 1) sensitized with $3.0\times10^{-4}$ mole of a sensitizing dye [I]per mole of silver halide, and the mixture was applied to a silver amount of 400 mg/m$^2$ and a coupler amount of 400 mg/m$^2$.

Sixth Layer: Protective Layer

Gelatin was coated to an amount of 200 mg/m$^2$.

In all of the above layers, saponin was contained as an coating aid. Also, as the film hardener, 2,4-dichloro-6-hydroxy-s-triazine sodium was added to each 0.02 g per 1 g of gelatin in the layers 2, 4 and 6.

(Preparation of Negative-Type Light-Sensitive Silver Halide Material)

On a polyethylene-coated paper support, the following respective layers were coated successively from the support side to prepare a light-sensitive material.

As the polyethylene-coated paper, there was employed one prepared by adding 6.8 % by weight of an anatase type titanium oxide to a mixture of 200 parts by weight of a polyethylene having an average molecular weight of 100,000 and a density of 0.95 and 20 parts by weight of a polyethylene having an average molecular weight of 2,000 and a density of 0.80, forming a coated layer of the mixture with a thickness of 0.035 mm on the surface of a pure paper having a weight of 170 g/m$^2$ according to extrusion coating and providing a coated layer with a thickness of 0.040 mm only with polyethylene on the back surface. After pre-treatment by corona discharging was applied on the polyethylene-coated surface on the support surface, the following respective layers were successively coated.

First Layer

For the blue-sensitive silver halide emulsion, a negative-type emulsion (Em-2) was employed, which contained 350 g of gelatin per mole of silver halide, was sensitized with the use of $2.5\times10^{-4}$ mole of a sensitizing dye (I) having the structure shown below (isopropyl alcohol was used as the solvent) per mole of silver halide, contained 200 mg/m$^2$ of 2,5-di-t-butylhydroquinone dispersed by dissolving in dibutyl phthalate and 2.0 g$\times 10^{-1}$ mole of silver halide and was coated to a silver amount of 300 mg/m$^2$.

Second Layer:

This layer is a gelatin layer containing 300 mg/m$^2$ of di-t-octylhydroquinone dispersed by dissolving in dibutyl phthalate and as the UV-ray absorbers, 200 mg/m$^2$ of a mixture (1:1:1:1) of 2-(2'-hydroxy-3',5'-di-t-butylphenyl)benzotriazole, 2-(2'-hydroxy-5'-t-butylphenyl)-benzotriazole, 2-(2'-hydroxy-3'-t-butyl-5'-methylphenyl)-5-chloro-benzotriazole and 2-(2'-hydroxy-3',5'-di-t-butylphenyl)-5-chloro-benzotriazole, and coated to a gelatin amount of 1900 mg/m$^2$.

Third Layer:

A green-sensitive silver halide emulsion (Em-2) was employed, which contained 450 g of gelatin per mole of silver halide, was sensitized with the use of 2.5$\times 10^{-4}$ mole of a sensitizing dye (II) having the structure shown below per mole of silver halide, contained 200 mg/m$^2$ of 2,5-di-tert-butylhydroquinone dispersed by dissolving in a solvent mixture comprising 2:1 of dibutyl phthalate and tricresyl phosphate and 1.5$\times 10^{-1}$ mole of [M-1]as the magenta coupler per mole of silver halide, and was coated to a silver amount of 230 mg/m$^2$ and an AI dye [I]of 50 mg/m$^2$. As the antioxidant, 0.30 mole of 2,2,4-trimethyl-6-lauryloxy-7-t-oxtylchromane was added per mole of coupler.

Fourth Layer

This layer is a gelating layer containing 30 mg/m$^2$ of di-t-octylhydroquinone dispersed by dissolving in dibutyl phthalate and as the UV-ray absorbers, 500 mg/m$^2$ of a mixture (2:1.5:1.5:2) of 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chloro-benzotriazole and 2-(2'-hydroxy-3',5'-di-t-butylphenyl)-5-chloro-benzotriazole, and coated to a gelatin amount of 1900 mg/m$^2$.

Fifth Layer

A red-sensitive silver halide emulsion (Em-2) was employed, which contained 500 g of gelatin per mole of silver halide, was sensitized with the use of 2.5$\times 10^{-5}$ mole of a sensitizing dye (III) having the structure shown below per mole of silver halide, contained 150 mg/m$^2$ of 2,5-ditert-butylhydroquinone dispersed by dissolving in dibutyl phthalate and 3.5$\times 10^{-1}$ mole of [C - 1]as the cyan coupler per mole of silver halide, and was coated to a silver amount of 280 mg/m$^2$ and an AI dye [III]of 40 mg/m$^2$.

Sixth Layer

This is a gelatin layer and gelatin is coated to 900 mg/m$^2$.

The film hardener, bis(vinylsulfonylmethyl) ether contained (10 mg per 1 g of gelatin), and saponin as coating aids.

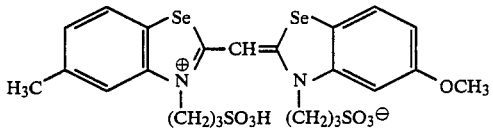

Sensitizing dye I

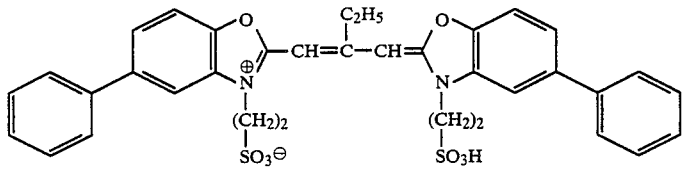

Sensitizing dye II

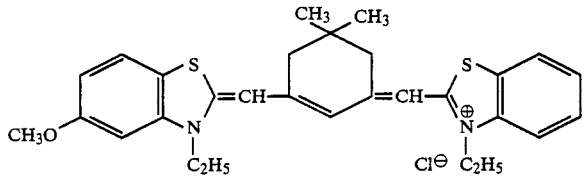

Sensitizing dye III

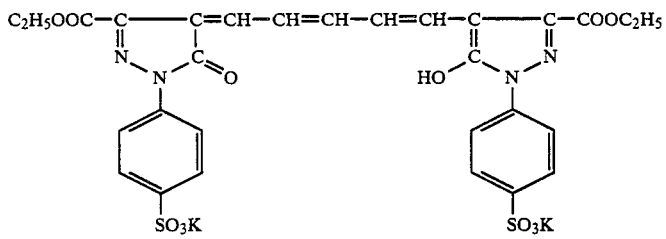

AI dye [I]

-continued

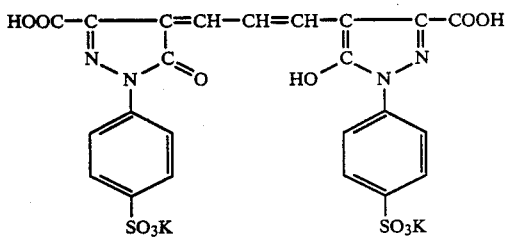

AI dye [II]

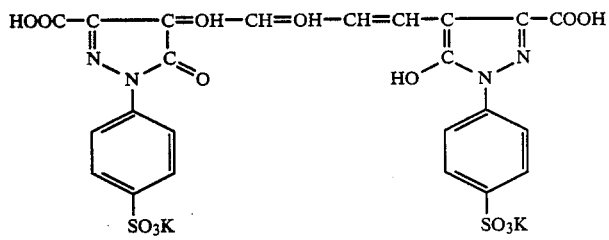

AI dye [III]

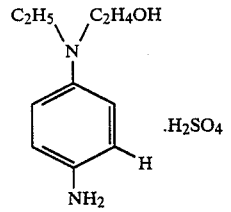

CD-1

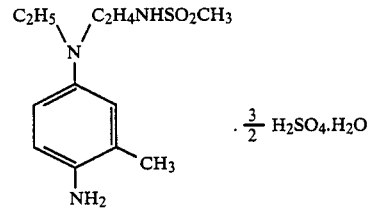

CD-2

The above light-sensitive material samples were subjected to exposure through an optical wedge and processed according to the following steps:

| Processing step (38° C.) | Processing step (I) | Processing step (II) |
|---|---|---|
| Dipping (Color developing solution) | 8 sec | |
| Color developing (whole surface uniformly exposed with light of 1 lux for the first 10 sec) | 90 sec Whole surface | 90 sec no uniform exposure |
| Bleach-fixing | 60 sec | 60 sec |
| Stabilizing processing substituted for water washing | 60 sec (2 layer countercurrent) | 60 sec |
| Drying | 60 to 80° C. 120 sec | 120 sec |

The respective processing solutions had the following compositions:

| [Color developing solution] | |
|---|---|
| Pure water | 800 ml |
| Sulfate of hydroxylamine | 2.5 g |
| Potassium bromide | (indicated in Table 1) |
| Sodium chloride | 1.0 g |
| Potassium sulfite | 1.0 g |
| Triethanolamine | 2.0 g |
| Color developing agent [the following CD − 1/CD − 2 = 1/1] | 0.03 mole |
| 1-Hydroxyethylidene-1,1-diphosphonic acid (60% aqueous solution) | 1.5 ml |
| Magnesium chloride | 0.3 g |
| Potassium carbonate | 32 g |
| Kaycoll-PK-Conc (optical brightener, produced by Shinnisso Kako K. K.) | 2.0 g |
| Made up to one liter with addition of pure water and adjusted to pH = 10.1 with 20% potassium hydroxide or 10% diluted sulfuric acid. | |

| [Bleach-fixing solution] | |
|---|---|
| Pure water | 550 ml |
| Iron (III) ammonium ethylenediaminetetraacetate | 65 g |
| Ammonium thiosulfate (70% aqueous solution) | 85 g |
| Sodium hydrogen sulfite | 10 g |
| Sodium metabisulfite | 2 g |
| Disodium ethylenediaminetetraacetate | 20 g |
| 2-Amino-5-mercapto-1,3,4-thiadiazole | 1.0 g |
| Made up to one liter with addition of pure water and adjusted to pH = 7.0 with aqueous ammonia or diluted sulfuric acid. | |

| [Stabilizing solution substituting for water washing] | |
|---|---|
| Ortho-phenylphenol | 0.2 g |
| 1-Hydroxyethylidene-1,1-diphosphonic acid (60% aqueous solution) | 2.0 g |
| Aqueous ammonia | 3.0 g |
| Made up to one liter with addition of water and adjusted to pH = 7.8 with aqueous ammonia and sulfuric acid. | |

Provided that the internal latent image type color light-sensitive material was processed in the processing step (I), while the negative-type color light-sensitive material in the processing step (II).

Maximum spectral reflective densities of yellow, magenta and cyan after processing were measured by use of PDA-65 (produced by KONICA CORPORATION).

The results are shown in Table 1.

TABLE 1

| Sample No. | Light-sensitive material | KBr concentration in color developing solution (mole/l) | Maximum spectral reflective density Y | M | C |
|---|---|---|---|---|---|
| 1 (Comparative) | Negative-type color light-sensitive material | $2.0 \times 10^{-2}$ | 1.32 | 1.50 | 1.29 |
| 2 (Comparative) | | $1.0 \times 10^{-2}$ | 1.39 | 1.59 | 1.38 |
| 3 (Comparative) | | $5.0 \times 10^{-3}$ | 1.45 | 1.66 | 1.46 |
| 4 (Comparative) | | $4.0 \times 10^{-3}$ | 1.49 | 1.76 | 1.59 |
| 5 (Comparative) | | $1.0 \times 10^{-3}$ | 1.53 | 1.82 | 1.62 |
| 6 (Comparative) | | $1.0 \times 10^{-4}$ | 1.59 | 1.85 | 1.65 |
| 7 (Comparative) | Internal latent image type color light-sensitive material | $2.0 \times 10^{-2}$ | 1.36 | 1.49 | 1.39 |
| 8 (Comparative) | | $1.0 \times 10^{-2}$ | 1.52 | 1.60 | 1.51 |
| 9 (Comparative) | | $5.0 \times 10^{-3}$ | 1.68 | 1.79 | 1.65 |
| 10 (This invention) | | $4.0 \times 10^{-3}$ | 1.84 | 1.85 | 1.79 |
| 11 (This invention) | | $1.0 \times 10^{-3}$ | 1.89 | 1.93 | 1.83 |
| 12 (This invention) | | $1.0 \times 10^{-4}$ | 1.93 | 1.96 | 1.86 |

As is apparent from the results in Table 1, it can be understood that the internal latent image type color light-sensitive material is more dependent on the concentration in the color developing solution than the negative-type color light-sensitive material and yet the development accelerating effect is particularly great at a KBr concentration of $4.0 \times 10^{-1\ 3}$ mole/liter or less.

EXAMPLE 2 (COMPARATIVE)

The same evaluation as in Example 1 was performed except for changing only the silver halide composition of the shell and the inhibitor in the internal latent image type color light-sensitive material as shown in Table 2.

Provided that the maximum spectral reflective density was written only in terms of the yellow density as the representative characteristic of rapidness.

TABLE 2

| Sample No. | AgCl content in the shell layer (mole %) | Mercapto type compound 10 mg/AgX 1 mole | KBr concentration in color developing solution (mole/l) | Maximum spectral reflective density (yellow density) |
|---|---|---|---|---|
| 13 (Comparative) | 0 | None | $2.0 \times 10^{-2}$ | 1.15 |
| 14 (Comparative) | 0 | None | $1.0 \times 10^{-2}$ | 1.31 |
| 15 (This invention) | 0 | None | $4.0 \times 10^{-3}$ | 1.50 |
| 16 (This invention) | 0 | None | $5.0 \times 10^{-4}$ | 1.60 |
| 17 (Comparative) | 30 | None | $2.0 \times 10^{-2}$ | 1.20 |
| 18 (Comparative) | 30 | None | $1.0 \times 10^{-2}$ | 1.39 |

TABLE 2-continued

| Sample No. | AgCl content in the shell layer (mole %) | Mercapto type compound 10 mg/AgX 1 mole | KBr concentration in color developing solution (mole/l) | Maximum spectral reflective density (yellow density) |
|---|---|---|---|---|
| 19 (This invention) | 30 | None | $4.0 \times 10^{-3}$ | 1.62 |
| 20 (This invention) | 30 | None | $5.0 \times 10^{-4}$ | 1.73 |
| 21 (Comparative) | 50 | None | $2.0 \times 10^{-2}$ | 1.27 |
| 22 (Comparative | 50 | None | $1.0 \times 10^{-2}$ | 1.45 |
| 23 (This invention) | 50 | None | $4.0 \times 10^{-3}$ | 1.75 |
| 24 (This invention) | 50 | None | $5.0 \times 10^{-4}$ | 1.84 |
| 25 (Comparative) | 30 | S-1 | $2.0 \times 10^{-2}$ | 1.02 |
| 26 (Comparative) | 30 | S-1 | $1.0 \times 10^{-2}$ | 1.30 |
| 27 (This invention) | 30 | S-1 | $4.0 \times 10^{-3}$ | 1.59 |
| 28 (This invention) | 30 | S-1 | $5.0 \times 10^{-4}$ | 1.72 |
| 29 (This invention) | 30 | S-2 | $4.0 \times 10^{-3}$ | 1.57 |
| 30 (This invention) | 30 | S-3 | $4.0 \times 10^{-3}$ | 1.57 |
| 31 (This invention) | 30 | S-4 | $4.0 \times 10^{-3}$ | 1.60 |

S-1

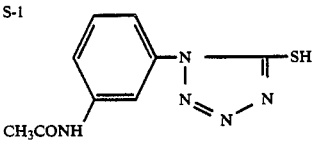

S-2

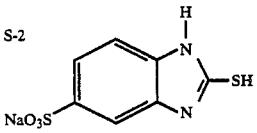

S-3

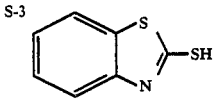

S-4

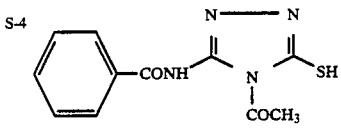

From the results in Table 2, it can be seen that the maximum reflective density differs depending on the silver chloride content in the shell layer and more preferable rapidness can be obtained when silver chloride is contained in the shell layer, the KBr concentration in the color developing solution is $4.0 \times 10^{-3}$ mole/liter or less. Also, it can be understood that the acceleration effect is marked particularly when a mercapto type compound is contained. Further, it has been also found that a light-sensitive material containing no mercapto type compound is higher in Dmin (minimum density) by 0.01 to 0.02 to be inferior in white ground.

EXAMPLE 3 (COMPARATIVE)

By adding the above inhibitor S-2 (10 mg per mole of Agx) into the internal latent image type light-sensitive material (AgCl content in the shell layer: 50 mole %, other being AgBr: 50 mole %), the relationship between the amount of benzyl alcohol in the color developing solution and the KBr concentration was investigated.

The results are shown in Table 3.

TABLE 3

| Sample No. | Benzyl alcohol in color developing solution (g/l) | KBr concentration in color developing solution (mole/l) | Maximum reflective density (yellow density) |
|---|---|---|---|
| 32 (Comparative) | 15 | $1.0 \times 10^{-2}$ | 1.53 |
| 33 (Comparative) | 15 | $5.0 \times 10^{-3}$ | 1.62 |
| 34 (This invention) | 15 | $1.0 \times 10^{-3}$ | 1.79 |
| 35 (Comparative) | 5 | $1.0 \times 10^{-2}$ | 1.46 |
| 36 (Comparative) | 5 | $5.0 \times 10^{-3}$ | 1.59 |
| 37 (This invention) | 5 | $1.0 \times 10^{-3}$ | 1.78 |
| 38 (Comparative) | 0.5 | $1.0 \times 10^{-2}$ | 1.35 |
| 39 (Comparative) | 0.5 | $5.0 \times 10^{-3}$ | 1.56 |
| 40 (This invention) | 0.5 | $1.0 \times 10^{-3}$ | 1.78 |
| 41 (Comparative) | None | $1.0 \times 10^{-2}$ | 1.31 |
| 42 (Comparative) | None | $5.0 \times 10^{-3}$ | 1.55 |
| 43 (This invention) | None | $1.0 \times 10^{-3}$ | 1.77 |

As apparent from the results in Table 3, the effect of benzyl alcohol on the KBr concentration in the color developing solution appears particularly markedly when the benzyl alcohol level is low, exhibiting good development acceleration at a concentration of $1.0 \times 10^{-3}$ mole/liter or lower. Therefore, when benzyl alcohol is reduced in amount or made 0 from the standpoint of environmental pollution or solubility, it is necessary to make the concentration of KBr in the color developing solution lower than in the present invention.

EXAMPLE 4

An internal latent type core/shell emulsion was prepared as described below.

While an aqueous solution containing gelatin was controlled at 50 ° C., an aqueous silver nitrate solution and an aqueous solutions containing potassium bromide and sodium chloride (KBr : NaCl = 50:50 in molar ratio) were added at the same time thereto to give a cubic emulsion with an average particle size of 0.38 μm. To the core emulsion thus obtained were added sodium thiosulfate and potassium chloroaurate, and chemical aging was effected at 55 ° C. for 120 minutes. This emulsion is called Emulsion B.

With Emulsion B as the core, and further an aqueous silver nitrate solution and an aqueous solution containing potassium bromide and sodium chloride (the content of silver chloride is shown in Table 4) which are equimoles to the silver nitrate solution were added at the same time to give tetradecahedral particles with an average particle size of 0.60 μm.

To these emulsions was added sodium thiosulfate to effect chemical sensitization, and after completion of chemical sensitization, 10 mg of 1-phenyl-5-mercaptotetrazole was added per one mole of silver halide.

(Preparation of internal latent image type light-sensitive silver halide material)

On a paper support having polyethylene laminated thereon, the following respective layers were provided by coating successively to prepare an internal latent image type light-sensitive material sample.

First Layer: Cyan-Forming Red-Sensitive Silver Halide Emulsion Layer 90 g of cyan couplers (C-2) and (C-3) (molar ratio; 1:1) shown below, 2 g of 2,5-di-tert-octylhydroquinone, 50 g of tricresylphosphate, 200 g of paraffin and 50 g of ethyl acetate were mixed and dissolved, added with a gelatin solution containing sodium dodecylbenzenesulfonate, followed by addition of an internal latent image type silver halide emulsion (shown in Table 4) sensitized with $3.5 \times 10^{-5}$ mole of a sensitizing dye (III) used in Example 1 per mole of silver halide, and the mixture was applied to a silver amount of 400 mg/m$^2$, and AI dye [I](used in Example 1) of 20 mg/m$^2$ and a coupler amount of 360 mg/m$^2$ Second Layer: Intermediate Layer One hundred (100) ml of a 2.5% gelatin solution containing 5 g of gray colloidal silver and 10 g of 2,5-di-tertoctylhydroquinone dispersed in dibutyl phthalate was applied to a colloidal silver amount of 400 mg/m$^2$.

Third Layer: Magenta-Forming Green-Sensitive Silver Halide Emulsion Layer

A magenta coupler (M-2) (100 g) shown below, 5 g of 2,5-di-tert-octylhydroquinone, 50 g of Sumilizer MDP (trade name, produced by Sumitomo Kagaku Kogyo K.K.), 200 g of paraffin, 100 g of dibutyl phthalate and 50 g of ethyl acetate were mixed and dissolved, added with a gelatin solution containing sodium dodecylbenzenesulfonate, followed by addition of an internal latent image type silver halide emulsion (shown in Table 4) sensitized with $3.0 \times 10^{-4}$ mole of a sensitizing dye (II) used in Example 1 per mole of silver halide, and the mixture was applied to a silver amount of 400 mg/m$^2$, an AI dye [II] (used in Example 1) of 20 mg/m$^2$ and a coupler amount of 400 mg/m$^2$.

Fourth layer: Yellow filter layer

A 2.5% gelatin solution containing 5 g of yellow colloidal silver and 5 g of 2,5-di-tert-octylhydroquinone dispersed in dibutyl phthalate was applied to 200 mg/m$^2$ of colloidal silver.

Fifth layer: Yellow-forming blue-sensitive silver halide emulsion layer

A yellow coupler (Y - 2) (120 g) shown below, 3.5 g of 2,5-di-tert-octylhydroquinone, 200 g of paraffin, 100 g of Tinuvin (trade name, produced by Ciba-Geigy AG) and 70 ml of ethyl acetate were mixed and dissolved, added with a gelatin solution containing sodium dodecylbenzenesulfonate, followed by addition of an internal latent image type silver halide emulsion (shown in Table 4) sensitized with $3.0 \times 10^{-4}$ mole of a sensitizing dye (I) used in Example 1 per mole of silver halide, and the mixture was applied to a silver amount of 400 mg/m$^2$ and a coupler amount of 400 mg/m$^2$.

Sixth layer: Protective layer

Gelatin was coated to an amount of 200 mg/m$^2$.

In all of the above layers, saponin was contained as an coating aid. Also, as the film hardener, 2,4-dichloro-6-hydroxy-s-triazine sodium was added to each 0.02 g per 1 g of gelatin in the layers 2, 4 and 6.

The internal latent image type silver halide emulsions in the first, the second and the third layers used are the same compositions (shown in Table 4).

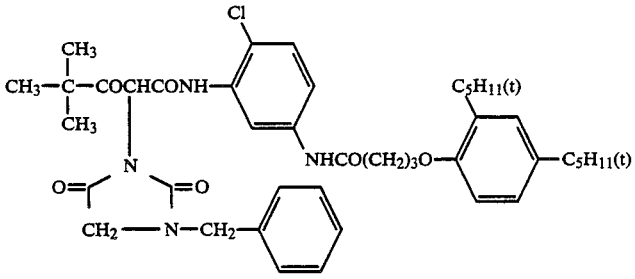

(Y-2)

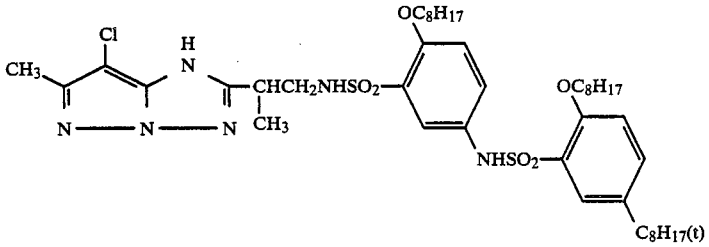

(M-2)

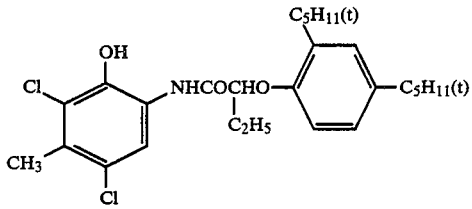

(C-2)

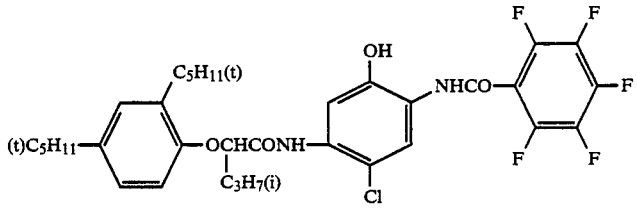

(C-3)

The above light-sensitive material samples were processed by using KONICA color 7 (produced by KONICA CORPORATION) to the following steps. Provided that densities after processing were adjusted to 0.6 by Y, M or C density.

| Processing step (38° C.) | Processing step |
|---|---|
| Dipping (Color developing solution) | 8 sec |
| Color developing (whole surface uniformly exposed with light of 1 lux for the first 10 sec) | 90 sec Whole surface |
| Bleach-fixing | 60 sec |
| Stabilizing processing | 60 sec |

-continued

| Processing step (38° C.) | Processing step |
|---|---|
| substituted for water washing | (2 layer countercurrent) |
| Drying | 60 to 80° C. 120 sec |

The respective processing solutions had the following compositions:

| [Color developing tank solution] | |
|---|---|
| Pure water | 800 ml |
| Preservative (shown in Table 4) | 4.0 g |
| Potassium bromide | 0.6 g |
| Sodium chloride | 1.0 g |
| Potassium sulfite | 1.0 g |
| Triethanolamine | 2.0 g |
| Color developing agent [the CD – 1/CD – 2 (used in Example 1) = 1/1] | 0.03 mole |
| Sodium 1,2-dihydroxybenzene-3,5-disulfonate | 0.6 g |
| Potassium carbonate | 32 g |
| Kaycoll-PK-Conc (optical brightener, produced by Shinnisso Kako K. K.) | 2.0 g |
| Made up to one liter with addition of pure water and adjusted to pH = 10.1 with 20% potassium hydroxide or 10% diluted sulfuric acid. | |

| [Bleach-fixing tank solution and replenishing solution] | |
|---|---|
| Pure water | 550 ml |
| Iron (III) ammonium ethylenediaminetetra-acetate | 65 g |
| Ammonium thiosulfate (70% aqueous solution) | 85 g |
| Sodium hydrogen sulfite | 10 g |
| Sodium metabisulfite | 2 g |
| Disodium ethylenediaminetetraacetate | 20 g |
| 2-Amino-5-mercapto-1,3,4-thiadiazole | 1.0 g |
| Made up to one liter with addition of pure water and adjusted to pH = 7.0 with aqueous ammonia or diluted sulfuric acid. | |

| [Stabilizing tank solution substituting for water washing and replenishing solution] | |
|---|---|
| Ortho-phenylphenol | 0.2 g |
| Sodium aminomethanesulfonate | 1.0 g |
| 1-Hydroxyethylidene-1,1-diphosphonic acid (60% aqueous solution) | 2.0 g |
| Ammonium sulfite (40% aqueous solution) | 10 ml |
| Aqueous ammonia | 3.0 g |
| Kaycoll-PK-Conc (optical brightener, produced by Shinnisso Kako K. K.) | 2.0 g |
| Made up to one liter with addition of water and adjusted to pH = 7.8 with aqueous ammonia and sulfuric acid. | |

Replenishing amounts of the replenishing solutions of the color developing solution, bleach-fixing solution and the stabilizing solution substituting for water washing in the above processing steps are 320 ml per each 1 $m^3$, and processed by the total replenishing solution being 3-times the volume of the color developing tank (hereinafter referred to 3R).

Spectral refractive maximum densities and minimum densities of yellow, magenta and cyan immediately after processing and after completion of 3R of samples which are previously exposured with an optical wedge were measured by use of PDA-65 (produced by KONICA CORPORATION). Provided that when the above samples are used, whole surface exposure of the color developing was stopped.

The results are shown in Table 4.

TABLE 4

| Sample No. | AgX composition of shell (AgCl content) (mole %) | Preservative | Spectral reflective maximum density: Immediately after processing Y | M | C | 3R Y | M | C | Spectral reflective minimum density: Immediately after processing Y | M | C | 3R Y | M | C | Remarks |
|---|---|---|---|---|---|---|---|---|---|---|---|---|---|---|---|
| 44 | — | HAS*1 | 1.85 | 1.90 | 1.83 | 1.83 | 1.86 | 1.79 | 0.09 | 0.08 | 0.09 | 0.10 | 0.09 | 0.11 | Comparative |
| 45 | 20 | HAS*1 | 1.80 | 1.86 | 1.79 | 1.77 | 1.82 | 1.76 | 0.09 | 0.08 | 0.09 | 0.10 | 0.09 | 0.11 | Comparative |
| 46 | 50 | HAS*1 | 1.74 | 1.81 | 1.72 | 1.71 | 1.77 | 1.68 | 0.09 | 0.08 | 0.09 | 0.11 | 0.10 | 0.11 | Comparative |
| 47 | 80 | HAS*1 | 1.65 | 1.75 | 1.64 | 1.62 | 1.71 | 1.61 | 0.09 | 0.08 | 0.09 | 0.11 | 0.11 | 0.13 | Comparative |
| 48 | — | DEHA*2 | 1.84 | 1.88 | 1.82 | 1.65 | 1.72 | 1.65 | 0.09 | 0.09 | 0.08 | 0.12 | 0.11 | 0.13 | Comparative |
| 49 | 20 | DEHA*2 | 1.85 | 1.90 | 1.83 | 1.78 | 1.80 | 1.75 | 0.09 | 0.09 | 0.08 | 0.10 | 0.10 | 0.11 | This invention |
| 50 | 50 | DEHA*2 | 1.85 | 1.92 | 1.84 | 1.82 | 1.84 | 1.78 | 0.09 | 0.09 | 0.08 | 0.10 | 0.10 | 0.10 | This invention |
| 51 | 80 | DEHA*2 | 1.87 | 1.94 | 1.86 | 1.85 | 1.91 | 1.83 | 0.09 | 0.09 | 0.09 | 0.10 | 0.10 | 0.09 | This invention |

*1HAS: Sulfate of hydroxylamine
*2DEHA: Diethylhydroxylamine (Exemplary 17)

As seen from Table 4, when silver chloride is not contained in the composition of silver halide of the shell, while fluctuation of the maximum density and the minimum density of from after processing to 3R of diethylhydroxylamine of the present invention is larger as compared with hydroxylamine sulfate, it can be understood that remarkable effect can be admitted to the above problem when the silver chloride content in the shell becomes higher.

Also, when the silver chloride content is making higher, lowering of density is remarkable in hydroxylamine sulfate, but in the case of using diethylhydroxylamine, the maximum density is rather increased.

EXAMPLE 5

The spectral reflective maximum density was measured in same manner as in Example 4 except for using No. 3 (AgCl in the shell=50 mole %, preservative: hydroxylamine sulfate) and No. 7 (AgCl in the shell=50 mole %, preservative: diethylhydroxylamine) used in Example 4, changing the preservative No. 7 as shown in Table 5 and changing the amount of benzyl alcohol in the color developing solution from 0 to 15 ml.

The results are shown in Table 5.

TABLE 5

| Sample No. | Preservative | Benzyl alcohol (g/l) | Spectral reflective maximum density: Immediately after processing Y | M | C | 3R Y | M | C | Remarks |
|---|---|---|---|---|---|---|---|---|---|
| 52 | HAS* | — | 1.74 | 1.80 | 1.71 | 1.70 | 1.77 | 1.67 | Comparative |
| 53 | HAS* | 3.0 | 1.76 | 1.83 | 1.75 | 1.71 | 1.81 | 1.70 | Comparative |
| 54 | HAS* | 10.0 | 1.77 | 1.85 | 1.78 | 1.73 | 1.84 | 1.75 | Comparative |
| 55 | HAS* | 15.0 | 1.80 | 1.85 | 1.81 | 1.78 | 1.85 | 1.77 | Comparative |
| 56 | Exemplary comp. (17) | — | 1.85 | 1.91 | 1.83 | 1.82 | 1.83 | 1.78 | This invention |
| 57 | Exemplary comp. (17) | 3.0 | 1.86 | 1.92 | 1.85 | 1.83 | 1.83 | 1.79 | This invention |
| 58 | Exemplary comp. (17) | 10.0 | 1.89 | 1.93 | 1.87 | 1.84 | 1.83 | 1.80 | This invention |
| 59 | Exemplary comp. (17) | 15.0 | 1.90 | 1.93 | 1.88 | 1.85 | 1.85 | 1.81 | This invention |
| 60 | Exemplary comp. (20) | — | 1.87 | 1.92 | 1.86 | 1.86 | 1.91 | 1.85 | This invention |
| 61 | Exemplary comp. (20) | 3.0 | 1.88 | 1.92 | 1.87 | 1.86 | 1.91 | 1.85 | This invention |
| 62 | Exemplary comp. (20) | 10.0 | 1.90 | 1.93 | 1.89 | 1.87 | 1.91 | 1.86 | This invention |
| 63 | Exemplary comp. (20) | 15.0 | 1.91 | 1.94 | 1.91 | 1.87 | 1.92 | 1.87 | This invention |
| 64 | Exemplary comp. (18) | — | 1.84 | 1.90 | 1.81 | 1.81 | 1.86 | 1.79 | This invention |

TABLE 5-continued

| Sample No. | Preservative | Benzyl alcohol (g/l) | Spectral reflective maximum density: Immediately after processing Y | M | C | 3R Y | M | C | Remarks |
|---|---|---|---|---|---|---|---|---|---|
| 65 | Exemplary comp. (31) | — | 1.83 | 1.91 | 1.83 | 1.81 | 1.89 | 1.82 | This invention |

*HAS: Sulfate of hydroxylamine

As apparent from Table 5, it can be understood that fluctuation of the maximum density is small when the preservative of the present invention is employed, and also the effect of the present invention can be remarkably revealed when the amount of benzyl alcohol is little.

EXAMPLE 6

The color developing solutions of Nos. 52, 56, 60, 64 and 65 (3R completed solution) shown in Table 5 were stored at 40° C. in the color developing solution tank having an open area of 13 $cm^2$/liter and occurrence of tar was observed with eyes.

The results are shown in Table 6.

TABLE 6

| | Days by the occurrence of tar |
|---|---|
| No. 52 | 12 days |
| No. 56 | 13 days |
| No. 60 | 15 days |
| No. 64 | 12 days |
| No. 65 | 13 days |

As apparent from Table 6, it can be understood that the preservative of the present invention is employed, preservation properties of the sample are the same or superior to those of the one which employs hydroxylamine sulfate.

EXAMPLE 7

In the same manner as in Example 4 except for using the following magenta couplers (M - 3) to (M - 7) in place of (M - 1) used in the third layer of the internal latent image type light-sensitive silver halide material and using a core-shell type emulsion having a silver chloride content of the shell being 50 mole %. These samples were subjected to exposure in the same manner as in Example 4 except for using the color developing solution wherein the preservative thereof is DEHA (Sample No. 50).

These samples were evaluated in the same manner as in Example 4. The results are shown in Table 7.

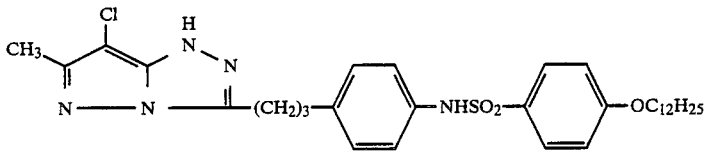

(M-3)

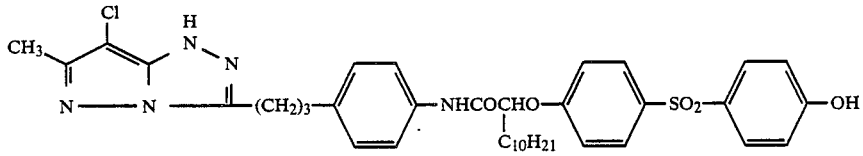

(M-4)

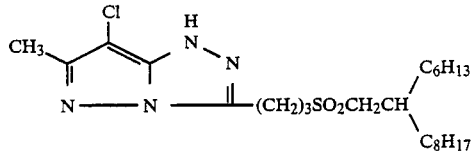

(M-5)

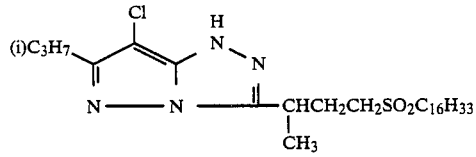

(M-6)

-continued (M-7)

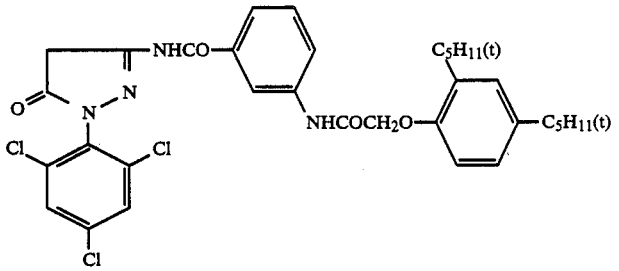

TABLE 7

| Sample No. | Magenta coupler | Spectral reflective maximum density: Immediately after processing Y | M | C | 3R Y | M | C | Spectral reflective minimum density: Immediately after processing Y | M | C | 3R Y | M | C | Remarks |
|---|---|---|---|---|---|---|---|---|---|---|---|---|---|---|
| 66 | M - 3 | 1.85 | 1.90 | 1.84 | 1.82 | 1.84 | 1.78 | 0.09 | 0.09 | 0.08 | 0.10 | 0.10 | 0.10 | This invention |
| 67 | M - 4 | 1.85 | 1.90 | 1.84 | 1.82 | 1.84 | 1.78 | 0.09 | 0.09 | 0.08 | 0.10 | 0.10 | 0.10 | This invention |
| 68 | M - 5 | 1.85 | 1.90 | 1.84 | 1.82 | 1.85 | 1.78 | 0.09 | 0.09 | 0.08 | 0.10 | 0.10 | 0.10 | This invention |
| 69 | M - 6 | 1.85 | 1.90 | 1.84 | 1.82 | 1.85 | 1.78 | 0.09 | 0.09 | 0.08 | 0.10 | 0.10 | 0.10 | This invention |
| 70 | M - 7 | 1.85 | 1.90 | 1.84 | 1.82 | 1.80 | 1.78 | 0.09 | 0.10 | 0.08 | 0.10 | 0.12 | 0.10 | This invention |

As clearly seen from Table 7, by using the pyrazolotriazole type coupler as the magenta coupler, fluctuation in the maximum density and the minimum density become small.

EXAMPLE 8

As the silver halide photographic material, Sample No. 50 in Example 4 was used and the material was processed by using a color developing solution containing DEHA as the preservative and a bleach-fixing solution containing the bleaching accelerator shown in Table 8 in place of 2-amino-5-mercapto-1,3,4-thiadiazole. The maximum spectral reflective density of blue was measured in the same manner as in Example 4.

The results are shown in Table 8.

TABLE 8

| Sample No. | Bleaching accelerator | Maximum spectral reflective density: Immediately after processing | 3R |
|---|---|---|---|
| 71 | None | 1.87 | 1.94 |
| 72 | I - 1 | 1.86 | 1.83 |
| 73 | II - 2 | 1.86 | 1.83 |
| 74 | II - 15 | 1.86 | 1.83 |
| 75 | II - 24 | 1.86 | 1.83 |
| 76 | II - 27 | 1.86 | 1.83 |
| 77 | III - 3 | 1.85 | 1.82 |
| 78 | III - 14 | 1.86 | 1.82 |
| 79 | IV - 1 | 1.86 | 1.81 |
| 80 | V - 10 | 1.85 | 1.83 |
| 81 | V - 13 | 1.85 | 1.83 |
| 82 | VI - 1 | 1.86 | 1.82 |
| 83 | VII - 8 | 1.86 | 1.82 |
| 84 | VIII - 1 | 1.86 | 1.82 |
| 85 | VIII - 4 | 1.86 | 1.82 |
| 86 | IX - 1 | 1.86 | 1.82 |
| 87 | A' - 1 | 1.85 | 1.82 |

As clearly understood from Table 8, by using the bleaching accelerator of the present invention for the bleach-fixing solution, fluctuation of the maximum spectral reflective density of blue becomes small.

We claim:

1. A method for processing a light-sensitive silver halide color photographic material, characterized in that said light-sensitive silver halide color photographic material contains a core-shell type-internal latent image type silver halide emulsion, a shell of which contains at least silver chloride, and said light-sensitive silver halide color photographic material is processed with a color developing solution containing the compound represented by the following formula (A):

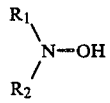

(A)

wherein $R_1$ and $R_2$ each represent a hydrogen atom or an alkyl group having 1 to 5 carbon atoms which may have a substituent or substituents, or $R_1$ and $R_2$ may be combined to form a ring, provided that the case where $R_1$ and $R_2$ are hydrogen atoms at the same time is excluded.

2. The method according to claim 1, wherein a bromide ion concentration of said color developing solution is $4.0\times10^{-3}$ mole/liter or less.

3. The method according to claim 1, wherein a concentration of the compound represented by the formula (A) in the color developing solution is 0.1 g/liter to 50 g/liter.

4. The method according to claim 3, wherein a concentration of the compound represented by the formula (A) in the color developing solution is 0.3 g/liter to 30 g/liter.

5. The method according to claim 4, wherein a concentration of the compound represented by the formula (A) in the color developing solution is 0.5 g/liter to 20 g/liter.

6. The method according to claim 1, wherein said color developing solution further contains a sulfite or sulforous ion releasing compound.

7. The method according to claim 6, wherein the concentration of the sulfite or sulforous ion releasing compound is within the range of $1.0\times10^{-4}$ to $1.0\times10^{-1}$ mole per liter of the color developing solution.

8. The method according to claim 6, wherein said sulfite or sulforous ion releasing compound is selected from the group consisting of potassium sulfite, sodium sulfite, ammonium sulfite, sodium metabisulfite, potassium metabisulfite, bisulfite adduct of acetaldehyde, bisulfite adduct of propionaldehyde and bisulfite adduct of glutaraldehyde.

9. The method according to claim 1, wherein said color developing solution contains 1.0 ml/liter or less of benzyl alcohol.

10. The method according to claim 9, wherein said color developing solution contains 0.5 ml/liter or less of benzyl alcohol.

11. The method according to claim 1, wherein said light-sensitive silver halide color photographic material contains at least one of the mercapto compound represented by the formula (B) or (C):

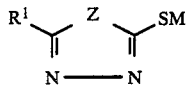

(B)

wherein Z represents —$NR^2$, an oxygen atom, a sulfur atom or a selenium atom; $R^1$ represents a hydrogen atom, an alkyl group, an aryl group, —$NR^3R^4$ group, —$NHCOR^3$ group or —$NHSO_2R^3$ group, where $R^3$ and $R^4$ each represent an alkyl group, an alkenyl group, a cycloalkyl group, an aryl group or an aralkyl group; $R^2$ represents a hydrogen atom, an alkyl group, an alkenyl group, a cycloalkyl group, an aryl group, an aralkyl group, an amino group, —$NHCOR^3$ group, —$NHSO_4R^3$ group, —$COR^5$ group or —$SO_2R^5$ group, where R represents an alkyl group, an alkenyl group, a cycloalkyl group, an aryl group, an aralkyl group or —$NR^3R^4$ group; and M represents a hydrogen atom, an alkali metal or an ammonium group;

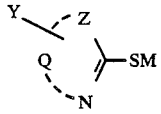

(C)

wherein Z represents —NR′, an oxygen atom, a sulfur atom or a selenium atom, where R′ represents a hydrogen atom, an alkyl group or an aryl group; Q represents a hydrocarbon group necessary for forming a 5-membered heterocyclic ring with Z and the nitrogen atom, and said heterocyclic ring may be fused with a benzene ring or a naphthalene ring; Y represents a hydrogen atom or a substituent; and M has the same meaning as defined above.

12. The method according to claim 11, wherein said compound represented by the formula (B) is selected from the group consisting of:

B-1

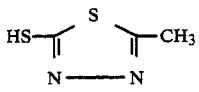

-continued

B-2

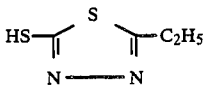

B-3

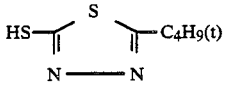

B-4

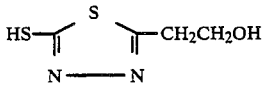

B-5

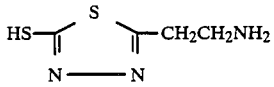

B-6

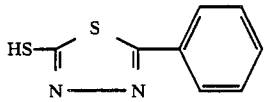

B-7

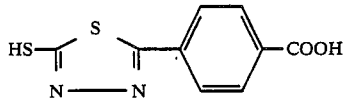

B-8

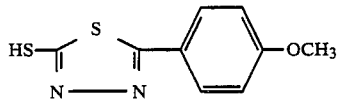

B-9

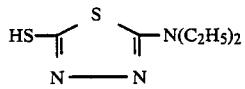

B-10

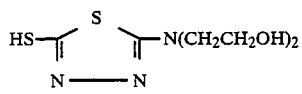

B-11

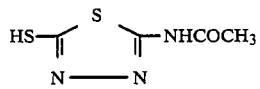

B-12

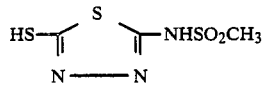

B-13

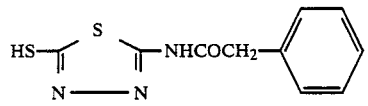

B-14

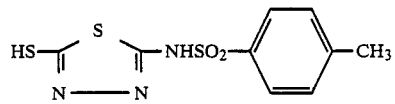

B-15

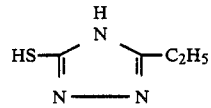

-continued
B-16
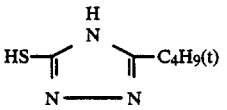
B-17
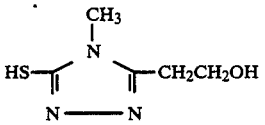
B-18
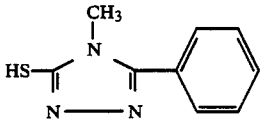
B-19
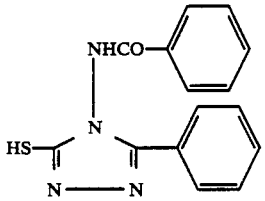
B-20
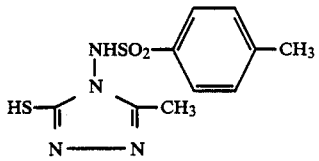
B-21
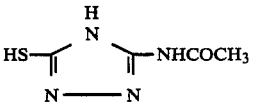
B-22
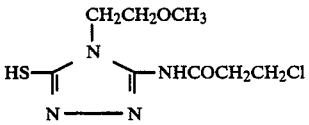
B-23
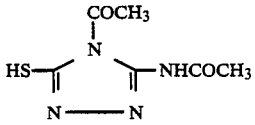
B-24
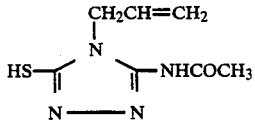
B-25
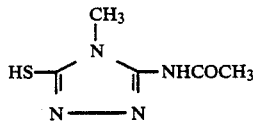
-continued
B-26
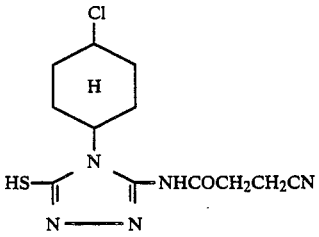
B-27
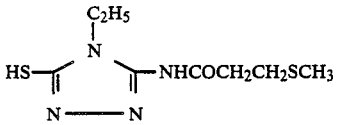
B-28
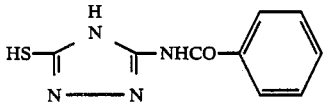
B-29
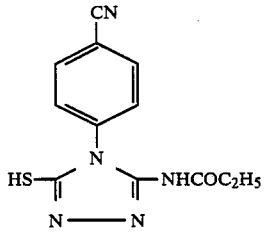
B-30
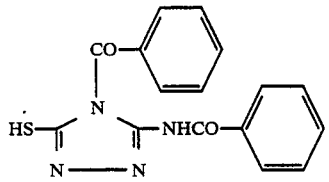
B-31
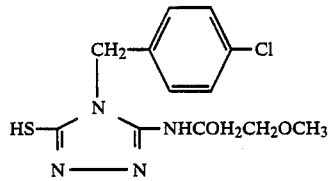
B-32
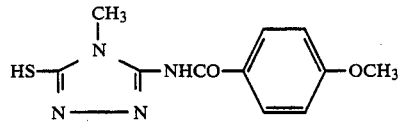
B-33
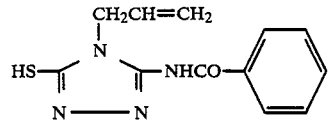
B-34
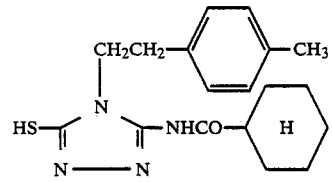

-continued
B-35
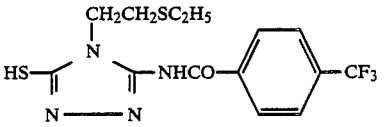
B-36
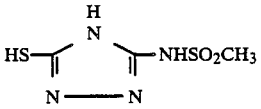
B-37
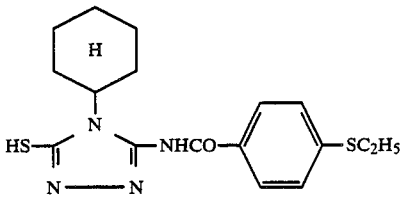
B-38
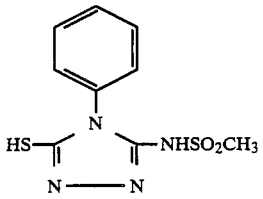
B-39
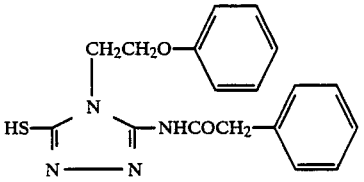
B-40
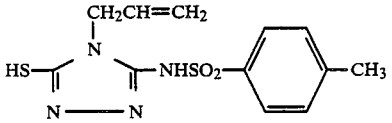
B-41
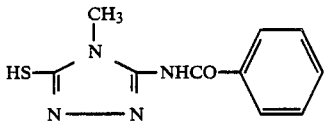
B-42
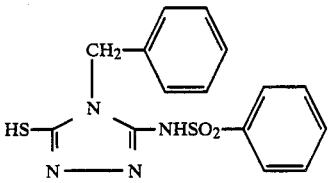
B-43
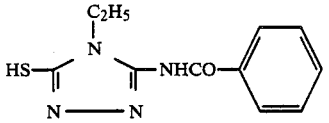
-continued
B-44
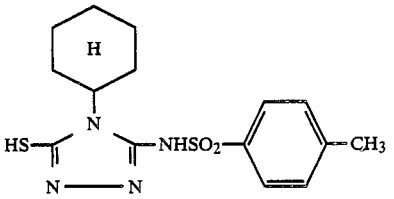
B-45
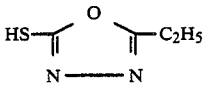
B-46
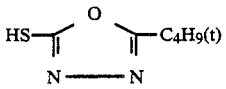
B-47
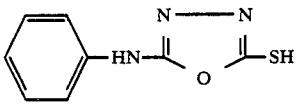
B-48
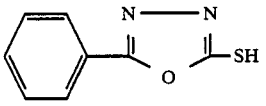
B-49
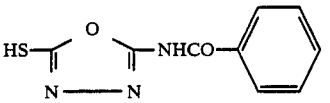
B-50
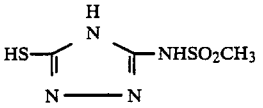
B-51
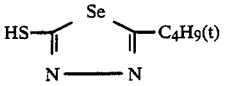
B-52
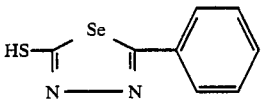
B-53
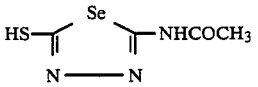
B-54
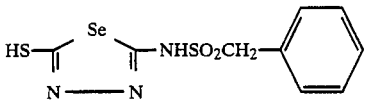
B-55
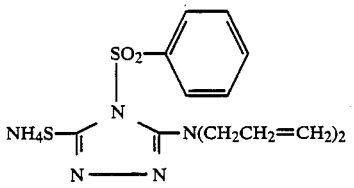
and -continued
B-56
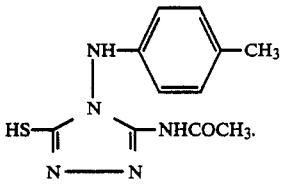
13. The method according to claim 11, wherein said compound represented by the formula (C) is selected from the group consisting of:
C-1
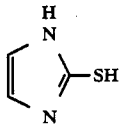
C-2
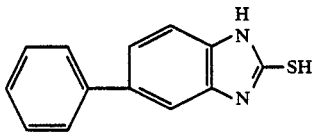
C-3
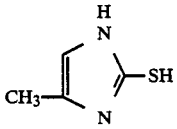
C-4
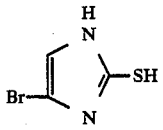
C-5
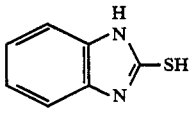
C-6
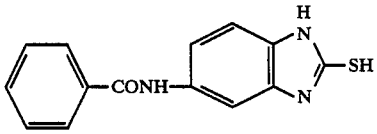
C-7
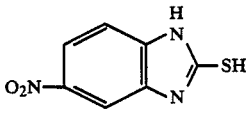
C-8
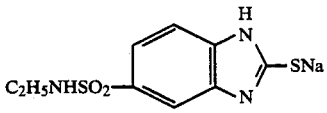
C-9
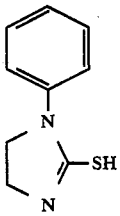
-continued
C-10
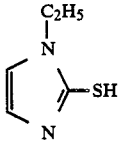
C-11
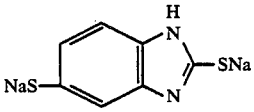
C-12
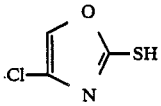
C-13
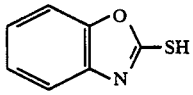
C-14
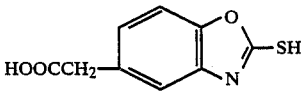
C-15
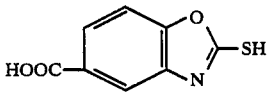
C-16
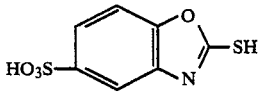
C-17
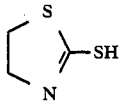
C-18
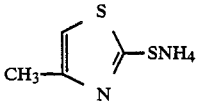
C-19
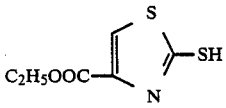
C-20
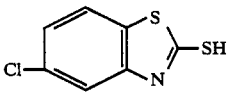
C-21
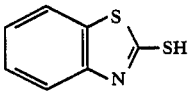
C-22
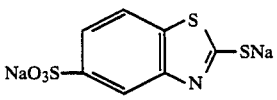

-continued

C-23

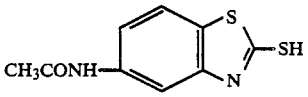

C-24

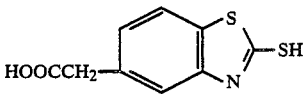

C-25

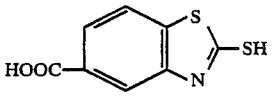

C-26

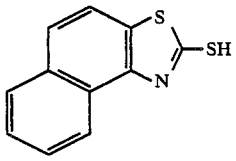

C-27

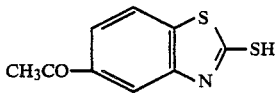

C-28

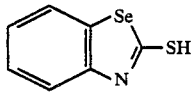

C-29

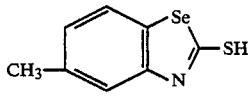

C-30

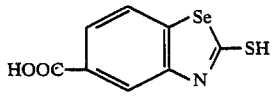

and

C-31

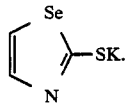

14. The method according to claim 1, wherein a stabilizing processing is applied after processing with a fixing solution or a bleach-fixing solution, without water washing step.

15. The method according to claim 1, wherein processing steps include a bleach-fixing processing step.

16. The method according to claim 15, wherein a bleach-fixing solution used in said bleach-fixing processing step contains at least one compound represented by the formulae (I) to (IX):

(I)

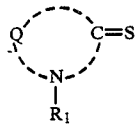

wherein Q represents a group of atoms necessary for formation of a nitrogen-containing hetero ring including fused unsaturated rings of 5 to 6 members, $R_1$ represents a hydrogen atom, an alkyl group having 1 to 6 carbon atoms, a cycloalkyl group, an aryl group, a heterocyclic group including fused unsaturated rings of 5 to 6 members or an amino group;

(II)

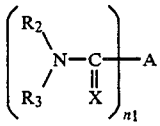

wherein $R_2$ and $R_3$ each represent a hydrogen atom, an alkyl group having 1 to 6 carbon atoms, a hydroxy group, a carboxy group, an amino group, an acyl group having 1 to 3 carbon atoms, an aryl group or an alkenyl group; A represents

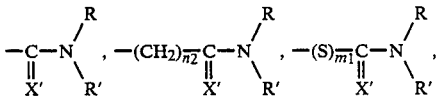

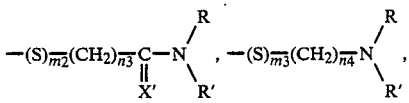

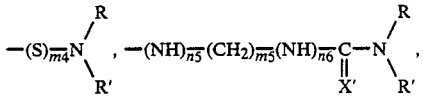

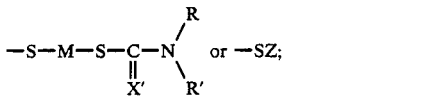

or a hetero ring residue of $n_1$ valence including fused unsaturated rings of 5 to 6 members, X represents =S, =O or =NR''; where, R and R' are the same as $R_2$ and $R_3$, respectively; X' is the same as X; Z represents a hydrogen atom, an alkali metal atom, an ammonium group, an amino group, a nitrogen-containing heterocyclic residue, an alkyl group or

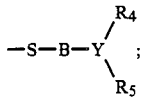

M represents a divalent metal atom; R'' represents a hydrogen atom, an alkyl group having 1 to 6 carbon atom, a cycloalkyl group, an aryl group, a heterocyclic residue including fused unsaturated rings of 5 to 6 members or an amino group; $n_1$ to $n_6$ and $m_1$ to $m_5$ each represent an integer of 1 to 6; B represents an alkylene group having 1 to 6 carbon atoms; Y represents —N< or —CH<; and $R_4$ and $R_5$ are the same as $R_2$ and $R_3$, respectively; provided that $R_4$ and $R_5$ may each represent —B—SZ, and also $R_2$ and $R_3$, R and R', and $R_4$ and $R_5$ may be bonded together to form a ring; the compounds represented by said formula are also inclusive of ethanolated derivatives and salts thereof;

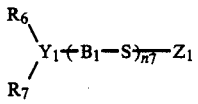

(III)

wherein $R_6$ and $R_7$ each represent a hydrogen atom, an alkyl group having 1 to 6 carbon atoms, a hydroxy group, a carboxy group, an amino group, an acyl group having 1 to 3 carbon atoms, an aryl group, an alkenyl group or $—B_1—S—Z_1$; provided that $R_6$ and $R_7$ may be bonded together to form a ring; $Y_1$ represents >N— or >CH—; $B_1$ represents an alkylene group having 1 to 6 carbon atoms; $Z_1$ represents a hydrogen atom, an alkali metal atom, an ammonium group, an amino group, a nitrogen-containing heterocyclic residue or

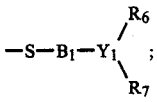

and $n_7$ represents an integer of 1 to 6;

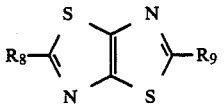

(IV)

wherein $R_8$ and $R_9$ each represent

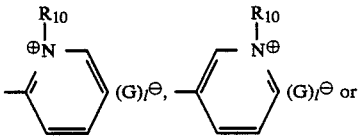

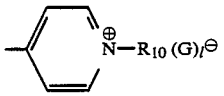

$R_{10}$ represents an alkyl group or $—(CH_2)_{n8}SO_3^{\ominus}$ provided that when $R_{10}$ is $—(CH_2)_{n8}SO_3^{\ominus}$, l represents 0, and when an alkyl group, it represents 1; $G^{\ominus}$ represents an anion; $n_8$ represents an integer of 1 to 6;

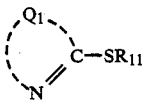

(V)

wherein $Q_1$ represents a group of atoms necessary for formation of a nitrogen-containing hetero ring including fused unsaturated rings or saturated rings of 5 to 6 members; $R_{11}$ represents a hydrogen atom,

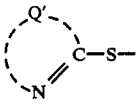

or an alkyl group; provided that Q' is the same as $Q_1$;

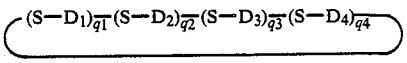

(VI)

wherein $D_1$, $D_2$, $D_3$ and $D_4$ each represent a mere bonding arm, an alkylene group having 1 to 8 carbon atoms or a vinylene group; $q_1$, $q_2$, $q_3$ and $q_4$ each represent 0, 1 or 2; the ring formed together with sulfur atom may be further fused with a saturated or unsaturated ring of 5 to 6 members;

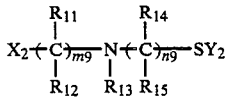

(VII)

wherein $X_2$ represents —COOM', —OH, $—SO_3M'$, $—CONH_2$, $—SO_2NH_2$, $—NH_2$, —SH, —CN, $—CO_2R_{16}$, $—SO_2R_{16}$, $—OR_{16}$, $—NH_{16}R_{17}$, $—SR_{16}$, $—SO_3R_{16}$, $—NHCOR_{16}$, $—NHSO_2R_{16}$, $—OCOR_{16}$ or $—SO_2R_{16}$; $Y_2$ represents

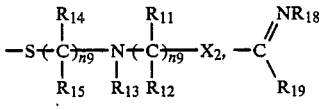

or a hydrogen atom; $m_9$ and $n_9$ each represent an integer of 1 to 10; $R_{11}$, $R_{12}$, $R_{14}$, $R_{15}$, $R_{17}$ and $R_{18}$ each represent a hydrogen atom, a lower alkyl group, an acyl group or

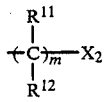

where $R^{11}$ and $R^{12}$ each have the same meanings as the above $R_{11}$ and $R_{12}$, respectively; $R_{16}$ represents a lower alkyl group; $R_{19}$ represents $—NR_{20}R_{21}$, $—OR_{22}$ or $—SR_{22}$; $R_{20}$ and $R_{21}$ each represent a hydrogen atom or a lower alkyl group; $R_{22}$ represents a group of atoms necessary for formation of a ring by bonding to $R_{18}$; $R_{20}$ or $R_{21}$ may also form a ring by bonding to $R_{18}$; M' represents a hydrogen atom or a cation;

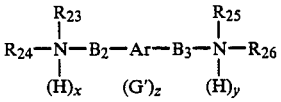

(VIII)

wherein Ar represents a divalent aryl group or divalent organic group comprising a combination of an aryl group with oxygen atom and/or an alkylene group; $B_2$ and $B_3$ each represent a lower alkylene group; $R_{23}$, $R_{24}$, $R_{25}$ and $R_{26}$ each represent a hydroxy-substituted lower alkylene group; x and y each represent 0 or 1; G' represents an anion; and z represents 0, 1 or 2;

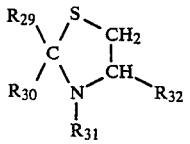

(IX)

wherein $R_{29}$ and $R_{30}$ each represent a hydrogen atom, an alkyl group, an aryl group or a heterocyclic group; $R_{31}$ represents a hydrogen atom or an alkyl group; and $R_{32}$ represents a hydrogen atom or a carboxy group.

17. The method according to claim 1, wherein said light-sensitive silver halide color photographic material contains at least one magenta coupler represented by the formula (M - I):

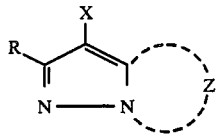

(M-I)

wherein Z represents a metal atom group necessary for forming a nitrogen-containing heterocyclic ring, and a ring formed by said Z may have a substituent or substituents; X represents a hydrogen atom or a group eliminatable through the reaction with an oxidized product of a color developing agent; and R represents a hydrogen atom or a substituent.

18. The method according to claim 17, wherein said magenta coupler is selected from the group of the formulae (M - II) to (M - VII):

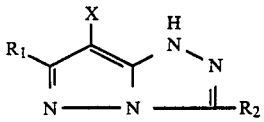

(M-II)

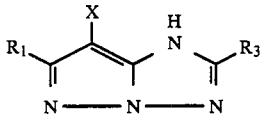

(M-III)

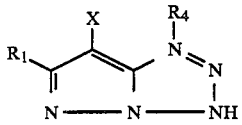

(M-IV)

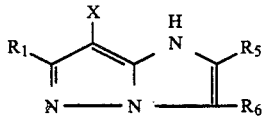

(M-V)

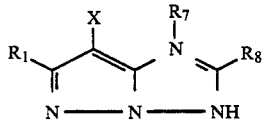

(M-VI)

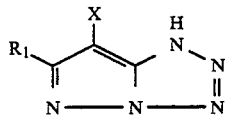

(M-VII)

wherein $R_1$ to $R_8$ and X have the same meanings as the R and X defined in claim 17.

* * * * *